US010176814B2

(12) United States Patent
Kim

(10) Patent No.: US 10,176,814 B2
(45) Date of Patent: Jan. 8, 2019

(54) HIGHER ORDER AMBISONICS SIGNAL COMPRESSION

(71) Applicant: QUALCOMM Incorporated, San Diego, CA (US)

(72) Inventor: Moo Young Kim, San Diego, CA (US)

(73) Assignee: QUALCOMM Incorporated, San Diego, CA (US)

( * ) Notice: Subject to any disclaimer, the term of this patent is extended or adjusted under 35 U.S.C. 154(b) by 0 days.

(21) Appl. No.: 15/823,284

(22) Filed: Nov. 27, 2017

(65) Prior Publication Data

US 2018/0082694 A1 Mar. 22, 2018

Related U.S. Application Data

(62) Division of application No. 14/712,661, filed on May 14, 2015, now Pat. No. 9,847,087.

(60) Provisional application No. 61/994,800, filed on May 16, 2014, provisional application No. 62/004,145, filed on May 28, 2014.

(51) Int. Cl.

| | |
|---|---|
| ***G10L 19/008*** | (2013.01) |
| ***G10L 19/002*** | (2013.01) |
| ***H04S 3/00*** | (2006.01) |

(52) U.S. Cl.

CPC ..... *G10L 19/008* (2013.01); *G10L 19/002* (2013.01); *H04S 3/008* (2013.01); *H04S 2420/11* (2013.01)

(58) Field of Classification Search

None

See application file for complete search history.

(56) References Cited

U.S. PATENT DOCUMENTS

| | | | |
|---|---|---|---|
| 8,965,775 | B2 | 2/2015 | Virette et al. |
| 9,847,087 | B2 | 12/2017 | Kim et al. |
| 2009/0083045 | A1 | 3/2009 | Briand et al. |
| 2011/0249822 | A1 | 10/2011 | Jaillet et al. |
| 2012/0155653 | A1 | 6/2012 | Jax et al. |

(Continued)

FOREIGN PATENT DOCUMENTS

| | | | |
|---|---|---|---|
| WO | 2014046916 | A1 | 3/2014 |
| WO | 2014194099 | A1 | 12/2014 |
| WO | 2014210284 | A1 | 12/2014 |

OTHER PUBLICATIONS

Audio, "Call for Proposals for 3D Audio," International Organisation for Standardisation Organisation Internationale de Normalisation ISO/IEC JTC1/SC29/WG11 Coding of Moving Pictures and Audio, ISO/IEC JTC1/SC29/WG11/N13411, Geneva, Jan. 2013, pp. 1-20.

(Continued)

*Primary Examiner* — Paul Huber

(74) *Attorney, Agent, or Firm* — Shumaker & Sieffert, P.A.

(57) ABSTRACT

Systems and techniques for compression and decoding of audio data are generally disclosed. An example device for compressing higher order ambisonic (HOA) coefficients representative of a soundfield includes a memory configured to store audio data and one or more processors configured to: determine when to use ambient HOA coefficients of the HOA coefficients to augment one or more foreground audio objects obtained through decomposition of the HOA coefficients based on one or more singular values also obtained through the decomposition of the HOA coefficients, the ambient HOA coefficients representative of an ambient component of the soundfield.

25 Claims, 15 Drawing Sheets

(56) References Cited

U.S. PATENT DOCUMENTS

| | | | |
|---|---|---|---|
| 2012/0259644 | A1 | 10/2012 | Lin et al. |
| 2014/0358557 | A1 | 12/2014 | Sen et al. |
| 2014/0358565 | A1 | 12/2014 | Peters et al. |
| 2015/0213803 | A1 | 7/2015 | Peters et al. |
| 2016/0148618 | A1 | 5/2016 | Huang et al. |

OTHER PUBLICATIONS

Bartkowiak M., et al., "Object-Based Data Compression for Massive Multichannel Audio," 15th International Symposium on New Trends in Audio and Video, Sep. 25-27, 2014, pp. 1-8.

Boehm J., et al., "Proposed changes to the bitstream of RM0-HOA for integration of Qualcomm CE," 107. MPEG Meeting; Jan. 13, 2014-Jan. 17, 2014; San Jose, CA (Motion Picture Expert Group or ISO/IECJTC1/SC29/WG11), No. M32246, Jan. 8, 2014 (Jan. 8, 2014), XP030060698, pp. 1-30.

Herre et al., "MPEG-H 3D Audio—The New Standard for Coding of Immersive Spatial Audio," IEEE Journal of Selected Topics in Signal Processing, vol. 9, No. 5, Aug. 2015, 10 pp.

"Information technology—High efficiency coding and media delivery in heterogeneous environments—Part 3: 3D Audio." ISO/IEC JTC 1/SC 29N, Apr. 4, 2014, 337 pp.

"Information technology—High efficiency coding and media delivery in heterogeneous environments—Part 3: 3D Audio," ISO/IEC JTC 1/SC 29N, Jul. 25, 2005, 311 pp.

"Information technology—High efficiency coding and media delivery in heterogeneous environments—Part 3: Part 3: 3D Audio, Amendment 3: MPEG-H 3D Audio Phase 2," ISO/IEC JTC 1/SC 29N, Jul. 25, 2015, 208 pp.

International Search Report and Written Opinion—PCT/US2015/031072—ISA/EPO—Oct. 28, 2015, 20 pp.

Poletti M., "Three-Dimensional Surround Sound Systems Based on Spherical Harmonics," The Journal of the Audio Engineering Society, Nov. 2005, pp. 1004-1025, vol. 53 (11).

Response to Second Written Opinion dated Jun. 24, 2016, from International Application No. PCT/US2015/031072, filed on Jul. 22, 2016, 20 pp.

Response to Written Opinion dated Oct. 28, 2015, from International Application No. PCT/US2015/031072, filed on Mar. 16, 2016, 7 pp.

Second Written Opinion from International Application No. PCT/US2015/031072, dated Jun. 24, 2016, 11 pp.

Sen D., et al., "RM1-HOA Working Draft Text," 107. MPEG Meeting; Jan. 13, 2014-Jan. 17, 2014; San Jose, CA (Motion Picture Expert Group or ISO/IEC JTC1/SC29/WG11), No. M31827, Jan. 11, 2014 (Jan. 11, 2014), XP030060280, pp. 83.

Trevino J., et al., "High order Ambisonic decoding method for irregular loudspeaker arrays," Proceedings of 28th International Congress on Acoustics, Aug. 23, 2010 (Aug. 23, 2010), XP055115491.

International Preliminary Report on Patentability from International Application No. PCT/US2015/031072, dated Sep. 14, 2016, 18 pp.

"WD1-HOA Text of MPEG-H 3D Audio", 107. MPEG Meeting; Jan. 13, 2014-Jan. 17, 2014; San Jose; (Motion Picture Expert Group or ISO/IEC JTC1/SC29/WG11) No. N14264, Feb. 21, 2014 (Feb. 21. 2014), XP030021001, the whole document.

HIGHER ORDER AMBISONICS SIGNAL COMPRESSION

This application is a divisional of U.S. Utility application Ser. No. 14/712,661, filed 14 May 2015, which claims priority to U.S. Provisional Application No. 61/994,800, filed 16 May 2014, and to U.S. Provisional Application No. 62/004,145, filed 28 May 2014, the entire contents of each of which are incorporated herein by reference.

TECHNICAL FIELD

This disclosure relates to audio data and, more specifically, compression of audio data.

BACKGROUND

A higher-order ambisonics (HOA) signal (often represented by a plurality of spherical harmonic coefficients (SHC) or other hierarchical elements) is a three-dimensional representation of a soundfield. The HOA or SHC representation may represent the soundfield in a manner that is independent of the local speaker geometry used to playback a multi-channel audio signal rendered from the SHC signal. The SHC signal may also facilitate backwards compatibility as the SHC signal may be rendered to well-known and highly adopted multi-channel formats, such as a 5.1 audio channel format or a 7.1 audio channel format. The SHC representation may therefore enable a better representation of a soundfield that also accommodates backward compatibility.

SUMMARY

In general, techniques are described for higher order ambisonics (HOA) compression. In various examples, the techniques are based one or more of energies (or energy values) associated with audio objects, and on bit allocation mechanisms.

In one aspect, a method of compressing higher order ambisonic (HOA) coefficients representative of a soundfield includes determining when to use ambient HOA coefficients of the HOA coefficients to augment one or more foreground audio objects obtained through decomposition of the HOA coefficients based on one or more singular values also obtained through the decomposition of the HOA coefficients, the ambient HOA coefficients representative of an ambient component of the soundfield.

In another aspect, a method of decoding encoded decoding encoded higher order ambisonics (HOA) coefficients representative of a soundfield includes allocating bits to an audio object of the soundfield, based on an energy associated with the audio object, the audio object being obtained through decomposition of the encoded HOA coefficients.

In another aspect, a device for compressing higher order ambisonic (HOA) coefficients representative of a soundfield includes a memory configured to store audio data and one or more processors configured to: determine when to use ambient HOA coefficients of the HOA coefficients to augment one or more foreground audio objects obtained through decomposition of the HOA coefficients based on one or more singular values also obtained through the decomposition of the HOA coefficients, the ambient HOA coefficients representative of an ambient component of the soundfield.

In another aspect, a device for compressing higher order ambisonic (HOA) coefficients representative of a soundfield, the device includes means for determining when to use ambient HOA coefficients of the HOA coefficients to augment one or more foreground audio objects obtained through decomposition of the HOA coefficients based on one or more singular values also obtained through the decomposition of the HOA coefficients, the ambient HOA coefficients representative of an ambient component of the soundfield.

The details of one or more aspects of the techniques are set forth in the accompanying drawings and the description below. Other features, objects, and advantages of the techniques will be apparent from the description and drawings, and from the claims.

DETAILED DESCRIPTION

Figure 1:
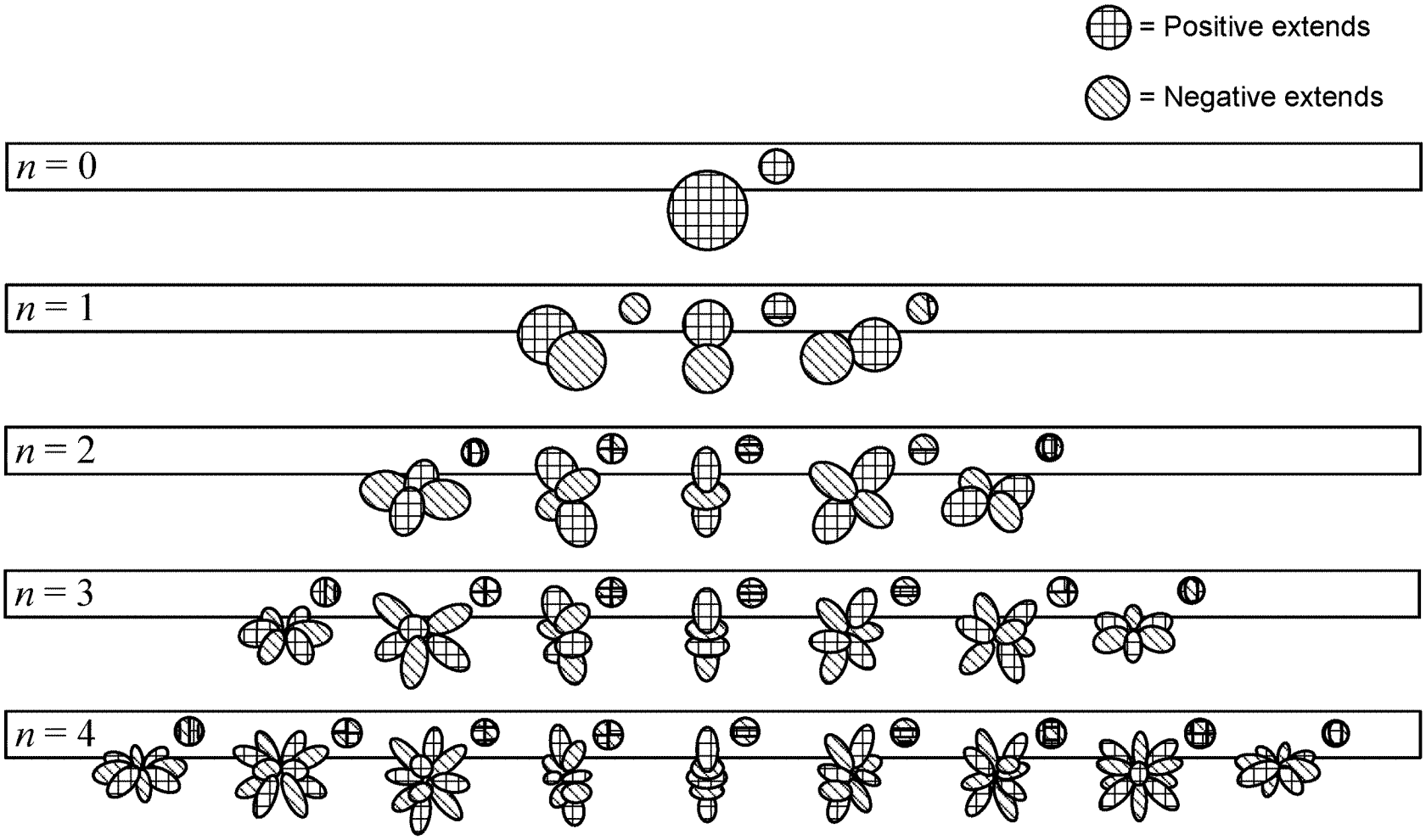
FIG. 1 is a diagram illustrating spherical harmonic basis functions of various orders and sub-orders.

The evolution of surround sound has made available many output formats for entertainment nowadays. Examples of such consumer surround sound formats are mostly 'channel' based in that they implicitly specify feeds to loudspeakers in certain geometrical coordinates. The consumer surround sound formats include the popular 5.1 format (which includes the following six channels: front left (FL), front right (FR), center or front center, back left or surround left, back right or surround right, and low frequency effects (LFE)), the growing 7.1 format, various formats that includes height speakers such as the 7.1.4 format and the 22.2 format (e.g., for use with the Ultra High Definition Television standard). Non-consumer formats can span any number of speakers (in symmetric and non-symmetric geometries) often termed 'surround arrays'. One example of such an array includes 32 loudspeakers positioned on coordinates on the corners of a truncated icosahedron.

The input to a future MPEG encoder is optionally one of three possible formats: (i) traditional channel-based audio (as discussed above), which is meant to be played through loudspeakers at pre-specified positions; (ii) object-based audio, which involves discrete pulse-code-modulation (PCM) data for single audio objects with associated metadata containing their location coordinates (amongst other information); and (iii) scene-based audio, which involves representing the soundfield using coefficients of spherical harmonic basis functions (also called "spherical harmonic coefficients" or SHC, "Higher-order Ambisonics" or HOA, and "HOA coefficients"). The future MPEG encoder may be described in more detail in a document entitled "Call for Proposals for 3D Audio," by the International Organization for Standardization/International Electrotechnical Commission (ISO)/(IEC) JTC1/SC29/WG11/N13411, released January 2013 in Geneva, Switzerland, and available at http://mpeg.chiariglione.org/sites/default/files/files/standards/parts/docs/w13411.zip.

There are various 'surround-sound' channel-based formats in the market. They range, for example, from the 5.1 home theatre system (which has been the most successful in terms of making inroads into living rooms beyond stereo) to the 22.2 system developed by NHK (Nippon Hoso Kyokai or Japan Broadcasting Corporation). Content creators (e.g., Hollywood studios) would like to produce the soundtrack for a movie once, and not spend effort to remix it for each speaker configuration. Recently, Standards Developing Organizations have been considering ways in which to provide an encoding into a standardized bitstream and a subsequent decoding that is adaptable and agnostic to the speaker geometry (and number) and acoustic conditions at the location of the playback (involving a renderer).

To provide such flexibility for content creators, a hierarchical set of elements may be used to represent a soundfield. The hierarchical set of elements may refer to a set of elements in which the elements are ordered such that a basic set of lower-ordered elements provides a full representation of the modeled soundfield. As the set is extended to include higher-order elements, the representation becomes more detailed, increasing resolution.

One example of a hierarchical set of elements is a set of spherical harmonic coefficients (SHC). The following expression demonstrates a description or representation of a soundfield using SHC:

$$p_i(t, r_r, \theta_r, \varphi_r) = \sum_{\omega=0}^{\infty}\left[4\pi\sum_{n=0}^{\infty} j_n(kr_r)\sum_{m=-n}^{n} A_n^m(k)Y_n^m(\theta_r, \varphi_r)\right]e^{j\omega t},$$

The expression shows that the pressure $p_i$ at any point $\{r_r, \theta_r, \varphi_r\}$ of the soundfield, at time t, can be represented uniquely by the SHC, $A_n^m(k)$. Here, $k=\omega/c$ is the speed of sound (~343 m/s), $\{r_r, \theta_r, \varphi_r\}$ is a point of reference (or observation point), $j_n(\bullet)$ is the spherical Bessel function of order n, and $Y_n^m(\theta_r,\varphi_r)$ are the spherical harmonic basis functions of order n and suborder m. It can be recognized that the term in square brackets is a frequency-domain representation of the signal (i.e., $S(\omega,r_r,\theta_r,\varphi_r)$) which can be approximated by various time-frequency transformations, such as the discrete Fourier transform (DFT), the discrete cosine transform (DCT), or a wavelet transform. Other examples of hierarchical sets include sets of wavelet transform coefficients and other sets of coefficients of multiresolution basis functions.

FIG. 1 is a diagram illustrating spherical harmonic basis functions from the zero order (n=0) to the fourth order (n=4). As can be seen, for each order, there is an expansion of suborders m which are shown but not explicitly noted in the example of FIG. 1 for ease of illustration purposes.

The SHC $A_n^m(k)$ can either be physically acquired (e.g., recorded) by various microphone array configurations or, alternatively, they can be derived from channel-based or object-based descriptions of the soundfield. The SHC represent scene-based audio, where the SHC may be input to an audio encoder to obtain encoded SHC that may promote more efficient transmission or storage. For example, a fourth-order representation involving $(1+4)^2$ (25, and hence fourth order) coefficients may be used.

As noted above, the SHC may be derived from a microphone recording using a microphone array. Various examples of how SHC may be derived from microphone arrays are described in Poletti, M., "Three-Dimensional Surround Sound Systems Based on Spherical Harmonics," J. Audio Eng. Soc., Vol. 53, No. 11, 2005 November, pp. 1004-1025.

To illustrate how the SHCs may be derived from an object-based description, consider the following equation. The coefficients $A_n^m(k)$ for the soundfield corresponding to an individual audio object may be expressed as:

$$A_n^m(k)=g(\omega)(-4\pi ik)h_n^{(2)}(kr_s)Y_n^{m*}(\theta_s,\varphi_s),$$

where i is $\sqrt{-1}$, $h_n^{(2)}(\bullet)$ is the spherical Hankel function (of the second kind) of order n, and $\{r_s,\theta_s,\varphi_s\}$ is the location of the object. Knowing the object source energy $g(\omega)$ as a function of frequency (e.g., using time-frequency analysis techniques, such as performing a fast Fourier transform on the PCM stream) allows us to convert each PCM object and the corresponding location into the SHC $A_n^m(k)$. Further, it can be shown (since the above is a linear and orthogonal decomposition) that the $A_n^m(k)$ coefficients for each object are additive. In this manner, a multitude of PCM objects can be represented by the $A_n^m(k)$ coefficients (e.g., as a sum of the coefficient vectors for the individual objects). Essentially, the coefficients contain information about the soundfield (the pressure as a function of 3D coordinates), and the above represents the transformation from individual objects to a representation of the overall soundfield, in the vicinity of the observation point $\{r_r,\theta_r,\varphi_r\}$. The remaining figures are described below in the context of object-based and SHC-based audio coding.

Figure 2:
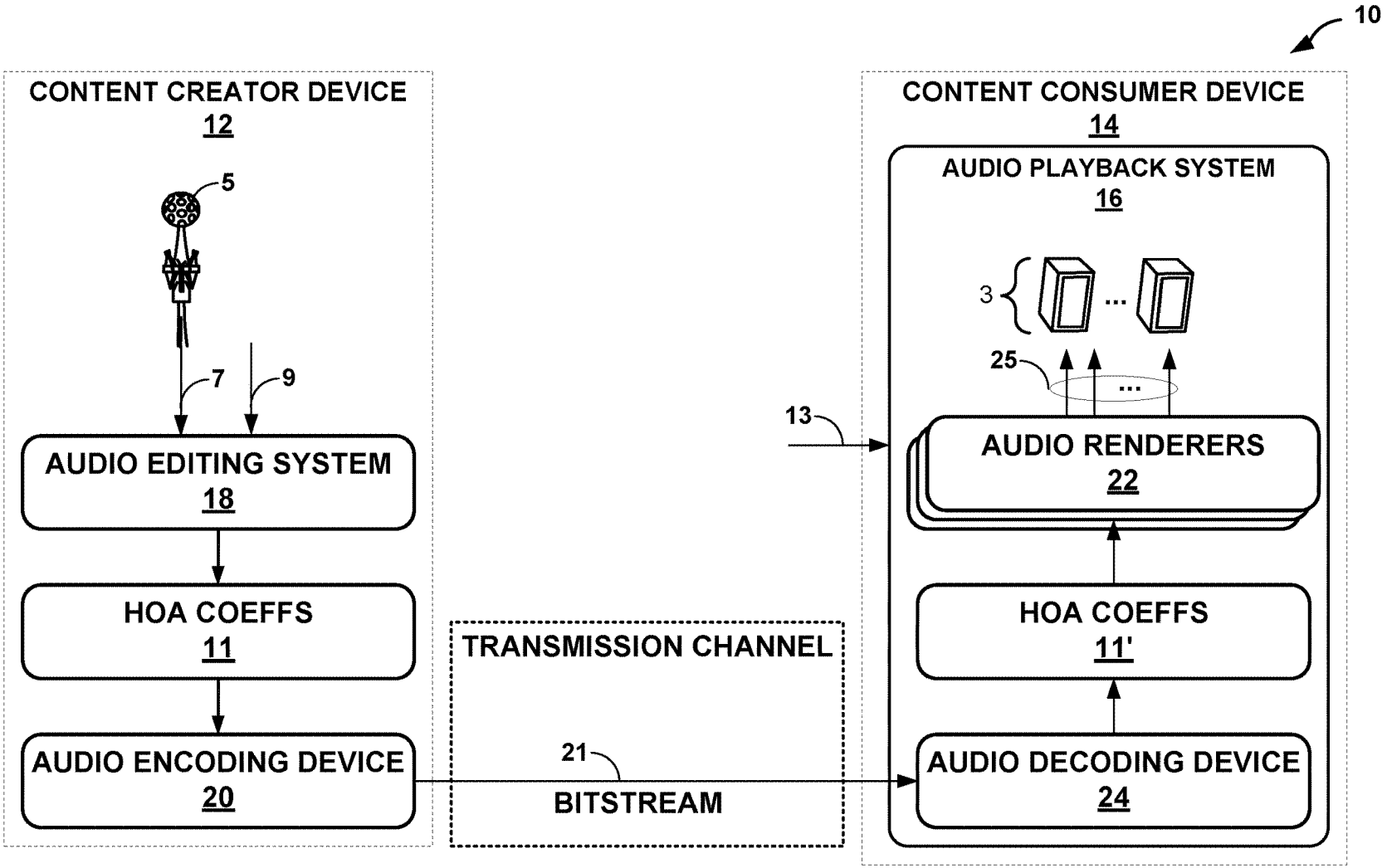
FIG. 2 is a diagram illustrating a system that may perform various aspects of the techniques described in this disclosure.

FIG. 2 is a diagram illustrating a system 10 that may perform various aspects of the techniques described in this disclosure. As shown in the example of FIG. 2, the system 10 includes a content creator device 12 and a content consumer device 14. While described in the context of the content creator device 12 and the content consumer device 14, the techniques may be implemented in any context in which SHCs (which may also be referred to as HOA coefficients) or any other hierarchical representation of a soundfield are encoded to form a bitstream representative of the audio data. Moreover, the content creator device 12 may represent any form of computing device capable of implementing the techniques described in this disclosure, including a handset (or cellular phone), a tablet computer, a smart phone, or a desktop computer to provide a few examples. Likewise, the content consumer device 14 may represent any form of computing device capable of implementing the techniques described in this disclosure, including a handset (or cellular phone), a tablet computer, a smart phone, a set-top box, or a desktop computer to provide a few examples.

The content creator device 12 may be operated by a movie studio or other entity that may generate multi-channel audio content for consumption by operators of content consumer devices, such as the content consumer device 14. In some examples, the content creator device 12 may be operated by an individual user who would like to compress HOA coefficients 11. Often, the content creator generates audio content in conjunction with video content. The content consumer device 14 may be operated by an individual. The content consumer device 14 may include an audio playback system 16, which may refer to any form of audio playback system capable of rendering SHC for play back as multi-channel audio content.

The content creator device 12 includes an audio editing system 18. The content creator device 12 obtain live recordings 7 in various formats (including directly as HOA coefficients) and audio objects 9, which the content creator device 12 may edit using audio editing system 18. A microphone 5 may capture the live recordings 7. The content creator may, during the editing process, render HOA coefficients 11 from audio objects 9, listening to the rendered speaker feeds in an attempt to identify various aspects of the soundfield that require further editing. The content creator device 12 may then edit HOA coefficients 11 (potentially indirectly through manipulation of different ones of the audio objects 9 from which the source HOA coefficients may be derived in the manner described above). The content creator device 12 may employ the audio editing system 18 to generate the HOA coefficients 11. The audio editing system 18 represents any system capable of editing audio data and outputting the audio data as one or more source spherical harmonic coefficients. In some examples, the microphone 5 may include, be, or be part of a three-dimensional (3D) microphone.

When the editing process is complete, the content creator device 12 may generate a bitstream 21 based on the HOA coefficients 11. That is, the content creator device 12 includes an audio encoding device 20 that represents a device configured to encode or otherwise compress HOA coefficients 11 in accordance with various aspects of the techniques described in this disclosure to generate the bitstream 21. The audio encoding device 20 may generate the bitstream 21 for transmission, as one example, across a transmission channel, which may be a wired or wireless channel, a data storage device, or the like. The bitstream 21 may represent an encoded version of the HOA coefficients 11 and may include a primary bitstream and another side bitstream, which may be referred to as side channel information.

While shown in FIG. 2 as being directly transmitted to the content consumer device 14, the content creator device 12 may output the bitstream 21 to an intermediate device positioned between the content creator device 12 and the content consumer device 14. The intermediate device may store the bitstream 21 for later delivery to the content consumer device 14, which may request the bitstream. The intermediate device may comprise a file server, a web server, a desktop computer, a laptop computer, a tablet computer, a mobile phone, a smart phone, or any other device capable of storing the bitstream 21 for later retrieval by an audio decoder. The intermediate device may reside in a content delivery network capable of streaming the bitstream 21 (and possibly in conjunction with transmitting a corresponding video data bitstream) to subscribers, such as the content consumer device 14, requesting the bitstream 21.

Alternatively, the content creator device 12 may store the bitstream 21 to a storage medium, such as a compact disc, a digital video disc, a high definition video disc or other storage media, most of which are capable of being read by a computer and therefore may be referred to as computer-readable storage media or non-transitory computer-readable storage media. In this context, the transmission channel may refer to the channels by which content stored to the mediums are transmitted (and may include retail stores and other store-based delivery mechanism). In any event, the techniques of this disclosure should not therefore be limited in this respect to the example of FIG. 2.

As further shown in the example of FIG. 2, the content consumer device 14 includes the audio playback system 16. The audio playback system 16 may represent any audio playback system capable of playing back multi-channel audio data. The audio playback system 16 may include a number of different renderers 22. The renderers 22 may each provide for a different form of rendering, where the different forms of rendering may include one or more of the various ways of performing vector-base amplitude panning (VBAP), and/or one or more of the various ways of performing soundfield synthesis. As used herein, "A and/or B" means "A or B", or both "A and B".

The audio playback system 16 may further include an audio decoding device 24. The audio decoding device 24 may represent a device configured to decode HOA coefficients 11' from the bitstream 21, where the HOA coefficients 11' may be similar to the HOA coefficients 11 but differ due to lossy operations (e.g., quantization) and/or transmission via the transmission channel. The audio playback system 16 may, after decoding the bitstream 21 to obtain the HOA coefficients 11' and render the HOA coefficients 11' to output loudspeaker feeds 25. The loudspeaker feeds 25 may drive one or more loudspeakers (which are not shown in the example of FIG. 2 for ease of illustration purposes).

To select the appropriate renderer or, in some instances, generate an appropriate renderer, the audio playback system 16 may obtain loudspeaker information 13 indicative of a number of loudspeakers and/or a spatial geometry of the loudspeakers. In some instances, the audio playback system 16 may obtain the loudspeaker information 13 using a reference microphone and driving the loudspeakers in such a manner as to dynamically determine the loudspeaker information 13. In other instances or in conjunction with the dynamic determination of the loudspeaker information 13, the audio playback system 16 may prompt a user to interface with the audio playback system 16 and input the loudspeaker information 13.

The audio playback system 16 may then select one of the audio renderers 22 based on the loudspeaker information 13. In some instances, the audio playback system 16 may, when none of the audio renderers 22 are within some threshold similarity measure (in terms of the loudspeaker geometry) to the loudspeaker geometry specified in the loudspeaker information 13, generate the one of audio renderers 22 based on the loudspeaker information 13. The audio playback system 16 may, in some instances, generate one of the audio renderers 22 based on the loudspeaker information 13 without first attempting to select an existing one of the audio renderers 22. One or more speakers 3 may then playback the rendered loudspeaker feeds 25.

Figure 3:
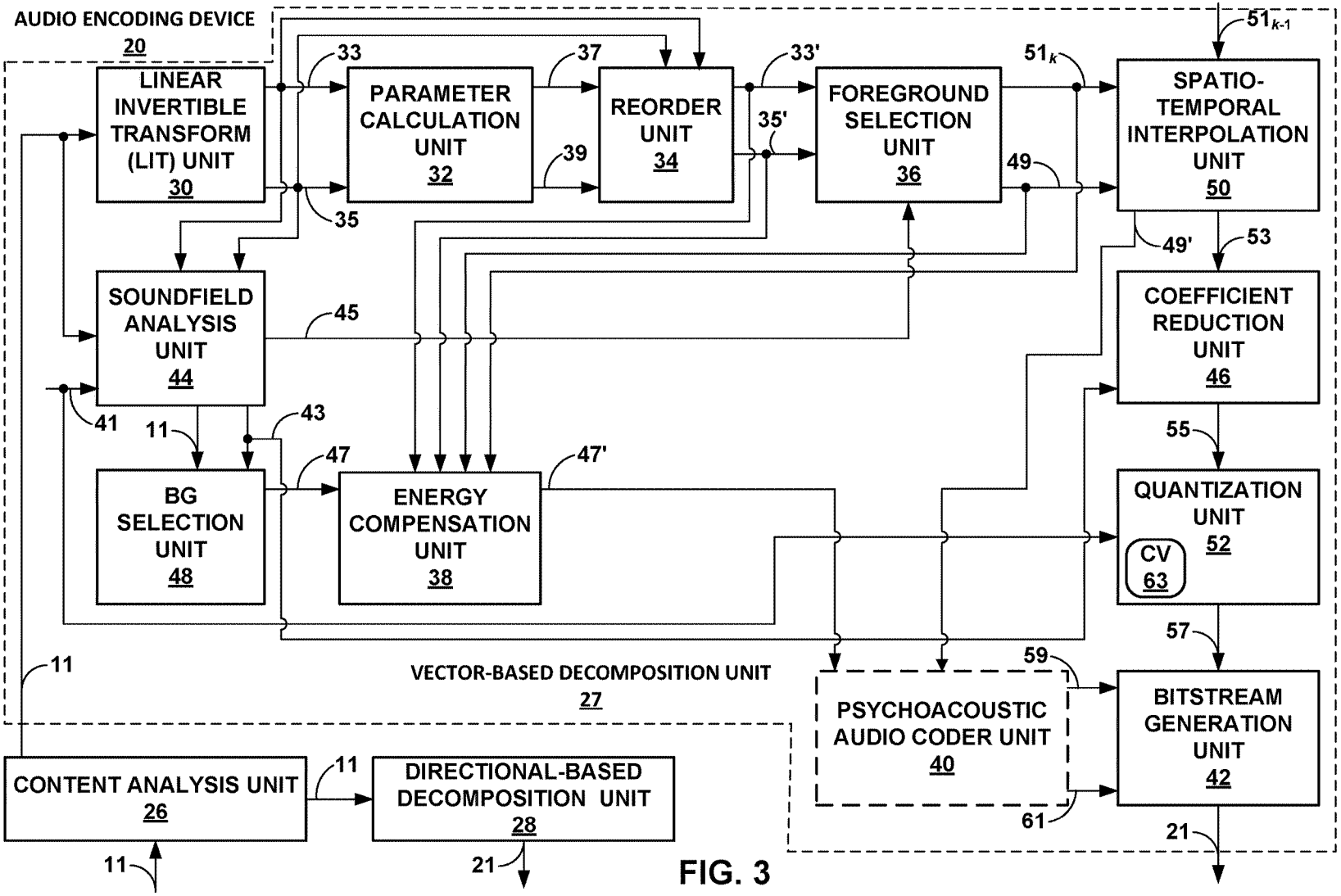
FIG. 3 is a block diagram illustrating, in more detail, one example of the audio encoding device shown in the example of FIG. 2 that may perform various aspects of the techniques described in this disclosure.

FIG. 3 is a block diagram illustrating, in more detail, one example of the audio encoding device 20 shown in the example of FIG. 2 that may perform various aspects of the techniques described in this disclosure. The audio encoding device 20 includes a content analysis unit 26, a vector-based decomposition unit 27 and a directional-based decomposition unit 28. Although described briefly below, more information regarding the audio encoding device 20 and the various aspects of compressing or otherwise encoding HOA coefficients is available in International Patent Application Publication No. WO 2014/194099, entitled "INTERPOLATION FOR DECOMPOSED REPRESENTATIONS OF A SOUND FIELD," filed 29 May 2014.

The content analysis unit 26 represents a unit configured to analyze the content of the HOA coefficients 11 to identify whether the HOA coefficients 11 represent content generated from a live recording or an audio object. The content analysis unit 26 may determine whether the HOA coefficients 11 were generated from a recording of an actual soundfield or from an artificial audio object. In some instances, when the framed HOA coefficients 11 were generated from a recording, the content analysis unit 26 passes the HOA coefficients 11 to the vector-based decomposition unit 27. In some instances, when the framed HOA coefficients 11 were generated from a synthetic audio object, the content analysis unit 26 passes the HOA coefficients 11 to the directional-based synthesis unit 28. The directional-based synthesis unit 28 may represent a unit configured to perform a directional-based synthesis of the HOA coefficients 11 to generate a directional-based bitstream 21.

As shown in the example of FIG. 3, the vector-based decomposition unit 27 may include a linear invertible transform (LIT) unit 30, a parameter calculation unit 32, a reorder unit 34, a foreground selection unit 36, an energy compensation unit 38, a psychoacoustic audio coder unit 40 (optional), a bitstream generation unit 42, a soundfield analysis unit 44, a coefficient reduction unit 46, a background (BG) selection unit 48, a spatio-temporal interpolation unit 50, and a quantization unit 52. The psychoacoustic audio coder unit 40 is shown with dashed-line borders in FIG. 3, to illustrate the optional nature of the psychoacoustic audio coder unit 40 with respect to different implementations of the audio encoding device 20.

The linear invertible transform (LIT) unit 30 receives the HOA coefficients 11 in the form of HOA channels, each channel representative of a block or frame of a coefficient associated with a given order, sub-order of the spherical basis functions (which may be denoted as HOA[k], where k may denote the current frame or block of samples). The matrix of HOA coefficients 11 may have dimensions D: $M\times(N+1)^2$.

The LIT unit 30 may represent a unit configured to perform a form of analysis referred to as singular value decomposition. While described with respect to SVD, the techniques described in this disclosure may be performed with respect to any similar transformation or decomposition that provides for sets of linearly uncorrelated, energy compacted output. Also, reference to "sets" in this disclosure is generally intended to refer to non-zero sets unless specifically stated to the contrary and is not intended to refer to the classical mathematical definition of sets that includes the so-called "empty set." An alternative transformation may comprise a principal component analysis, which is often referred to as "PCA." Depending on the context, PCA may be referred to by a number of different names, such as discrete Karhunen-Loeve transform, the Hotelling transform, proper orthogonal decomposition (POD), and eigenvalue decomposition (EVD) to name a few examples. Properties of such operations that are conducive to the underlying goal of compressing audio data are 'energy compaction' and 'decorrelation' of the multichannel audio data.

In any event, assuming the LIT unit 30 performs a singular value decomposition (which, again, may be referred to as "SVD") for purposes of example, the LIT unit 30 may transform the HOA coefficients 11 into two or more sets of transformed HOA coefficients. The "sets" of transformed HOA coefficients may include vectors of transformed HOA coefficients. In the example of FIG. 3, the LIT unit 30 may perform the SVD with respect to the HOA coefficients 11 to generate a so-called V matrix, an S matrix, and a U matrix. SVD, in linear algebra, may represent a factorization of a y-by-z real or complex matrix X (where X may represent multi-channel audio data, such as the HOA coefficients 11) in the following form:

$$X=USV^*$$

U may represent a y-by-y real or complex unitary matrix, where the y columns of U are known as the left-singular vectors of the multi-channel audio data. S may represent a y-by-z rectangular diagonal matrix with non-negative real numbers on the diagonal, where the diagonal values of S are known as the singular values of the multi-channel audio data. V* (which may denote a conjugate transpose of V) may represent a z-by-z real or complex unitary matrix, where the z columns of V* are known as the right-singular vectors of the multi-channel audio data.

In some examples, the V* matrix in the SVD mathematical expression referenced above is denoted as the conjugate transpose of the V matrix to reflect that SVD may be applied to matrices comprising complex numbers. When applied to matrices comprising only real-numbers, the complex conjugate of the V matrix (or, in other words, the V* matrix) may be considered to be the transpose of the V matrix. Below it is assumed, for ease of illustration purposes, that the HOA coefficients 11 comprise real-numbers with the result that the V matrix is output through SVD rather than the V* matrix. Moreover, while denoted as the V matrix in this disclosure, reference to the V matrix should be understood to refer to the transpose of the V matrix where appropriate. While assumed to be the V matrix, the techniques may be applied in a similar fashion to HOA coefficients 11 having complex coefficients, where the output of the SVD is the V* matrix. Accordingly, the techniques should not be limited in this respect to only provide for application of SVD to generate a V matrix, but may include application of SVD to HOA coefficients 11 having complex components to generate a V* matrix.

In this way, the LIT unit 30 may perform SVD with respect to the HOA coefficients 11 to output US[k] vectors 33 (which may represent a combined version of the S vectors and the U vectors) having dimensions D: $M\times(N+1)^2$, and V[k] vectors 35 having dimensions D: $(N+1)^2\times(N+1)^2$. Individual vector elements in the US[k] matrix may also be termed $X_{PS}(k)$ while individual vectors of the V[k] matrix may also be termed v(k).

An analysis of the U, S and V matrices may reveal that the matrices carry or represent spatial and temporal characteristics of the underlying soundfield represented above by X. Each of the N vectors in U (of length M samples) may represent normalized separated audio signals as a function of time (for the time period represented by M samples), that are orthogonal to each other and that have been decoupled from any spatial characteristics (which may also be referred to as directional information). The spatial characteristics, representing spatial shape and position (r, theta, phi) may instead be represented by individual $i^{th}$ vectors, $v^{(i)}(k)$, in the V matrix (each of length $(N+1)^2$). The individual elements of each of $v^{(i)}(k)$ vectors may represent an HOA coefficient describing the shape (including width) and position of the soundfield for an associated audio object. Both the vectors in the U matrix and the V matrix are normalized such that their root-mean-square energies are equal to unity. The energy of the audio signals in U are thus represented by the diagonal elements in S. Multiplying U and S to form US[k] (with individual vector elements $X_{PS}(k)$), thus represent the audio signal with energies. The ability of the SVD decomposition to decouple the audio time-signals (in U), their energies (in S) and their spatial characteristics (in V) may support various aspects of the techniques described in this disclosure. Further, the model of synthesizing the underlying HOA[k] coefficients, X, by a vector multiplication of US[k] and V[k] gives rise the term "vector-based decomposition," which is used throughout this document.

Although described as being performed directly with respect to the HOA coefficients 11, the LIT unit 30 may apply the linear invertible transform to derivatives of the HOA coefficients 11. For example, the LIT unit 30 may apply SVD with respect to a power spectral density matrix derived from the HOA coefficients 11. By performing SVD with respect to the power spectral density (PSD) of the HOA coefficients rather than the coefficients themselves, the LIT unit 30 may potentially reduce the computational complexity of performing the SVD in terms of one or more of processor cycles and storage space, while achieving the same source audio encoding efficiency as if the SVD were applied directly to the HOA coefficients.

The parameter calculation unit 32 represents a unit configured to calculate various parameters, such as a correlation parameter (R), directional properties parameters (θ, ω, r), and an energy property (e). Each of the parameters for the current frame may be denoted as R[k], θ[k], φ[k], r[k] and e[k]. The parameter calculation unit 32 may perform an energy analysis and/or correlation (or so-called cross-correlation) with respect to the US[k] vectors 33 to identify the parameters. The parameter calculation unit 32 may also determine the parameters for the previous frame, where the previous frame parameters may be denoted R[k−1], θ[k−1], φ[k−1], r[k−1] and e[k−1], based on the previous frame of US[k−1] vector and V[k−1] vectors. The parameter calculation unit 32 may output the current parameters 37 and the previous parameters 39 to reorder unit 34.

The parameters calculated by the parameter calculation unit 32 may be used by the reorder unit 34 to re-order the audio objects to represent their natural evaluation or continuity over time. The reorder unit 34 may compare each of the parameters 37 from the first US[k] vectors 33 turn-wise against each of the parameters 39 for the second US[k−1] vectors 33. The reorder unit 34 may reorder (using, as one example, a Hungarian algorithm) the various vectors within the US[k] matrix 33 and the V[k] matrix 35 based on the current parameters 37 and the previous parameters 39 to output a reordered US[k] matrix 33' (which may be denoted mathematically as $\overline{US}[k]$) and a reordered V[k] matrix 35' (which may be denoted mathematically as $\overline{V}[k]$) to a foreground sound (or predominant sound—PS) selection unit 36 ("foreground selection unit 36") and an energy compensation unit 38.

The soundfield analysis unit 44 may represent a unit configured to perform a soundfield analysis with respect to the HOA coefficients 11 so as to potentially achieve a target bitrate 41. The soundfield analysis unit 44 may, based on the analysis and/or on a received target bitrate 41, determine the total number of psychoacoustic coder instantiations (which may be a function of the total number of ambient or background channels ($BG_{TOT}$) and the number of foreground channels or, in other words, predominant channels. The total number of psychoacoustic coder instantiations can be denoted as numHOATransportChannels.

The soundfield analysis unit 44 may also determine, again to potentially achieve the target bitrate 41, the total number of foreground channels (nFG) 45, the minimum order of the background (or, in other words, ambient) soundfield ($N_{BG}$ or, alternatively, MinAmbHOAorder), the corresponding number of actual channels representative of the minimum order of background soundfield (nBGa=(MinAmbHOAorder+1)$^2$), and indices (i) of additional BG HOA channels to send (which may collectively be denoted as background channel information 43 in the example of FIG. 3). The background channel information 42 may also be referred to as ambient channel information 43. Each of the channels that remains from numHOATransportChannels—nBGa, may either be an "additional background/ambient channel", an "active vector-based predominant channel", an "active directional based predominant signal" or "completely inactive". In one aspect, the channel types may be indicated (as a "ChannelType") syntax element by two bits (e.g. 00: directional based signal; 01: vector-based predominant signal; 10: additional ambient signal; 11: inactive signal). The total number of background or ambient signals, nBGa, may be given by (MinAmbHOAorder+1)$^2$+the number of times the index 10 (in the above example) appears as a channel type in the bitstream for that frame.

The soundfield analysis unit 44 may select the number of background (or, in other words, ambient) channels and the number of foreground (or, in other words, predominant) channels based on the target bitrate 41, selecting more background and/or foreground channels when the target bitrate 41 is relatively higher (e.g., when the target bitrate 41 equals or is greater than 512 Kbps). In one aspect, the numHOATransportChannels may be set to 8 while the MinAmbHOAorder may be set to 1 in the header section of the bitstream. In this scenario, at every frame, four channels may be dedicated to represent the background or ambient portion of the soundfield while the other 4 channels can, on a frame-by-frame basis vary on the type of channel—e.g., either used as an additional background/ambient channel or a foreground/predominant channel. The foreground/predominant signals can be one of either vector-based or directional based signals, as described above.

In some instances, the total number of vector-based predominant signals for a frame, may be given by the number of times the ChannelType index is 01 in the bitstream of that frame. In the above aspect, for every additional background/ambient channel (e.g., corresponding to a ChannelType of 10), corresponding information of which of the possible HOA coefficients (beyond the first four) may be represented in that channel. The information, for fourth order HOA content, may be an index to indicate the HOA coefficients 5-25. The first four ambient HOA coefficients 1-4 may be sent all the time when minAmbHOAorder is set to 1, hence the audio encoding device may only need to indicate one of the additional ambient HOA coefficient having an index of 5-25. The information could thus be sent using a 5 bits syntax element (for $4^{th}$ order content), which may be denoted as "CodedAmbCoeffIdx." In any event, the soundfield analysis unit 44 outputs the background channel information 43 and the HOA coefficients 11 to the background (BG) selection unit 36, the background channel information 43 to coefficient reduction unit 46 and the bitstream generation unit 42, and the nFG 45 to a foreground selection unit 36.

In accordance with one or more aspects of this disclosure, the soundfield analysis unit 44 may be configured to perform singular value-based compression of audio data. According to some of the techniques described herein, the soundfield analysis unit 44 may select (e.g., "describe") the HOA coefficients 11 by analyzing one or more singular values associated with the US[k] vectors 33 and the V[k] vectors 35, or vectors derived therefrom. In some examples, the soundfield analysis unit may analyze singular values associated with the S[k] vectors 33". For instance, S[k] vectors 33" may represent an 'S' matrix that is not multiplied, or not yet multiplied, with a corresponding 'U' matrix. For ease of discussion purposes only, the US[k] vectors 33, the S[k] vectors 33", the V[k] vectors 35, any vectors derived therefrom, and any combination thereof, are collectively referred to herein as "the received vectors," "the received HOA signals," or the "the received audio data."

According to one or more techniques described herein, the soundfield analysis unit 44 may analyze singular values associated with the received audio data, to determine a manner in which to describe the received audio data using the HOA coefficients 11 and/or the background channel information 43. In one example of the techniques described herein, the soundfield analysis unit 44 may determine whether to represent the received audio data using only foreground audio objects, or alternatively, using both foreground and background audio objects.

In some instances, the soundfield analysis unit 44 may determine, based on singular values associated with background audio objects of the received audio data, that the received HOA signals can be represented using a few (e.g., four or five) singular values, all of which are associated with foreground audio objects of the received audio data. If the soundfield analysis unit 44 determines that the received HOA signals can be represented using only the foreground audio objects, the soundfield analysis unit 44 may not signal any background audio objects for the received audio objects. Instead, in this scenario, the soundfield analysis unit 44 may signal only the foreground audio objects as part of the HOA coefficients 11, to represent the received HOA signals.

To determine whether to signal any of the background audio objects for the received audio data, the soundfield analysis unit 44 may analyze singular values associated with background audio objects of the received audio data, such as singular values specified by the S[k] vectors 33". For example, the soundfield analysis unit 44 may determine whether the singular values specified by the S[k] vectors 33" (or attributes thereof, such as the amplitude) associated with the background audio objects are sufficiently low, that the received audio data can be represented or otherwise described using only foreground audio objects. In this example, if the soundfield analysis unit 44 determines that the singular values of the background audio objects as specified by the S[k] vectors 33" are sufficiently low (e.g., sufficiently close to zero), then the soundfield analysis unit 44 may not code any background information for the received audio data.

By not coding the background information in such a scenario, the soundfield analysis unit 44 may code sensitive items of the received audio data using only the foreground information. In other words, the soundfield analysis unit 44 may code sensitive items of the received audio data based on singular values associated with the received audio data. In this manner, the soundfield analysis unit 44 may implement techniques of this disclosure to conserve computing resources and communication bandwidth by eliminating coding and/or signaling of background information, based on the singular values associated with the background information.

In one example where the soundfield analysis unit 44 determines not to code and/or signal any background audio objects based on the singular values specified by the S[k] vectors 33", the soundfield analysis unit 44 may code a total of six foreground audio objects for the received audio data. In contrast, according to conventional techniques, the soundfield analysis unit 44 may code two foreground audio objects and four background objects in generating the HOA coefficients 11 and the background channel information 43. In this manner, the soundfield analysis unit 44 may implement the techniques of this disclosure to leverage available bitrate and bandwidth to code and signal potentially more foreground audio objects, while disregarding background audio objects, in scenarios where the foreground audio objects are potentially more important and/or sensitive. For instance, a sensitive audio object may indicate or be otherwise associated with audio data that significantly affects the overall audio content to be specified in a bitstream.

While described above with respect to the soundfield analysis unit 44, it will be understood that various other components of the audio encoding device 20 may implement the techniques described above. For instance, the bitstream generation unit 42 may allocate all of the available bits to the foreground audio objects in scenarios where the background audio objects are associated with sufficiently low singular values. conversely, if the background audio objects are associated with singular values that are significant enough to warrant signaling of the background audio objects, then the bitstream generation unit 42 may allocate some of the available bits to bitstream specification (and, for example, signaling) of the background audio objects (e.g., in addition to allocating the remaining available bits to signaling of the foreground audio objects). In this manner, the techniques described above may also be implemented via bit allocation mechanisms, such as bit allocation mechanisms implemented by the bitstream generation unit 42.

As described above, in some instances, the soundfield analysis unit 44 may determine, using the singular value-based techniques of this disclosure, not to code and/or signal any background audio objects based on the singular values specified by the S[k] vectors 33". Scenarios in which the soundfield analysis unit 44 determines not to code any background audio objects are referred to herein as a "foreground-only mode." The following Table 1 illustrates syntax that the soundfield analysis unit 44 may use when coding audio objections according to the foreground-only mode.

TABLE 1

| Syntax | No. of bits | Mnemonic |
|---|---|---|
| HOADecoderConfig(numHOATransportChannels) | | |
| { | | |
| MinAmbHoaOrder = escapedValue(3,5,0) − 1; | 3, 8 | uimsbf |
| MinNumOfCoeffsForAmbHOA = (MinAmbHoaOrder + 1)^2; | | |
| NumOfAdditionalCoders = numHOATransportChannels − MinNumOfCoeffsForAmbHOA; | | |

TABLE 1-continued

| Syntax | No. of bits | Mnemonic |
|---|---|---|
| SingleLayer; | 1 | bslbf |
| MaxNoOfDirSigsForPrediction = MaxNoOfDirSigsForPrediction + 1; | 2 | uimsbf |
| NoOfBitsPerScalefactor = NoOfBitsPerScalefactor + 1; | 4 | uimsbf |
| CodedSpatialInterpolationTime; | 3 | uimsbf |
| SpatialInterpolationMethod; | 1 | bslbf |
| CodedVVecLength; | 2 | uimsbf |
| MaxGainCorrAmpExp; | 3 | uimsbf |
| HOAFrameLengthIndicator; | 2 | uimsbf |
| MaxNumAddActiveAmbCoeffs = NumOfHoaCoeffs − MinNumOfCoeffsForAmbHOA; | | |
| AmbAsignmBits = ceil( log2( MaxNumAddActiveAmbCoeffs ) ); | | |
| ActivePredIdsBits = ceil( log2( NumOfHoaCoeffs ) ); | | |
| i = 1; | | |
| while( i * ActivePredIdsBits + ceil( log2( i ) ) < NumOfHoaCoeffs ){ | | |
| i++; | | |
| } | | |
| NumActivePredIdsBits = ceil( log2( max( 1, i − 1 ) ) ); | | |
| GainCorrPrevAmpExpBits = ceil( log2( ceil( log2( 1.5 * NumOfHoaCoeffs ) ) + MaxGainCorrAmpExp + 1 ) ); | | |
| for (i=0; i<NumOfAdditionalCoders; ++i){ | | |
| AmbCoeffTransitionState[i] = 3; | | |
| } | | |
| } | | |

NOTE:
MinAmbHoaOrder = 30 . . . 37 are reserved.
HOAFrameLengthIndicator = 3 is reserved.

To use the foreground-only mode, the soundfield analysis unit 44 may set the number of background audio objects equal to zero. Thus, according to the syntax illustrated in the Table 1 above, the soundfield analysis unit may set the MinNumOfCoeffsForAmbHOA syntax element to a value of zero.

The following Table 2 illustrates syntax that the soundfield analysis unit 44 may use in scenarios where the soundfield analysis unit 44 determines to code both foreground and background audio objects of a soundfield. More specifically, the soundfield analysis unit 44 may use the syntax illustrated in the Table 2 to set up a number of foreground audio objects and a number of background audio objects, the following table can be used.

TABLE 2

| Syntax | No. of bits | Mnemonic |
|---|---|---|
| HOAFrame( ) | | |
| { | | |
| NumOfDirSigs = 0; | | |
| NumOfVecSigs = 0; | | |
| NumOfContAddHoaChans = 0; | | |
| hoaIndependencyFlag; | 1 | bslbf |
| for(i=0; i< NumOfAdditionalCoders; ++i){ | | |
| ChannelSideInfoData(i); | | |
| HOAGainCorrectionData(i); | | |
| switch ChannelType[i] { | | |
| case 0: | | |
| DirSigChannelIds[NumOfDirSigs] = i + 1; | | |
| NumOfDirSigs++; | | |
| break; | | |
| case 1: | | |
| VecSigChannelIds[NumOfVecSigs] = i + 1; | | |
| NumOfVecSigs++; | | |
| break; | | |
| case 2: | | |
| if (AmbCoeffTransitionState[i] == 0) { | | |
| ContAddHoaCoeff [NumOfContAddHoaChans] = AmbCoeffIdx[i]; | | |
| NumOfContAddHoaChans++; | | |
| } | | |
| break; | | |
| } | | |
| } | | |

TABLE 2-continued

| Syntax | No. of bits | Mnemonic |
|---|---|---|
| for ( i= NumOfAdditionalCoders; i< NumHOATransportChannels; ++i){ | | |
| HOAGainCorrectionData(i); | | |
| } | | |
| for(i=0; i< NumOfVecSigs; ++i){ | | |
| VVectorData ( VecSigChannelIds(i) ); | | |
| } | | |
| if(NumOfDirSigs > 0){ | | |
| HOAPredictionInfo( DirSigChannelIds, NumOfDirSigs ) | | |
| } | | |
| } | | |

The background selection unit 48 may represent a unit configured to determine background or ambient HOA coefficients 47 based on the background channel information (e.g., the background soundfield ($N_{BG}$) and the number (nBGa) and the indices (i) of additional BG HOA channels to send). For example, when $N_{BG}$ equals one, the background selection unit 48 may select the HOA coefficients 11 for each sample of the audio frame having an order equal to or less than one. The background selection unit 48 may, in this example, then select the HOA coefficients 11 having an index identified by one of the indices (i) as additional BG HOA coefficients, where the nBGa is provided to the bitstream generation unit 42 to be specified in the bitstream 21 so as to enable the audio decoding device, such as the audio decoding device 24 shown in the example of FIGS. 2 and 4, to parse the background HOA coefficients 47 from the bitstream 21. The background selection unit 48 may then output the ambient HOA coefficients 47 to the energy compensation unit 38. The ambient HOA coefficients 47 may have dimensions D: $M\times[(N_{BG}+1)^2+nBGa]$. The ambient HOA coefficients 47 may also be referred to as "ambient HOA coefficients 47," where each of the ambient HOA coefficients 47 corresponds to a separate ambient HOA channel 47 to be encoded by the psychoacoustic audio coder unit 40.

The foreground selection unit 36 may represent a unit configured to select the reordered US[k] matrix 33' and the reordered V[k] matrix 35' that represent foreground or distinct components of the soundfield based on nFG 45 (which may represent a one or more indices identifying the foreground vectors). The foreground selection unit 36 may output nFG signals 49 (which may be denoted as a reordered $US[k]_{1,\ldots,nFG}$ 49, $FG_{1,\ldots,nfG}[k]$ 49, or $X_{PS}^{(1\ldots nFG)}(k)$ 49) to the psychoacoustic audio coder unit 40, where the nFG signals 49 may have dimensions D: M×nFG and each represent mono-audio objects. The foreground selection unit 36 may also output the reordered V[k] matrix 35' (or $v^{(1\ldots nFG)}(k)$ 35') corresponding to foreground components of the soundfield to the spatio-temporal interpolation unit 50, where a subset of the reordered V[k] matrix 35' corresponding to the foreground components may be denoted as foreground V[k] matrix $\mathbf{51}_k$ (which may be mathematically denoted as $\overline{V}_{1,\ldots,nFG}[k]$) having dimensions D: $(N+1)^2\times nFG$.

The energy compensation unit 38 may represent a unit configured to perform energy compensation with respect to the ambient HOA coefficients 47 to compensate for energy loss due to removal of various ones of the HOA channels by the background selection unit 48. The energy compensation unit 38 may perform an energy analysis with respect to one or more of the reordered US[k] matrix 33', the reordered V[k] matrix 35', the nFG signals 49, the foreground V[k] vectors $\mathbf{51}_k$ and the ambient HOA coefficients 47 and then perform energy compensation based on the energy analysis to generate energy compensated ambient HOA coefficients 47'. The energy compensation unit 38 may output the energy compensated ambient HOA coefficients 47' to the psychoacoustic audio coder unit 40.

The spatio-temporal interpolation unit 50 may represent a unit configured to receive the foreground V[k] vectors $\mathbf{51}_k$ for the $k^{th}$ frame and the foreground V[k−1] vectors $\mathbf{51}_{k-1}$ for the previous frame (hence the k−1 notation) and perform spatio-temporal interpolation to generate interpolated foreground V[k] vectors. The spatio-temporal interpolation unit 50 may recombine the nFG signals 49 with the foreground V[k] vectors $\mathbf{51}_k$ to recover reordered foreground HOA coefficients. The spatio-temporal interpolation unit 50 may then divide the reordered foreground HOA coefficients by the interpolated V[k] vectors to generate interpolated nFG signals 49'. The spatio-temporal interpolation unit 50 may also output the foreground V[k] vectors $\mathbf{51}_k$ that were used to generate the interpolated foreground V[k] vectors so that an audio decoding device, such as the audio decoding device 24, may generate the interpolated foreground V[k] vectors and thereby recover the foreground V[k] vectors $\mathbf{51}_k$. The foreground V[k] vectors $\mathbf{51}_k$ used to generate the interpolated foreground V[k] vectors are denoted as the remaining foreground V[k] vectors 53. In order to ensure that the same V[k] and V[k−1] are used at the encoder and decoder (to create the interpolated vectors V[k]) quantized/dequantized versions of the vectors may be used at the encoder and decoder. The spatio-temporal interpolation unit 50 may output the interpolated nFG signals 49' to the psychoacoustic audio coder unit 46 and the interpolated foreground V[k] vectors $\mathbf{51}_k$ to the coefficient reduction unit 46.

The coefficient reduction unit 46 may represent a unit configured to perform coefficient reduction with respect to the remaining foreground V[k] vectors 53 based on the background channel information 43 to output reduced foreground V[k] vectors 55 to the quantization unit 52. The reduced foreground V[k] vectors 55 may have dimensions D: $[(N+1)^2-(N_{BG}+1)^2-BG_{TOT}]\times nFG$. The coefficient reduction unit 46 may, in this respect, represent a unit configured to reduce the number of coefficients in the remaining foreground V[k] vectors 53. In other words, coefficient reduction unit 46 may represent a unit configured to eliminate the coefficients in the foreground V[k] vectors (that form the remaining foreground V[k] vectors 53) having little to no directional information. In some examples, the coefficients of the distinct or, in other words, foreground V[k] vectors corresponding to a first and zero order basis functions (which may be denoted as $N_{BG}$) provide little directional information and therefore can be removed from the foreground V-vectors (through a process that may be referred to as "coefficient reduction"). In this example, greater flexibility may be provided to not only identify the coefficients that correspond $N_{BG}$ but to identify additional HOA channels (which may be denoted by the variable TotalOfAddAmbHOAChan) from the set of $[(N_{BG}+1)^2+1, (N+1)^2]$.

The quantization unit 52 may represent a unit configured to perform any form of quantization to compress the reduced foreground V[k] vectors 55 to generate coded foreground V[k] vectors 57, outputting the coded foreground V[k] vectors 57 to the bitstream generation unit 42. In operation, the quantization unit 52 may represent a unit configured to compress a spatial component of the soundfield, i.e., one or more of the reduced foreground V[k] vectors 55 in this example. The quantization unit 52 may perform any one of the following 12 quantization modes, as indicated by a quantization mode syntax element denoted "NbitsQ":

| NbitsQ value | Type of Quantization Mode |
|---|---|
| 0-3: | Reserved |
| 4: | Vector Quantization |
| 5: | Scalar Quantization without Huffman Coding |
| 6: | 6-bit Scalar Quantization with Huffman Coding |
| 7: | 7-bit Scalar Quantization with Huffman Coding |
| 8: | 8-bit Scalar Quantization with Huffman Coding |
| . . . | . . . |
| 16: | 16-bit Scalar Quantization with Huffman Coding |

The quantization unit 52 may also perform predicted versions of any of the foregoing types of quantization modes, where a difference is determined between an element of (or a weight when vector quantization is performed) of the V-vector of a previous frame and the element (or weight when vector quantization is performed) of the V-vector of a current frame is determined. The quantization unit 52 may then quantize the difference between the elements or weights of the current frame and previous frame rather than the value of the element of the V-vector of the current frame itself.

The quantization unit 52 may perform multiple forms of quantization with respect to each of the reduced foreground V[k] vectors 55 to obtain multiple coded versions of the reduced foreground V[k] vectors 55. The quantization unit 52 may select the one of the coded versions of the reduced foreground V[k] vectors 55 as the coded foreground V[k] vector 57. The quantization unit 52 may, in other words, select one of the non-predicted vector-quantized V-vector, predicted vector-quantized V-vector, the non-Huffman-coded scalar-quantized V-vector, and the Huffman-coded scalar-quantized V-vector to use as the output switched-quantized V-vector based on any combination of the criteria discussed in this disclosure. In some examples, the quantization unit 52 may select a quantization mode from a set of quantization modes that includes a vector quantization mode and one or more scalar quantization modes, and quantize an input V-vector based on (or according to) the selected mode. The quantization unit 52 may then provide the selected one of the non-predicted vector-quantized V-vector (e.g., in terms of weight values or bits indicative thereof), predicted vector-quantized V-vector (e.g., in terms of error values or bits indicative thereof), the non-Huffman-coded scalar-quantized V-vector and the Huffman-coded scalar-quantized V-vector to the bitstream generation unit 52 as the coded foreground V[k] vectors 57. The quantization unit 52 may also provide the syntax elements indicative of the quantization mode (e.g., the NbitsQ syntax element) and any other syntax elements used to dequantize or otherwise reconstruct the V-vector.

The psychoacoustic audio coder unit 40 included within the audio encoding device 20 may represent multiple instances of a psychoacoustic audio coder, each of which is used to encode a different audio object or HOA channel of each of the energy compensated ambient HOA coefficients 47' and the interpolated nFG signals 49' to generate encoded ambient HOA coefficients 59 and encoded nFG signals 61. The psychoacoustic audio coder unit 40 may output the encoded ambient HOA coefficients 59 and the encoded nFG signals 61 to the bitstream generation unit 42.

The bitstream generation unit 42 included within the audio encoding device 20 represents a unit that formats data to conform to a known format (which may refer to a format known by a decoding device), thereby generating the vector-based bitstream 21. The bitstream 21 may, in other words, represent encoded audio data, having been encoded in the manner described above. The bitstream generation unit 42 may represent a multiplexer in some examples, which may receive the coded foreground V[k] vectors 57, the encoded ambient HOA coefficients 59, the encoded nFG signals 61 and the background channel information 43. The bitstream generation unit 42 may then generate a bitstream 21 based on the coded foreground V[k] vectors 57, the encoded ambient HOA coefficients 59, the encoded nFG signals 61 and the background channel information 43. In this way, the bitstream generation unit 42 may thereby specify the vectors 57 in the bitstream 21 to obtain the bitstream 21 as described below in more detail with respect to the example of FIG. 7. The bitstream 21 may include a primary or main bitstream and one or more side channel bitstreams.

According to one or more aspects of this disclosure, the bitstream generation unit 42 may allocate bits to audio objects based on one or more singular values associated with the audio objects. For instance, in cases where the singular values for the background audio objects are sufficiently low (e.g., in amplitude) that the coded foreground V[k] vectors 57 and the encoded nFG signals 61 adequately represent or otherwise describe the signaled audio data, the bitstream generation unit 42 may allocate all of the available bits to the coded foreground V[k] vectors 57. For instance, the singular values for an audio object correspond to an energy of the audio object (e.g., by expressing the square root of the energy). In cases of small quantization errors for a large value in the V[k] and/or US[k] vectors for the background audio objects, the quantization error may be audible. Conversely, in cases of small quantization errors for a small value in the V[k] and/or US[k] vectors for the background audio objects, the quantization error may not be audible.

In turn, the bitstream generation unit 42 may leverage these aspects of quantization error audibility to allocate bits to audio objects in a directly proportional manner to the strength (e.g., amplitude) of singular values associated with the audio objects. For instance, when an audio object is associated with a singular value of a lesser amplitude (e.g., below a threshold amplitude), the bitstream generation unit 42 may allocate a lesser number of available bits (or even no bits) to the signaling of such an audio object. On the other hand, when an audio object is associated with a singular value of a greater amplitude (e.g., meeting or exceeding a threshold amplitude), the bitstream generation unit 42 may allocate a greater number of available bits to the signaling of such an audio object.

In various examples, the received audio data (e.g., the coded foreground V[k] vectors 57, the encoded ambient HOA coefficients 59, and the encoded nFG signals 61) may include background audio objects having lesser-amplitude singular values and foreground audio objects having greater-amplitude singular values. In one such example, the bitstream generation unit 42 may allocate all of the available bits to the foreground audio objects (e.g., as to be specified in the vector-based bitstream 21, and/or for signaling), and allocate no bits to the background audio objects (e.g., as to be specified in the bitstream 21, and/or for signaling). In another such example, the bitstream generation unit 42 may allocate portions of the available bits to each of the foreground and background audio objects, in a manner that is proportional to the singular value amplitude of each respective singular value. In this manner, the bitstream generation unit 42 may allocate bits in descending order of energy (e.g., importance). As described, the amplitude of a singular value describes a square root of the energy (and/or "eigenvalue") of the associated audio object.

According to some of the techniques described herein, the bitstream generation unit 42 may set an upper limit (or "cap" or "maximum") on the number of bits that can be allocated to a single audio object, with respect to being specified in the bitstream 21. By capping the number of bits that can be allocated to a single audio object, the bitstream generation unit 42 may mitigate or eliminate potential inaccuracies arising from allocating all bits to signaling a small number of audio objects, which in turn may cause the absence of representations of other (potentially important/significant) audio objects from the vector-based bitstream 21.

In some examples, the bitstream generation unit 42 may allocate the bits to the audio objects by applying a formula that is based on the amplitude of the singular value for each audio object. In one such example, the bitstream generation unit 42 may allocate a percentage of the available bits according to an audio object, based on the amplitude of the singular value for the audio object. For instance, if a first foreground object has a singular value having an amplitude of 0.6, then the bitstream generation unit 42 may allocate 60% of the available bits to the first foreground object. Additionally, if a second foreground object has a singular value having an amplitude of 0.3, then the bitstream generation unit 42 may allocate 30% of the available bits to the second foreground object. In this example, if the remaining 10% are also allocated to the other foreground audio objects, the bitstream generation unit may not allocate any bits to any background audio objects. In this example, the bitstream generation unit 42 may set the upper limit of bits for a single audio object at 60% or higher, thereby accommodating the 60% bit allocation to the first foreground object.

In some examples, the bitstream generation unit 42 may signal the particular bit allocation scheme for a soundfield to a decoding device. For instance, the bitstream generation unit 42 may signal the bit allocation scheme separately, or "out of band" from the bitstream representing the audio objects of the soundfield. In instances where the bitstream generation unit 42 signals the bit allocation scheme for a particular soundfield, the bit allocation scheme data may be considered descriptive information or so-called "metadata" with respect to the soundfield. In some instances, the bitstream generation unit 42 may also signal the upper limit ("cap" or "maximum") on the number of bits that can be allocated to a single audio object, as part of the metadata.

Although not shown in the example of FIG. 3, the audio encoding device 20 may also include a bitstream output unit that switches the bitstream output from the audio encoding device 20 (e.g., between the directional-based bitstream 21 and the vector-based bitstream 21) based on whether a current frame is to be encoded using the directional-based synthesis or the vector-based synthesis, or decomposition. The bitstream output unit may perform the switch based on the syntax element output by the content analysis unit 26 indicating whether a directional-based synthesis was performed (as a result of detecting that the HOA coefficients 11 were generated from a synthetic audio object) or a vector-based synthesis or decomposition was performed (as a result of detecting that the HOA coefficients were recorded). The bitstream output unit may specify the correct header syntax to indicate the switch or current encoding used for the current frame along with the respective one of the bitstreams 21.

Moreover, as noted above, the soundfield analysis unit 44 may identify $BG_{TOT}$ ambient HOA coefficients 47, which may change on a frame-by-frame basis (although at times $BG_{TOT}$ may remain constant or the same across two or more adjacent (in time) frames). The change in $BG_{TOT}$ may result in changes to the coefficients expressed in the reduced foreground V[k] vectors 55. The change in $BG_{TOT}$ may result in background HOA coefficients (which may also be referred to as "ambient HOA coefficients") that change on a frame-by-frame basis (although, again, at times $BG_{TOT}$ may remain constant or the same across two or more adjacent (in time) frames). The changes often result in a change of energy for the aspects of the sound field represented by the addition or removal of the additional ambient HOA coefficients and the corresponding removal of coefficients from or addition of coefficients to the reduced foreground V[k] vectors 55.

As a result, the soundfield analysis unit 44 may further determine when the ambient HOA coefficients change from frame to frame and generate a flag or other syntax element indicative of the change to the ambient HOA coefficient in terms of being used to represent the ambient components of the sound field (where the change may also be referred to as a "transition" of the ambient HOA coefficient or as a "transition" of the ambient HOA coefficient). In particular, the coefficient reduction unit 46 may generate the flag (which may be denoted as an AmbCoeffTransition flag or an AmbCoeffIdxTransition flag), providing the flag to the bitstream generation unit 42 so that the flag may be included in the bitstream 21 (possibly as part of side channel information).

The coefficient reduction unit 46 may, in addition to specifying the ambient coefficient transition flag, also modify how the reduced foreground V[k] vectors 55 are generated. In one example, upon determining that one of the ambient HOA ambient coefficients is in transition during the current frame, the coefficient reduction unit 46 may specify, a vector coefficient (which may also be referred to as a "vector element" or "element") for each of the V-vectors of the reduced foreground V[k] vectors 55 that corresponds to the ambient HOA coefficient in transition. Again, the ambient HOA coefficient in transition may add or remove from the $BG_{TOT}$ total number of background coefficients. Therefore, the resulting change in the total number of background coefficients affects whether the ambient HOA coefficient is included or not included in the bitstream, and whether the corresponding element of the V-vectors are included for the V-vectors specified in the bitstream in the second and third configuration modes described above. More information regarding how the coefficient reduction unit 46 may specify the reduced foreground V[k] vectors 55 to overcome the changes in energy is provided in U.S. application Ser. No.

14/594,533, entitled "TRANSITIONING OF AMBIENT HIGHER_ORDER AMBISONIC COEFFICIENTS," filed Jan. 12, 2015.

Figure 4:
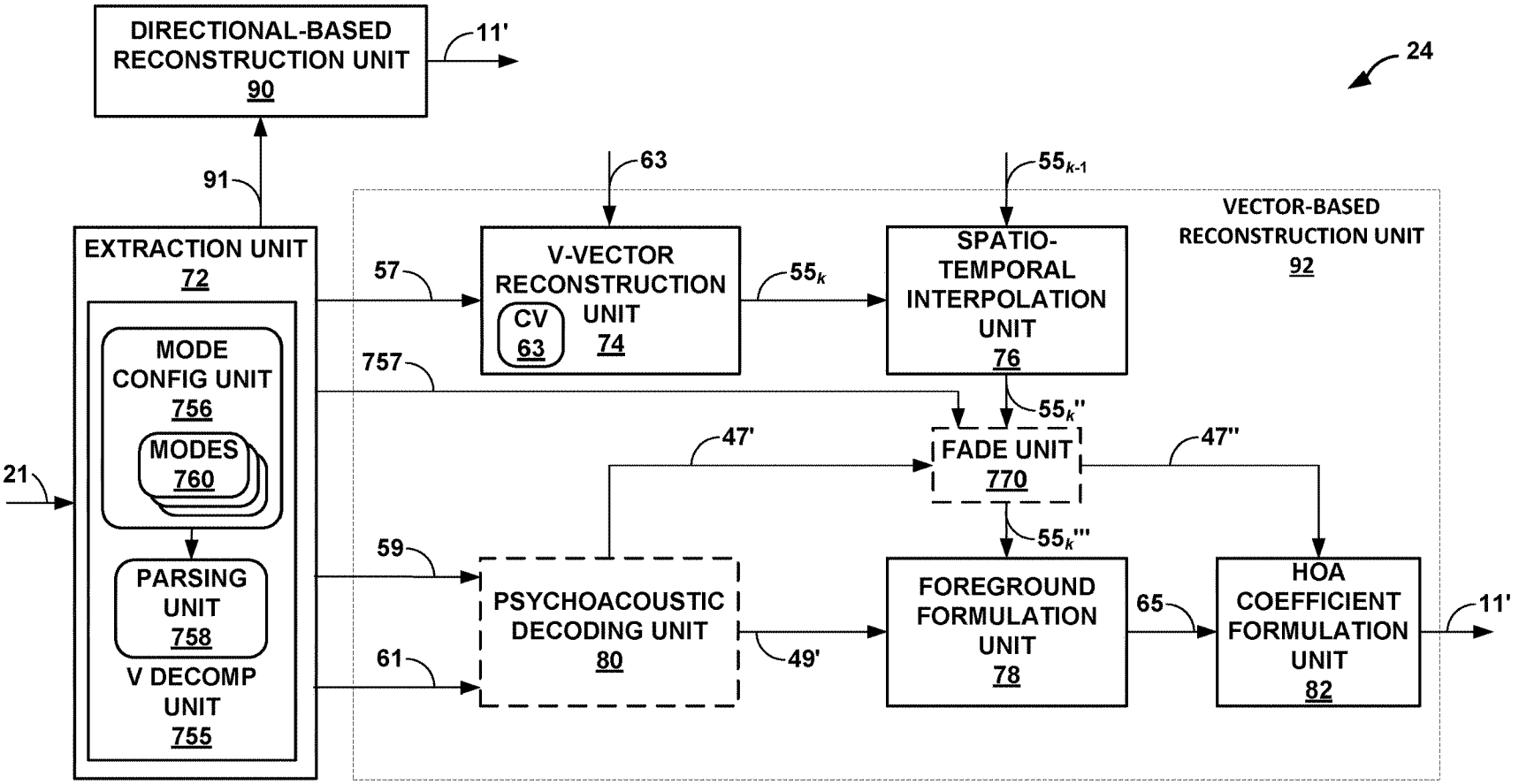
FIG. 4 is a block diagram illustrating the audio decoding device of FIG. 2 in more detail.

FIG. 4 is a block diagram illustrating the audio decoding device 24 of FIG. 2 in more detail. As shown in the example of FIG. 4 the audio decoding device 24 may include an extraction unit 72, a directionality-based reconstruction unit 90 and a vector-based reconstruction unit 92. Although described below, more information regarding the audio decoding device 24 and the various aspects of decompressing or otherwise decoding HOA coefficients is available in International Patent Application Publication No. WO 2014/194099, entitled "INTERPOLATION FOR DECOMPOSED REPRESENTATIONS OF A SOUND FIELD," filed 29 May 2014.

The extraction unit 72 may represent a unit configured to receive the bitstream 21 and extract the various encoded versions (e.g., a directional-based encoded version or a vector-based encoded version) of the HOA coefficients 11. The extraction unit 72 may determine from the above noted syntax element indicative of whether the HOA coefficients 11 were encoded via the various direction-based or vector-based versions. When a directional-based encoding was performed, the extraction unit 72 may extract the directional-based version of the HOA coefficients 11 and the syntax elements associated with the encoded version (which is denoted as directional-based information 91 in the example of FIG. 4), passing the directional based information 91 to the directional-based reconstruction unit 90. The directional-based reconstruction unit 90 may represent a unit configured to reconstruct the HOA coefficients in the form of HOA coefficients 11' based on the directional-based information 91. The bitstream and the arrangement of syntax elements within the bitstream is described in more detail at other portions of this disclosure.

When the syntax element indicates that the HOA coefficients 11 were encoded using a vector-based synthesis or decomposition, the extraction unit 72 may extract the coded foreground V[k] vectors 57 (which may include coded weights 57 and/or indices 63 or scalar quantized V-vectors), the encoded ambient HOA coefficients 59 and the corresponding audio objects 61 (which may also be referred to as the encoded nFG signals 61). The audio objects 61 each correspond to one of the vectors 57. The extraction unit 72 may pass the coded foreground V[k] vectors 57 to the V-vector reconstruction unit 74 and the encoded ambient HOA coefficients 59 along with the encoded nFG signals 61 to the (optional) psychoacoustic decoding unit 80. The psychoacoustic decoding unit 80 is shown with dashed-line borders in FIG. 4, to illustrate the optional nature of the psychoacoustic decoding unit 80 with respect to different implementations of the audio decoding device 24.

In some examples, the extraction unit 72 may receive the particular bit allocation scheme for a soundfield represented by the bitstream 21. For instance, the extraction unit 72 may receive the bit allocation scheme separately, or "out of band" from the bitstream representing the audio objects of the soundfield. In instances where the extraction unit 72 receives the bit allocation scheme for a particular soundfield, the audio decoding device 24 may use the bit allocation scheme data as descriptive information or so-called "metadata" with respect to the soundfield.

For instance, one or more components of the audio decoding device 24 may use the bit allocation metadata to assign a specific number of bits (which may be expressed as a proportion of a total number of bits) to each signaled audio object. In a foreground-only scenario, the audio decoding device 24 may apply the received metadata to assign all bits of a soundfield to the foreground objects of the soundfield. According to a particular foreground-only scenario described above with respect to FIG. 3, the audio decoding device 24 may assign 60% of a soundfield's total bits to a first foreground audio object of the soundfield, 30% to a second foreground audio object of the soundfield, and may distribute the remaining 10% of the bits to the remaining foreground audio objects of the soundfield, based on the individual energies displayed by the specific foreground audio objects.

In some examples, the received metadata may also include the upper limit ("cap" or "maximum") on the number of bits that can be allocated to a single audio object, as part of the metadata. In these instances, the audio decoding device 24 may determine that no individual audio object of the corresponding soundfield can be allotted more bits than the received upper limit. By capping the number of bits that can be allocated to a single audio object, the audio decoding device may mitigate or eliminate potential inaccuracies arising from allocating all bits to rendering a small number of audio objects, which in turn may cause the absence of representations of other (potentially important/significant) audio objects from the rendered soundfield.

The V-vector reconstruction unit 74 may represent a unit configured to reconstruct the V-vectors from the encoded foreground V[k] vectors 57. The V-vector reconstruction unit 74 may operate in a manner reciprocal to that of the quantization unit 52.

The psychoacoustic decoding unit 80 may operate in a manner reciprocal to the psychoacoustic audio coder unit 40 shown in the example of FIG. 3 so as to decode the encoded ambient HOA coefficients 59 and the encoded nFG signals 61 and thereby generate energy compensated ambient HOA coefficients 47' and the interpolated nFG signals 49' (which may also be referred to as interpolated nFG audio objects 49'). The psychoacoustic decoding unit 80 may pass the energy compensated ambient HOA coefficients 47' to the fade unit 770 and the nFG signals 49' to the foreground formulation unit 78.

The spatio-temporal interpolation unit 76 may operate in a manner similar to that described above with respect to the spatio-temporal interpolation unit 50. The spatio-temporal interpolation unit 76 may receive the reduced foreground V[k] vectors $\mathbf{55}_k$ and perform the spatio-temporal interpolation with respect to the foreground V[k] vectors $\mathbf{55}_k$ and the reduced foreground V[k−1] vectors $\mathbf{55}_{k-1}$ to generate interpolated foreground V[k] vectors $\mathbf{55}_k''$. The spatio-temporal interpolation unit 76 may forward the interpolated foreground V[k] vectors $\mathbf{55}_k''$ to the fade unit 770.

The extraction unit 72 may also output a signal 757 indicative of when one of the ambient HOA coefficients is in transition to fade unit 770, which may then determine which of the $SHC_{BG}$ 47' (where the $SHC_{BG}$ 47' may also be denoted as "ambient HOA channels 47'''" or "ambient HOA coefficients 47'''") and the elements of the interpolated foreground V[k] vectors $\mathbf{55}_k''$ are to be either faded-in or faded-out. In some examples, the fade unit 770 may operate opposite with respect to each of the ambient HOA coefficients 47' and the elements of the interpolated foreground V[k] vectors $\mathbf{55}_k''$. That is, the fade unit 770 may perform a fade-in or fade-out, or both a fade-in or fade-out with respect to corresponding one of the ambient HOA coefficients 47', while performing a fade-in or fade-out or both a fade-in and a fade-out, with respect to the corresponding one of the elements of the interpolated foreground V[k] vectors $\mathbf{55}_k''$. The fade unit 770 may output adjusted ambient HOA coefficients 47'' to the HOA coefficient formulation unit 82 and adjusted foreground V[k] vectors $\mathbf{55}_k'''$ to the foreground formulation unit 78. In this respect, the fade unit 770 represents a unit configured to perform a fade operation with respect to various aspects of the HOA coefficients or derivatives thereof, e.g., in the form of the ambient HOA coefficients 47' and the elements of the interpolated foreground V[k] vectors $\mathbf{55}_k''$.

The foreground formulation unit 78 may represent a unit configured to perform matrix multiplication with respect to the adjusted foreground V[k] vectors $\mathbf{55}_k'''$ and the interpolated nFG signals 49' to generate the foreground HOA coefficients 65. In this respect, the foreground formulation unit 78 may combine the audio objects 49' (which is another way by which to denote the interpolated nFG signals 49') with the vectors $\mathbf{55}_k'''$ to reconstruct the foreground or, in other words, predominant aspects of the HOA coefficients 11'. The foreground formulation unit 78 may perform a matrix multiplication of the interpolated nFG signals 49' by the adjusted foreground V[k] vectors $\mathbf{55}_k'''$.

The HOA coefficient formulation unit 82 may represent a unit configured to combine the foreground HOA coefficients 65 to the adjusted ambient HOA coefficients 47" so as to obtain the HOA coefficients 11'. The prime notation reflects that the HOA coefficients 11' may be similar to but not the same as the HOA coefficients 11. The differences between the HOA coefficients 11 and 11' may result from loss due to transmission over a lossy transmission medium, quantization or other lossy operations.

Figure 5A:
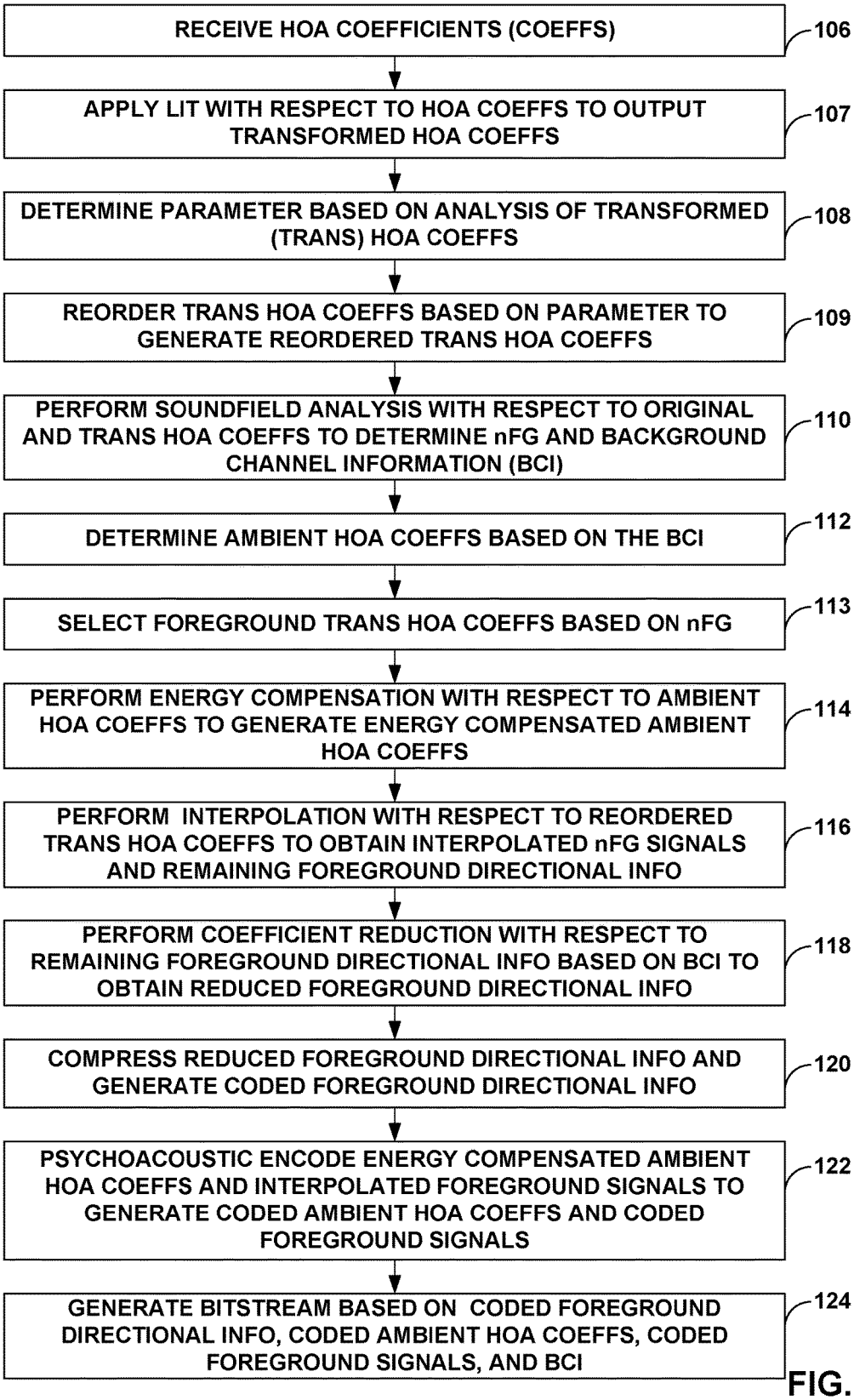
FIG. 5A is a flowchart illustrating exemplary operation of an audio encoding device in performing various aspects of the decomposition techniques described in this disclosure.

FIG. 5A is a flowchart illustrating exemplary operation of an audio encoding device, such as the audio encoding device 20 shown in the example of FIG. 3, in performing various aspects of the decomposition techniques described in this disclosure. Initially, the audio encoding device 20 receives the HOA coefficients 11 (106). The audio encoding device 20 may invoke the LIT unit 30, which may apply a LIT with respect to the HOA coefficients to output transformed HOA coefficients (e.g., in the case of SVD, the transformed HOA coefficients may comprise the US[k] vectors 33 and the V[k] vectors 35) (107).

The audio encoding device 20 may next invoke the parameter calculation unit 32 to perform the above described analysis with respect to any combination of the US[k] vectors 33, US[k−1] vectors 33, the V[k] and/or V[k−1] vectors 35 to identify various parameters in the manner described above. That is, the parameter calculation unit 32 may determine at least one parameter based on an analysis of the transformed HOA coefficients 33/35 (108).

The audio encoding device 20 may then invoke the reorder unit 34, which may reorder the transformed HOA coefficients (which, again in the context of SVD, may refer to the US[k] vectors 33 and the V[k] vectors 35) based on the parameter to generate reordered transformed HOA coefficients 33'/35' (or, in other words, the US[k] vectors 33' and the V[k] vectors 35'), as described above (109). The audio encoding device 20 may, during any of the foregoing operations or subsequent operations, also invoke the soundfield analysis unit 44. The soundfield analysis unit 44 may, as described above, perform a soundfield analysis with respect to the HOA coefficients 11 and/or the transformed HOA coefficients 33/35 to determine the total number of foreground channels (nFG) 45, the order of the background soundfield ($N_{BG}$) and the number (nBGa) and indices (i) of additional BG HOA channels to send (which may collectively be denoted as background channel information 43 in the example of FIG. 3) (109).

The audio encoding device 20 may also invoke the background selection unit 48. The background selection unit 48 may determine background or ambient HOA coefficients 47 based on the background channel information 43 (110). The audio encoding device 20 may further invoke the foreground selection unit 36, which may select the reordered US[k] vectors 33' and the reordered V[k] vectors 35' that represent foreground or distinct components of the soundfield based on nFG 45 (which may represent a one or more indices identifying the foreground vectors) (112).

The audio encoding device 20 may invoke the energy compensation unit 38. The energy compensation unit 38 may perform energy compensation with respect to the ambient HOA coefficients 47 to compensate for energy loss due to removal of various ones of the HOA coefficients by the background selection unit 48 (114) and thereby generate energy compensated ambient HOA coefficients 47'.

The audio encoding device 20 may also invoke the spatio-temporal interpolation unit 50. The spatio-temporal interpolation unit 50 may perform spatio-temporal interpolation with respect to the reordered transformed HOA coefficients 33'/35' to obtain the interpolated foreground signals 49' (which may also be referred to as the "interpolated nFG signals 49'") and the remaining foreground directional information 53 (which may also be referred to as the "V[k] vectors 53") (116). The audio encoding device 20 may then invoke the coefficient reduction unit 46. The coefficient reduction unit 46 may perform coefficient reduction with respect to the remaining foreground V[k] vectors 53 based on the background channel information 43 to obtain reduced foreground directional information 55 (which may also be referred to as the reduced foreground V[k] vectors 55) (118).

The audio encoding device 20 may then invoke the quantization unit 52 to compress, in the manner described above, the reduced foreground V[k] vectors 55 and generate coded foreground V[k] vectors 57 (120).

The audio encoding device 20 may also invoke the psychoacoustic audio coder unit 40. The psychoacoustic audio coder unit 40 may psychoacoustic code each vector of the energy compensated ambient HOA coefficients 47' and the interpolated nFG signals 49' to generate encoded ambient HOA coefficients 59 and encoded nFG signals 61. The audio encoding device may then invoke the bitstream generation unit 42. The bitstream generation unit 42 may generate the bitstream 21 based on the coded foreground directional information 57, the coded ambient HOA coefficients 59, the coded nFG signals 61 and the background channel information 43.

Figure 5B:
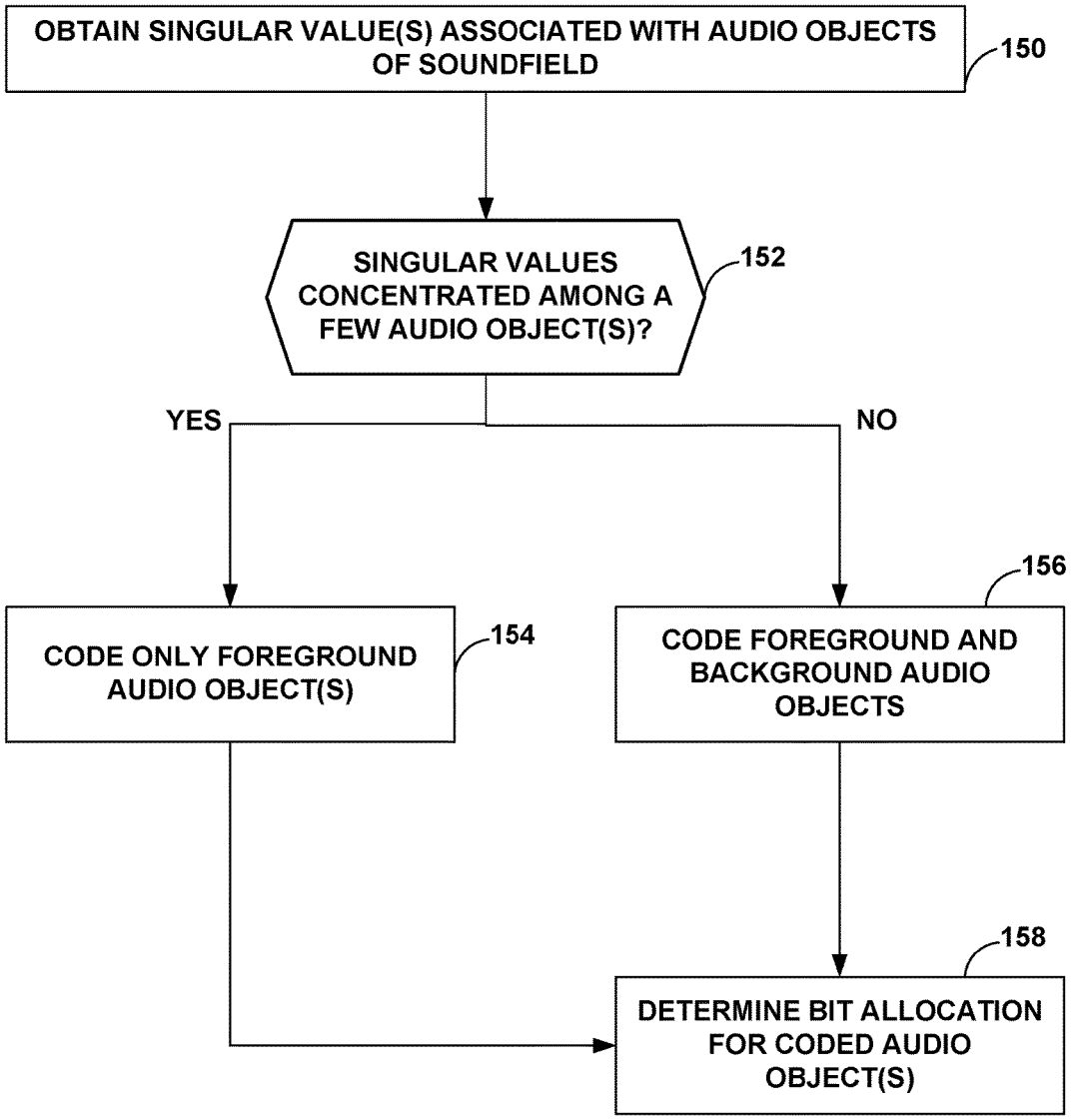
FIG. 5B is a flowchart illustrating exemplary operation of an audio encoding device in performing various aspects of the coding techniques described in this disclosure.

FIG. 5B is a flowchart illustrating exemplary operation of an audio encoding device in performing the coding techniques described in this disclosure. In the example of FIG. 5B, an audio encoding device (e.g., the audio encoding device 20 of FIGS. 1 and 2) may obtain one or more singular values associated with audio objects of a soundfield (150). As discussed above, the audio objects of the soundfield may include foreground audio objects and background audio objects. Additionally, the audio encoding device 20 may determine whether the singular values obtained from the HOA coefficients of the soundfield are concentrated among a few audio objects of the soundfield (152). For instance, the audio encoding device 20 may obtain a singular value for each background audio object by calculating a square root of a corresponding eigenvalue. Additionally, the audio encoding device 20 may set the threshold amplitude to correspond to a predetermined minimum energy value.

If the audio encoding device 20 determines that the singular values of the audio objects are concentrated among only a few audio objects of the soundfield (YES' branch of 152), then the audio encoding device 20 may code only the foreground audio object(s) of the soundfield (154). Conversely, if the audio encoding device 20 determines that the singular values are relatively more distributed across the audio objects of the soundfield (NO' branch of 152), then the audio encoding device 20 may code both the foreground and background audio objects of the soundfield (156).

Additionally, upon coding the respective audio object(s) at step 154 or 154 as the case may be, the audio encoding device 20 may determine a bit allocation for the coded audio object(s) of the soundfield (158). In an instance where the audio encoding device 20 coded only foreground audio objects (154), the audio encoding device may allocate the bits only among the foreground audio objects (in various proportions). In an instance where the audio encoding device 20 coded both foreground and background audio objects (156), the audio encoding device 20 may, after allocating the requisite bits to all foreground audio objects, allot the remaining bits among the background audio objects.

Figure 6:
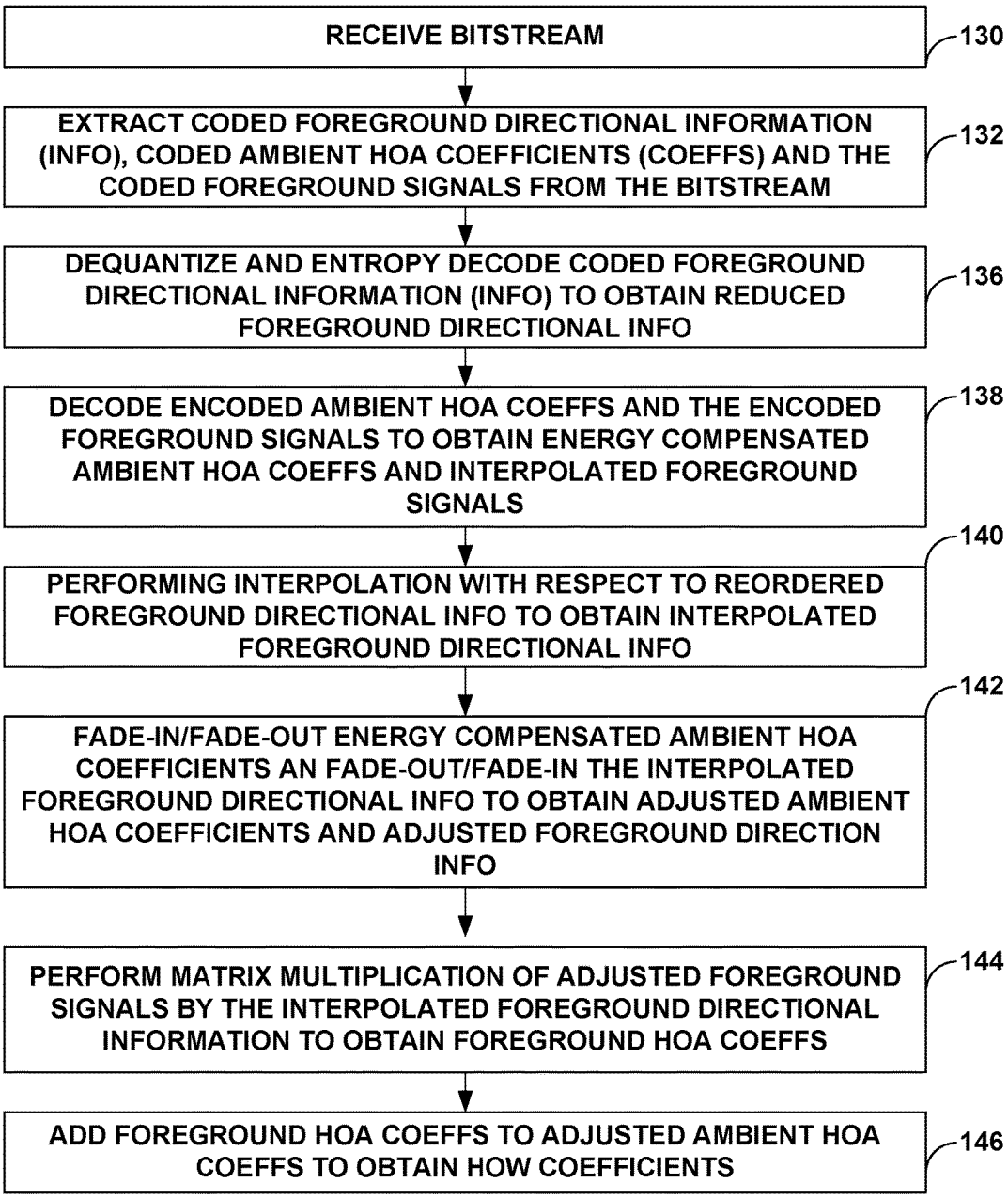
FIG. 6 is a flowchart illustrating exemplary operation of an audio decoding device in performing various aspects of the techniques described in this disclosure.

FIG. 6 is a flowchart illustrating exemplary operation of an audio decoding device, such as the audio decoding device 24 shown in FIG. 4, in performing various aspects of the techniques described in this disclosure. Initially, the audio decoding device 24 may receive the bitstream 21 (130). Upon receiving the bitstream, the audio decoding device 24 may invoke the extraction unit 72. Assuming for purposes of discussion that the bitstream 21 indicates that vector-based reconstruction is to be performed, the extraction unit 72 may parse the bitstream to retrieve the above noted information, passing the information to the vector-based reconstruction unit 92.

In other words, the extraction unit 72 may extract the coded foreground directional information 57 (which, again, may also be referred to as the coded foreground V[k] vectors 57), the coded ambient HOA coefficients 59 and the coded foreground signals (which may also be referred to as the coded foreground nFG signals 59 or the coded foreground audio objects 59) from the bitstream 21 in the manner described above (132).

The audio decoding device 24 may further invoke the dequantization unit 74. The dequantization unit 74 may entropy decode and dequantize the coded foreground directional information 57 to obtain reduced foreground directional information $\mathbf{55}_k$ (136). The audio decoding device 24 may also invoke the psychoacoustic decoding unit 80. The psychoacoustic audio decoding unit 80 may decode the encoded ambient HOA coefficients 59 and the encoded foreground signals 61 to obtain energy compensated ambient HOA coefficients 47' and the interpolated foreground signals 49' (138). The psychoacoustic decoding unit 80 may pass the energy compensated ambient HOA coefficients 47' to the fade unit 770 and the nFG signals 49' to the foreground formulation unit 78.

The audio decoding device 24 may next invoke the spatio-temporal interpolation unit 76. The spatio-temporal interpolation unit 76 may receive the reordered foreground directional information $\mathbf{55}_k'$ and perform the spatio-temporal interpolation with respect to the reduced foreground directional information $\mathbf{55}_k/\mathbf{55}_{k-1}$ to generate the interpolated foreground directional information $\mathbf{55}_k''$ (140). The spatio-temporal interpolation unit 76 may forward the interpolated foreground V[k] vectors $\mathbf{55}_k''$ to the fade unit 770.

The audio decoding device 24 may invoke the fade unit 770. The fade unit 770 may receive or otherwise obtain syntax elements (e.g., from the extraction unit 72) indicative of when the energy compensated ambient HOA coefficients 47' are in transition (e.g., the AmbCoeffTransition syntax element). The fade unit 770 may, based on the transition syntax elements and the maintained transition state information, fade-in or fade-out the energy compensated ambient HOA coefficients 47' outputting adjusted ambient HOA coefficients 47" to the HOA coefficient formulation unit 82. The fade unit 770 may also, based on the syntax elements and the maintained transition state information, and fade-out or fade-in the corresponding one or more elements of the interpolated foreground V[k] vectors $\mathbf{55}_k''$ outputting the adjusted foreground V[k] vectors $\mathbf{55}_k'''$ to the foreground formulation unit 78 (142).

The audio decoding device 24 may invoke the foreground formulation unit 78. The foreground formulation unit 78 may perform matrix multiplication the nFG signals 49' by the adjusted foreground directional information $\mathbf{55}_k'''$ to obtain the foreground HOA coefficients 65 (144). The audio decoding device 24 may also invoke the HOA coefficient formulation unit 82. The HOA coefficient formulation unit 82 may add the foreground HOA coefficients 65 to adjusted ambient HOA coefficients 47" so as to obtain the HOA coefficients 11' (146).

The foregoing techniques may be performed with respect to any number of different contexts and audio ecosystems. A number of example contexts are described below, although the techniques should be limited to the example contexts. One example audio ecosystem may include audio content, movie studios, music studios, gaming audio studios, channel based audio content, coding engines, game audio stems, game audio coding/rendering engines, and delivery systems.

The movie studios, the music studios, and the gaming audio studios may receive audio content. In some examples, the audio content may represent the output of an acquisition. The movie studios may output channel based audio content (e.g., in 2.0, 5.1, and 7.1) such as by using a digital audio workstation (DAW). The music studios may output channel based audio content (e.g., in 2.0, and 5.1) such as by using a DAW. In either case, the coding engines may receive and encode the channel based audio content based one or more codecs (e.g., AAC, AC3, Dolby True HD, Dolby Digital Plus, and DTS Master Audio) for output by the delivery systems. The gaming audio studios may output one or more game audio stems, such as by using a DAW. The game audio coding/rendering engines may code and or render the audio stems into channel based audio content for output by the delivery systems. Another example context in which the techniques may be performed comprises an audio ecosystem that may include broadcast recording audio objects, professional audio systems, consumer on-device capture, HOA audio format, on-device rendering, consumer audio, TV, and accessories, and car audio systems.

The broadcast recording audio objects, the professional audio systems, and the consumer on-device capture may all code their output using HOA audio format. In this way, the audio content may be coded using the HOA audio format into a single representation that may be played back using the on-device rendering, the consumer audio, TV, and accessories, and the car audio systems. In other words, the single representation of the audio content may be played back at a generic audio playback system (i.e., as opposed to requiring a particular configuration such as 5.1, 7.1, etc.), such as audio playback system 16.

Other examples of context in which the techniques may be performed include an audio ecosystem that may include acquisition elements, and playback elements. The acquisition elements may include wired and/or wireless acquisition devices (e.g., Eigen microphones), on-device surround sound capture, and mobile devices (e.g., smartphones and tablets). In some examples, wired and/or wireless acquisition devices may be coupled to mobile device via wired and/or wireless communication channel(s).

In accordance with one or more techniques of this disclosure, the mobile device may be used to acquire a soundfield. For instance, the mobile device may acquire a soundfield via the wired and/or wireless acquisition devices and/or the on-device surround sound capture (e.g., a plurality of microphones integrated into the mobile device). The mobile device may then code the acquired soundfield into the HOA coefficients for playback by one or more of the playback elements. For instance, a user of the mobile device may record (acquire a soundfield of) a live event (e.g., a meeting, a conference, a play, a concert, etc.), and code the recording into HOA coefficients.

The mobile device may also utilize one or more of the playback elements to playback the HOA coded soundfield. For instance, the mobile device may decode the HOA coded soundfield and output a signal to one or more of the playback elements that causes the one or more of the playback elements to recreate the soundfield. As one example, the mobile device may utilize the wireless and/or wireless communication channels to output the signal to one or more speakers (e.g., speaker arrays, sound bars, etc.). As another example, the mobile device may utilize docking solutions to output the signal to one or more docking stations and/or one or more docked speakers (e.g., sound systems in smart cars and/or homes). As another example, the mobile device may utilize headphone rendering to output the signal to a set of headphones, e.g., to create realistic binaural sound.

In some examples, a particular mobile device may both acquire a 3D soundfield and playback the same 3D soundfield at a later time. In some examples, the mobile device may acquire a 3D soundfield, encode the 3D soundfield into HOA, and transmit the encoded 3D soundfield to one or more other devices (e.g., other mobile devices and/or other non-mobile devices) for playback.

Yet another context in which the techniques may be performed includes an audio ecosystem that may include audio content, game studios, coded audio content, rendering engines, and delivery systems. In some examples, the game studios may include one or more DAWs which may support editing of HOA signals. For instance, the one or more DAWs may include HOA plugins and/or tools which may be configured to operate with (e.g., work with) one or more game audio systems. In some examples, the game studios may output new stem formats that support HOA. In any case, the game studios may output coded audio content to the rendering engines which may render a soundfield for playback by the delivery systems.

The techniques may also be performed with respect to exemplary audio acquisition devices. For example, the techniques may be performed with respect to an Eigen microphone which may include a plurality of microphones that are collectively configured to record a 3D soundfield. In some examples, the plurality of microphones of Eigen microphone may be located on the surface of a substantially spherical ball with a radius of approximately 4 cm. In some examples, the audio encoding device 20 may be integrated into the Eigen microphone so as to output a bitstream 21 directly from the microphone.

Another exemplary audio acquisition context may include a production truck which may be configured to receive a signal from one or more microphones, such as one or more Eigen microphones. The production truck may also include an audio encoder, such as audio encoder 20 of FIG. 3.

The mobile device may also, in some instances, include a plurality of microphones that are collectively configured to record a 3D soundfield. In other words, the plurality of microphone may have X, Y, Z diversity. In some examples, the mobile device may include a microphone which may be rotated to provide X, Y, Z diversity with respect to one or more other microphones of the mobile device. The mobile device may also include an audio encoder, such as audio encoder 20 of FIG. 3.

A ruggedized video capture device may further be configured to record a 3D soundfield. In some examples, the ruggedized video capture device may be attached to a helmet of a user engaged in an activity. For instance, the ruggedized video capture device may be attached to a helmet of a user whitewater rafting. In this way, the ruggedized video capture device may capture a 3D soundfield that represents the action all around the user (e.g., water crashing behind the user, another rafter speaking in front of the user, etc. . . . ).

The techniques may also be performed with respect to an accessory enhanced mobile device, which may be configured to record a 3D soundfield. In some examples, the mobile device may be similar to the mobile devices discussed above, with the addition of one or more accessories. For instance, an Eigen microphone may be attached to the above noted mobile device to form an accessory enhanced mobile device. In this way, the accessory enhanced mobile device may capture a higher quality version of the 3D soundfield than just using sound capture components integral to the accessory enhanced mobile device.

Example audio playback devices that may perform various aspects of the techniques described in this disclosure are further discussed below. In accordance with one or more techniques of this disclosure, speakers and/or sound bars may be arranged in any arbitrary configuration while still playing back a 3D soundfield. Moreover, in some examples, headphone playback devices may be coupled to a decoder 24 via either a wired or a wireless connection. In accordance with one or more techniques of this disclosure, a single generic representation of a soundfield may be utilized to render the soundfield on any combination of the speakers, the sound bars, and the headphone playback devices.

A number of different example audio playback environments may also be suitable for performing various aspects of the techniques described in this disclosure. For instance, a 5.1 speaker playback environment, a 2.0 (e.g., stereo) speaker playback environment, a 9.1 speaker playback environment with full height front loudspeakers, a 22.2 speaker playback environment, a 16.0 speaker playback environment, an automotive speaker playback environment, and a mobile device with ear bud playback environment may be suitable environments for performing various aspects of the techniques described in this disclosure.

In accordance with one or more techniques of this disclosure, a single generic representation of a soundfield may be utilized to render the soundfield on any of the foregoing playback environments. Additionally, the techniques of this disclosure enable a rendered to render a soundfield from a generic representation for playback on the playback environments other than that described above. For instance, if design considerations prohibit proper placement of speakers according to a 7.1 speaker playback environment (e.g., if it is not possible to place a right surround speaker), the techniques of this disclosure enable a render to compensate with the other 6 speakers such that playback may be achieved on a 6.1 speaker playback environment.

Moreover, a user may watch a sports game while wearing headphones. In accordance with one or more techniques of this disclosure, the 3D soundfield of the sports game may be acquired (e.g., one or more Eigen microphones may be placed in and/or around the baseball stadium), HOA coefficients corresponding to the 3D soundfield may be obtained and transmitted to a decoder, the decoder may reconstruct the 3D soundfield based on the HOA coefficients and output the reconstructed 3D soundfield to a renderer, the renderer may obtain an indication as to the type of playback environment (e.g., headphones), and render the reconstructed 3D soundfield into signals that cause the headphones to output a representation of the 3D soundfield of the sports game.

In each of the various instances described above, it should be understood that the audio encoding device 20 may perform a method or otherwise comprise means to perform each step of the method for which the audio encoding device 20 is configured to perform In some instances, the means may comprise one or more processors. In some instances, the one or more processors may represent a special purpose processor configured by way of instructions stored to a non-transitory computer-readable storage medium. In other words, various aspects of the techniques in each of the sets of encoding examples may provide for a non-transitory computer-readable storage medium having stored thereon instructions that, when executed, cause the one or more processors to perform the method for which the audio encoding device 20 has been configured to perform.

Figure 7:
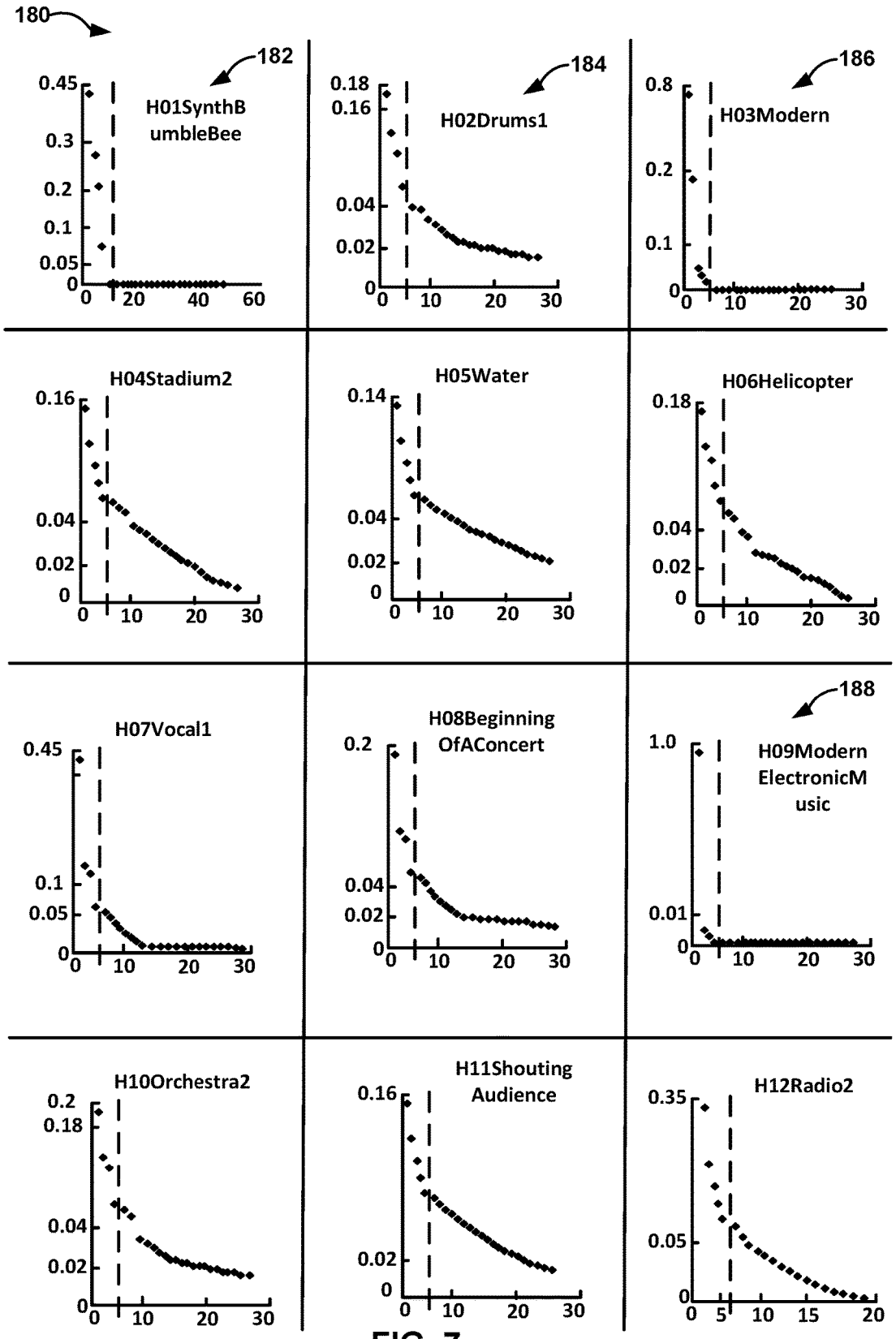
FIG. 7 is a conceptual diagram illustrating a set of line graphs of singular values for various audio objects.

FIG. 7 is a conceptual diagram illustrating a set of line graphs 180. The set of line graphs 180 represents singular value distributions for various captured soundfields. Each line graph of the set of line graphs 180 plots singular values for audio objects of various soundfields. As specific examples, line graph 182 plots singular values for a "bumblebee" soundfield, line graph 184 plots singular values for a "drums" soundfield, line graph 186 plots singular values for a "modem" soundfield, and line graph 188 plots singular values for a "modern electronic music" soundfield. Other line graphs of FIG. 7 are associated with soundfields representing "stadium," "water," "helicopter," "vocal," "beginning of a concert," "orchestra," "shouting audience," and "radio" settings. As shown in FIG. 7, each of the line graphs 182 (bumblebee), 186 (modem), and 188 (modern electronic music) includes singular values for background audio objects that have amplitudes equal to, or approximately equal to, zero. More specifically, the plot points positioned to the right of the respective vertical line in each of the line graphs 182, 184, 186, and 188, lie substantially on the respective x-axis.

In some examples, the soundfield analysis unit 44 may not code the background audio objects associated with the sounds plotted in the line graphs 182, 186, and 188, based on the singular values of these background audio objects having low amplitudes. In some examples, the bitstream generation unit 42 may allocate fewer (or no) bits to the signaling of the background audio objects of associated with the sounds plotted in the line graphs 182, 186, and 188, based on the singular values of these background audio objects having low amplitudes. In these examples, one or both of the soundfield analysis unit 44 and the bitstream generation unit 42 may still code and/or allocate bits, respectively, to the foreground audio objects.

In contrast, the line graph 184 (drums) illustrates background audio objects that associated with singular values that have amplitudes that are greater (or even significantly greater) than zero. In this example, the soundfield analysis unit 44 and/or the bitstream generation unit 42 may code and/or allocate bits, respectively, to the background audio objects of the drum sound, based on the singular values of these background audio objects having higher amplitudes. In this manner, the audio encoding device 20 may implement techniques of this disclosure to implement singular value-based coding and/or signaling of audio objects.

Figure 8:
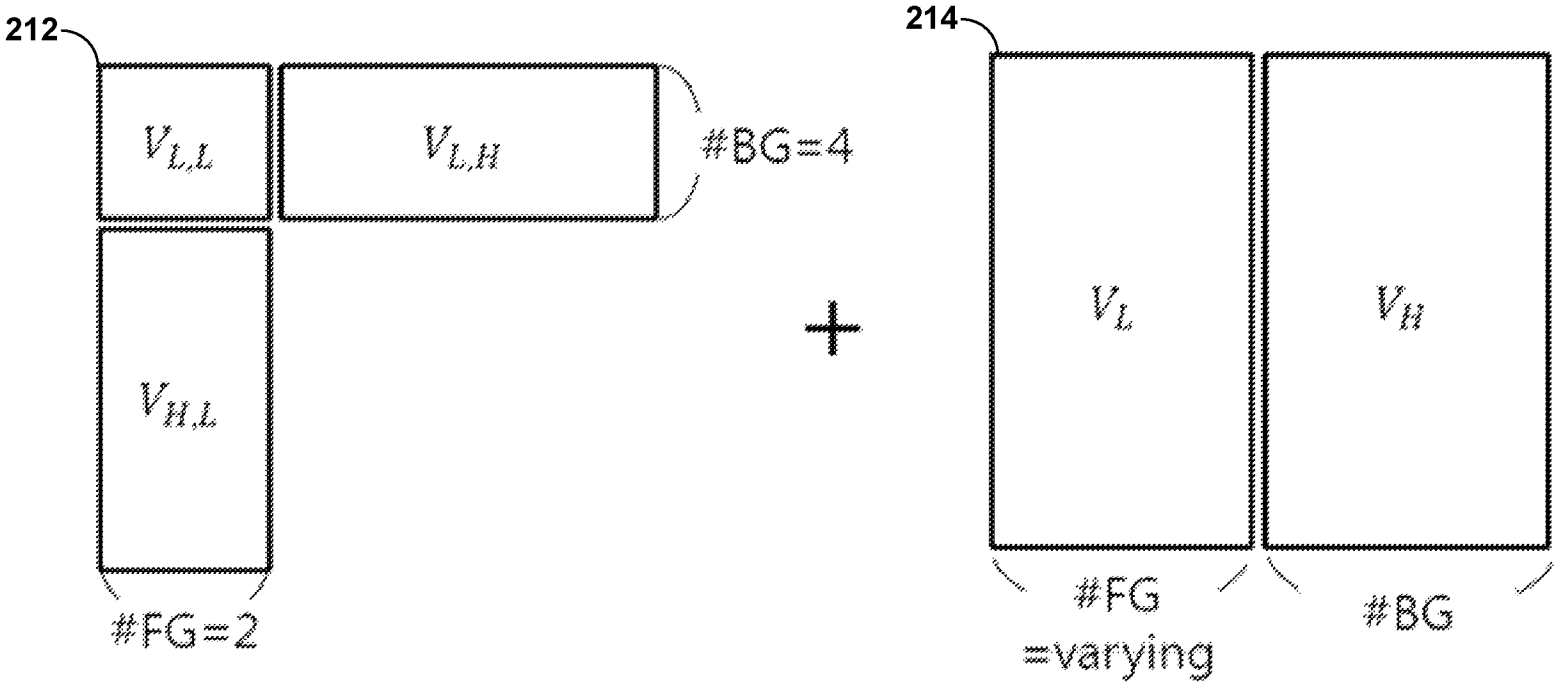
FIG. 8 is a conceptual diagram illustrating audio object signaling schemes in accordance with the techniques described herein.

FIG. 8 is a conceptual diagram illustrating audio object signaling schemes in accordance with the techniques described herein. The audio signaling scheme 6014, depicted at the right of FIG. 8, illustrates a signaling scheme that the audio encoding device 20 may implement in accordance with one or more aspects of this disclosure, in scenarios where the singular values associated with background audio objects are low enough that the background audio objects need not be signaled. In the example of the audio object signaling scheme 6014, the audio encoding device 20 may arrange foreground audio objects ("$V_L$") and background audio objects ("$V_H$") in adjacent columns. In one example, the left column of the audio object signaling scheme 6014 may include a total of six foreground audio objects. If the audio encoding device 20 determines that the singular values for the background audio objects are close to zero (e.g., below a threshold), then the audio encoding device 20 may code and/or signal only the six foreground audio objects arranged in the left column.

The traditional audio object signaling scheme 212, depicted at the left of FIG. 8, illustrates a signaling scheme that contrasts with the singular value-based techniques of the audio object signaling scheme 214. As shown in FIG. 8, according to the traditional audio object signaling scheme 212, the audio encoding device 20 may signal two foreground audio objects (arranged in column form), and four background audio objects (arranged in row form).

According to the singular value based coding scheme 214 for energy-concentrated frames, the audio encoding device 20 may quantize the top 6 (varying) US signals and the V vectors corresponding to the top 6 varying US signals. In this manner, the audio encoding device 20 may allocate more bits for AAC for higher singular value components.

In this manner, the audio encoding device 20 (and one or more components thereof, such as the soundfield analysis unit 44) may, in accordance with techniques of this disclosure, perform a method of compressing higher order ambisonic (HOA) coefficients representative of a soundfield, the method comprising determining when to use ambient HOA coefficients of the HOA coefficients to augment one or more foreground audio objects obtained through vector-based synthesis or decomposition of the HOA coefficients based on one or more singular values also obtained through the vector-based synthesis or decomposition of the HOA coefficients, the ambient HOA coefficients representative of an ambient component of the soundfield. In some examples, the HOA coefficients may also include one or more foreground HOA coefficients representative of the one or more foreground audio objects of the soundfield. In some examples, determining when to use the ambient HOA coefficients to augment the one or more foreground audio objects comprises analyzing (e.g., by the soundfield analysis unit 44) the one or more singular values obtained through the vector-based synthesis or decomposition of the HOA coefficients.

In some examples, determining when to use the ambient HOA coefficients to augment the one or more foreground audio objects comprises determining (e.g., by the soundfield analysis unit 44) whether one or more ambient singular values of the one or more singular values are less than a threshold value, where the ambient singular values are associated with the ambient component of the soundfield, and when the one or more ambient singular values associated with the ambient component are less than the threshold value, determining (e.g., by the soundfield analysis unit 44) not to use the ambient HOA coefficients to augment the foreground audio objects. In some examples, determining when to use the ambient HOA coefficients to augment the one or more foreground audio objects comprises, when the one or more ambient singular values are equal to or greater than the threshold value, determining (e.g., by the soundfield analysis unit 44) to use the ambient HOA coefficients to augment the foreground audio objects.

In some examples, each of the one or more singular values represents a square root of a corresponding energy value. In some examples, each of the one or more singular values represents a square root of a corresponding eigenvalue. In some examples, the method performed by the audio encoding device 20 may further include further comprising coding one or more S matrices that include the one or more singular values. In some examples, the method performed by the audio encoding device 20 includes coding (e.g., by the bitstream generation unit 42) one or more S matrices that include the one or more singular values. In some examples, determining (e.g., by the soundfield analysis unit 44) when to use the ambient HOA coefficients to augment the one or more foreground audio objects is based on one or more amplitudes corresponding to one or more ambient singular values of the one or more singular values, the ambient singular values being associated with the ambient component of the soundfield. In some examples, determining when to use the ambient HOA coefficients to augment the one or more foreground audio objects comprises determining (e.g., by the soundfield analysis unit 44) to use the ambient HOA coefficients to augment the foreground audio objects, and determining (e.g., by the bitstream generation unit 42) a number of bits to assign to the ambient component.

In this manner, the audio decoding device 24 (and/or various components thereof, such as the extraction unit 72) may, in accordance with aspects of this disclosure, be operable to perform a method of decoding encoded higher order ambisonics (HOA) coefficients representative of a soundfield, the method comprising determining whether to extract one or more ambient HOA coefficients from a bitstream (e.g., the vector-based bitstream 21). In one such example, the one or more ambient HOA coefficients represent an ambient component of the soundfield.

In this manner, in accordance with techniques of this disclosure, the audio encoding device 20 (and one or more components thereof, such as the bitstream generation unit 42) may perform a method of compressing higher order ambisonics (HOA) coefficients representative of a soundfield, the method comprising allocating bits to an audio object of the soundfield, based on an energy (or energy value) associated with the audio object, wherein the audio object is obtained through vector-based synthesis or decomposition of the HOA coefficients. In some examples, the number of the allocated bits (e.g., as allocated by the bitstream generation unit 42) is proportional to the energy (or energy value) associated with the audio object. In one such example, the number of the allocated bits (e.g., as allocated by the bitstream generation unit 42) is directly proportional to the energy (or energy value) associated with the audio object.

In some examples of the method that may be performed by the bitstream generation unit 42, the audio object is included in a plurality of audio objects of the soundfield, the allocated bits are selected from a set of bits, and allocating the bits to the audio object comprises allocating the set of bits to the plurality of audio objects in descending order of energy. In one such example of the method that the bitstream generation unit 42 may perform, each audio object of the plurality of audio objects is associated with a corresponding singular value, and each corresponding singular value represents a square root of a corresponding energy level.

In some examples of the method that the bitstream generation unit 42 may perform, the plurality of audio objects includes one or more foreground audio objects and one or more background audio objects. In one such example, allocating the set of bits comprises allocating (e.g., by the bitstream generation unit 42) all bits of the set of bits to the one or more foreground audio objects. In another such example, allocating the set of bits comprises allocating (e.g., by the bitstream generation unit 42) a first portion of the set of bits to the one or more foreground audio objects and a second portion of the set of bits to at least one background audio object of the one or more background audio objects.

In some examples, the method performed by the bitstream generation unit 42 further comprises determining a maximum number of bits that can be allocated to a single audio object of the plurality of audio objects. In one such example, allocating the set of bits comprises allocating (e.g., by the bitstream generation unit 42) the set of bits such that no audio object of the plurality of audio objects is allocated a number of bits that exceeds the maximum number. In some examples, allocating the set of bits comprises allocating (e.g., by the bitstream generation unit 42) the set of bits according to an amplitude of the corresponding singular value for each audio object of the plurality of audio objects.

In some such examples, allocating the set of bits according to the amplitude of each corresponding singular value comprises allocating (e.g., by the bitstream generation unit 42) a greater proportion of the set of bits to a first audio object that has a greater amplitude, and a lesser proportion of the set of bits to a second audio object that has a lesser amplitude. In one such example, the method that the bitstream generation unit 42 may perform further includes further comprising calculating the greater proportion and the lesser proportion as respective percentage values based on the greater amplitude of the first audio object and the lesser amplitude of the second audio object.

According to various aspects of this disclosure the audio encoding device 20 (and/or one or more components thereof) may be configured to perform a method of compressing higher order ambisonics (HOA) coefficients representative of a soundfield, the method comprising setting (e.g., by the bitstream generation unit 42) an upper limit on a number of bits that can be allocated to a single audio object of a plurality of audio objects representative of the soundfield.

In this manner, the audio decoding device 24 (and/or various components thereof, such as the extraction unit 72) may, in accordance with aspects of this disclosure, be operable to perform a method of decoding encoded higher order ambisonics (HOA) coefficients representative of a soundfield, the method including decoding encoded higher order ambisonics (HOA) coefficients representative of a soundfield, the method comprising allocating bits to an audio object of the soundfield, based on an energy associated with the audio object, the audio object being obtained through vector-based synthesis of the encoded HOA coefficients. In some examples, the method performed by the audio encoding device 24 may further include receiving a bit allocation scheme for the soundfield as part of an encoded bitstream (e.g., the bitstream 21).

In some examples, the bit allocation scheme may be included in metadata associated with the soundfield. In some instances, the metadata associated with the soundfield may further include an upper limit on a number of bits that can be allocated to a single audio object of a plurality of audio objects representative of the soundfield. in some examples of the method performed by the audio decoding device 24, allocating the bits may include allocating the bits such that no audio object of the soundfield is allocated a number of bits that exceeds the maximum number.

Example 1

In various examples, the matrices US and V are composed of a set of column vectors: {US_i, V_i}. Because an i-th vector, (US_i, V_i), and a j-th vector, (US_j, V_j), have different importance, dynamic bit allocation to each vector is disclosed. An i-th vector, (US_i, V_i), has the corresponding singular value, S_i_i, where S_i_i>=0. The higher singular value corresponds to the more energy concentration of that signal. Thus, total bits are allocated to an i-th vector, (US_i, V_i), according to the ratio of the singular value: S_i_i: allocatedRate=TOTALRATE*S_i_i/sum(S_i_i) where sum(S_i_i) is the sum of whole singular values.

Example 1a

The upper limit of the allocated rate for (US_i, V_i) is. First, (US_i, V_i) is sorted in descending order according to the corresponding singular values. When the calculated allocatedRate is greater than the pre-defined upper limit, the upper limit amount of bits is allocated. The remaining bits are used for the remaining (US_i, V_i).

Example 1b

Because S_i_i^2 corresponds to energy, S_i_i^2 can be used instead of S_i_i.

Example 2

If the most of energy is concentrated on a few singular values, only foreground signals (=the first few columns of US and V matrices) may be coded and transmitted. In this case, background signals (=the first few rows of US and V matrices) are not transmitted. For a certain test item, 99% of energy is concentrated on the top 6 singular values. In this case, only 6 foreground signals are coded and transmitted to a decoder. It provides potentially better quality than the conventional system where 2 foreground and 4 background signals are coded and transmitted.

Example 2a

Decision whether to use the proposed system (only foreground coding) or the conventional system (foreground+background coding) can be made based on the singular values. If the pre-defined number of singular values (for example 6) contain most of energy (for example 99%), the proposed system can be used instead of the conventional system.

Example 2b

Bit allocation can be performed based on techniques described in Example 1 above.

Figure 9A:
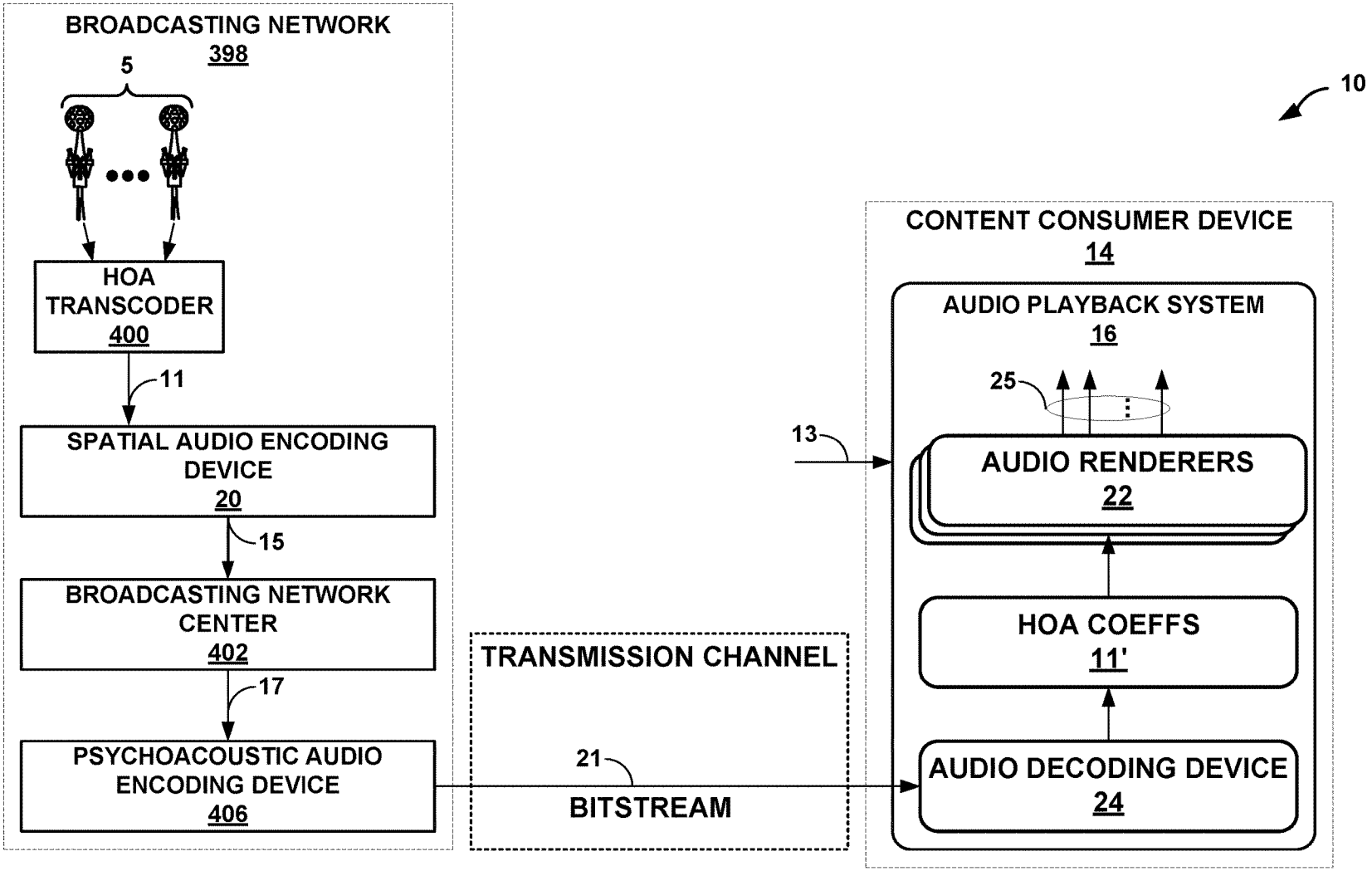
FIGS. 9A-9D are conceptual diagrams illustrating a system that may perform various aspects of the techniques described in this disclosure, and further details of a broadcasting network center of FIG. 9A.

FIGS. 9A-9D are conceptual diagrams illustrating a system that may perform various aspects of the techniques described in this disclosure, and further details of a broadcasting network center of FIG. 9A. FIG. 9A is a diagram illustrating a system 10 that may perform various aspects of the techniques described in this disclosure. As shown in the example of FIG. 9, the system 10 includes a broadcasting network 398 and a content consumer device 14. While described in the context of the broadcasting network 398 and the content consumer device 14, the techniques may be implemented in any context in which SHCs (which may also be referred to as HOA coefficients) or any other hierarchical representation of a soundfield are encoded to form a bitstream representative of the audio data. Moreover, the broadcasting network 398 may represent a system comprising one or more of any form of computing device capable of implementing the techniques described in this disclosure, including a handset (or cellular phone), a tablet computer, a smart phone, a desktop computer, or dedicated hardware to provide a few examples or. Likewise, the content consumer device 14 may represent any form of computing device capable of implementing the techniques described in this disclosure, including a handset (or cellular phone), a tablet computer, a smart phone, a set-top box, or a desktop computer to provide a few examples.

The broadcasting network 398 may represent any entity that may generate multi-channel audio content and possibly video content for consumption by content consumers, such as the content consumer device 14. The broadcasting network 398 may capture live audio data at events, such as sporting events, while also inserting various other types of additional audio data, such as commentary audio data, commercial audio data, intro or exit audio data and the like, into the live audio content. The content consumer device 14 represents an individual that owns or has access to an audio playback system, which may refer to any form of audio playback system capable of rendering higher order ambisonic audio data (which includes higher order audio coefficients that may also be referred to as spherical harmonic coefficients) for play back as multi-channel audio content. In the example of FIG. 9A, the content consumer device 14 includes an audio playback system 16.

The broadcasting network 398 includes microphones 5 that record or otherwise obtain live recordings in various formats (including directly as HOA coefficients) and audio objects. When the microphones 5 obtain live audio directly as HOA coefficients, the microphones 5 may include an HOA transcoder, such as an HOA transcoder 400 shown in the example of FIG. 9A. In other words, although shown as separate from the microphones 5, a separate instance of the HOA transcoder 400 may be included within each of the microphones 5 so as to naturally transcode the captured feeds into HOA coefficients 11. However, when not included within the microphones 5, the HOA transcoder 400 may transcode the live feeds output from the microphones 5 into HOA coefficients 11. In this respect, the HOA transcoder 400 may represent a unit configured to transcode microphone feeds and/or audio objects into HOA coefficients 11. The broadcasting network 398 therefore includes the HOA transcoder 400 as integrated with the microphones 5, as an HOA transcoder separate from the microphones 5 or some combination thereof.

The broadcasting network 398 may also include a spatial audio encoding device 20, a broadcasting network center 402 and a psychoacoustic audio encoding device 406. The spatial audio encoding device 20 may represent a device capable of performing the mezzanine compression techniques described in this disclosure with respect to the HOA coefficients 11 to obtain mezzanine formatted audio data 15. The spatial audio encoding device 20 may represent one implementation of the audio encoding device 20 of FIGS. 1 and 2, and is therefore similarly numbered in this disclosure. Although described in more detail below, the spatial audio encoding device 20 may be configured to perform this mezzanine compression with respect to the HOA coefficients 11 through application of a vector-based synthesis to the HOA coefficients 11.

The spatial audio encoding device 20 may be configured to encode the HOA coefficients 11 using a vector-based synthesis methodology involving application of a linear invertible transform (LI). One example of the linear invertible transform is referred to as a "singular value decomposition" (or "SVD"). In this example, the spatial audio encoding device 20 may apply SVD to the HOA coefficients 11 to determine a decomposed version of the HOA coefficients 11. The spatial audio encoding device 20 may then analyze the decomposed version of the HOA coefficients 11 to identify various parameters, which may facilitate reordering of the decomposed version of the HOA coefficients 11. The spatial audio encoding device 20 may then reorder the decomposed version of the HOA coefficients 11 based on the identified parameters, where such reordering, as described in further detail below, may improve coding efficiency given that the transformation may reorder the HOA coefficients across frames of the HOA coefficients (where a frame commonly includes M samples of the HOA coefficients 11 and M is, in some examples, set to 1024). After reordering the decomposed version of the HOA coefficients 11, the spatial audio encoding device 20 may select those of the decomposed version of the HOA coefficients 11 representative of foreground (or, in other words, distinct, predominant or salient) components of the soundfield. The spatial audio encoding device 20 may specify the decomposed version of the HOA coefficients 11 representative of the foreground components as an audio object and associated directional information.

The spatial audio encoding device 20 may also perform a soundfield analysis with respect to the HOA coefficients 11 in order, at least in part, to identify those of the HOA coefficients 11 representative of one or more background (or, in other words, ambient) components of the soundfield. The spatial audio encoding device 20 may perform energy compensation with respect to the background components given that, in some examples, the background components may only include a subset of any given sample of the HOA coefficients 11 (e.g., such as those corresponding to zero and first order spherical basis functions and not those corresponding to second or higher order spherical basis functions). When order-reduction is performed, in other words, the spatial audio encoding device 20 may augment (e.g., add/subtract energy to/from) the remaining background HOA coefficients of the HOA coefficients 11 to compensate for the change in overall energy that results from performing the order reduction.

The spatial audio encoding device 20 may perform a form of interpolation with respect to the foreground directional information and then perform an order reduction with respect to the interpolated foreground directional information to generate order reduced foreground directional information. The spatial audio encoding device 20 may further perform, in some examples, a quantization with respect to the order reduced foreground directional information, outputting coded foreground directional information. In some instances, this quantization may comprise a scalar/entropy quantization. The spatial audio encoding device 20 may then output the mezzanine formatted audio data 15 as the background components, the foreground audio objects, and the quantized directional information. The background components and the foreground audio objects may comprise pulse code modulated (PCM) transport channels in some examples. The spatial audio encoding device 20 may then transmit or otherwise output the mezzanine formatted audio data 15 to the broadcasting network center 402. Although not shown in the example of FIG. 9A, further processing of the mezzanine formatted audio data 15 may be performed to accommodate transmission from the spatial audio encoding device 20 to the broadcasting network center 402 (such as encryption, satellite compression schemes, fiber compression schemes, etc.).

Mezzanine formatted audio data 15 may represent audio data that conforms to a so-called mezzanine format, which is typically a lightly compressed (relative to end-user compression provided through application of psychoacoustic audio encoding to audio data, such as MPEG surround, MPEG-AAC, MPEG-USAC or other known forms of psychoacoustic encoding) version of the audio data. Given that broadcasters prefer dedicated equipment that provides low latency mixing, editing, and other audio and/or video functions, broadcasters are reluctant to upgrade the equipment given the cost of such dedicated equipment. To accommodate the increasing bitrates of video and/or audio and provide interoperability with older or, in other words, legacy equipment that may not be adapted to work on high definition video content or 3D audio content, broadcasters have employed this intermediate compression scheme, which is generally referred to as "mezzanine compression," to reduce file sizes and thereby facilitate transfer times (such as over a network or between devices) and improved processing (especially for older legacy equipment). In other words, this mezzanine compression may provide a more lightweight version of the content which may be used to facilitate editing times, reduce latency and improve the overall broadcasting process.

The broadcasting network center 402 may therefore represent a system responsible for editing and otherwise processing audio and/or video content using an intermediate compression scheme to improve the work flow in terms of latency. In the context of processing audio data, the broadcasting network center 402 may, in some examples, insert additional audio data into the live audio content represented by the mezzanine formatted audio data 15. This additional audio data may comprise commercial audio data representative of commercial audio content, television studio show audio data representative of television studio audio content, intro audio data representative of intro audio content, exit audio data representative of exit audio content, emergency audio data representative of emergency audio content (e.g., weather warnings, national emergencies, local emergencies, etc.) or any other type of audio data that may be inserted into mezzanine formatted audio data 15.

In some examples, the broadcasting network center 402 includes legacy audio equipment capable of processing up to 16 audio channels. In the context of 3D audio data that relies on HOA coefficients, such as the HOA coefficients 11, the HOA coefficients 11 may have more than 16 audio channels (e.g., a 4th order representation of the 3D soundfield would require (4+1)2 or 25 HOA coefficients per sample, which is equivalent to 25 audio channels). This limitation in legacy broadcasting equipment may prevent adoption of 3D HOA-based audio formats, such as that set forth in the ISO/IEC DIS 23008-3 document, entitled "Information technology—High efficiency coding and media delivery in heterogeneous environments—Part 3: 3 D audio," by ISO/IEC JTC 1/SC 29/WG 11, dated 2014 Jul. 25. As such, the techniques described in this disclosure may promote a form of mezzanine compression that allows for obtaining the mezzanine formatted audio data 15 from the HOA coefficients 11 in a manner that overcomes this limitation of legacy audio equipment. That is, the spatial audio encoding device 20 may be configured to perform the techniques described in this disclosure to obtain the mezzanine audio data 15 having 16 or fewer audio channels (and possibly as few as 6 audio channels given that legacy audio equipment may, in some examples, allow for processing 5.1 audio content, where the '0.1' represents the sixth audio channel).

In any event, the broadcasting network center 402 may output augmented mezzanine formatted audio data 17. The augmented mezzanine formatted audio data 17 may include the mezzanine formatted audio data 15 and any additional audio data inserted into the mezzanine formatted audio data 15 by the broadcasting network center 404. Prior to distribution, the broadcasting network 398 may further compress the augmented mezzanine formatted audio data 17. As shown in the example of FIG. 9A, the psychoacoustic audio encoding device 406 may perform psychoacoustic audio encoding (such as any of the examples described above) with respect to the augmented mezzanine formatted audio data 17 to generate a bitstream 21. The broadcasting network 398 may then transmit the bitstream 21 via a transmission channel to the content consumer device 14.

In some examples, the psychoacoustic audio encoding device 406 may represent multiple instances of a psychoacoustic audio coder, each of which is used to encode a different audio object or HOA channel of each of augmented mezzanine formatted audio data 17. In some instances, this psychoacoustic audio encoding device 406 may represent one or more instances of an advanced audio coding (AAC) encoding unit. Often, the psychoacoustic audio coder unit 40 may invoke an instance of an AAC encoding unit for each of channel of the augmented mezzanine formatted audio data 17. More information regarding how the background spherical harmonic coefficients may be encoded using an AAC encoding unit can be found in a convention paper by Eric Hellerud, et al., entitled "Encoding Higher Order Ambisonics with AAC," presented at the 124th Convention, 2008 May 17-20 and available at: http://ro.uow.edu.au/cgi/viewcontent.cgi?article=8025&context=engpapers. In some instances, the psychoacoustic audio encoding device 406 may audio encode various channels (e.g., background channels) of the augmented mezzanine formatted audio data 17 using a lower target bitrate than that used to encode other channels (e.g., foreground channels) of the augmented mezzanine formatted audio data 17.

While shown in FIG. 9A as being directly transmitted to the content consumer device 14, the broadcasting network 398 may output the bitstream 21 to an intermediate device positioned between the broadcasting network 398 and the content consumer device 14. This intermediate device may store the bitstream 21 for later delivery to the content consumer device 14, which may request this bitstream. The intermediate device may comprise a file server, a web server, a desktop computer, a laptop computer, a tablet computer, a mobile phone, a smart phone, or any other device capable of storing the bitstream 21 for later retrieval by an audio decoder. This intermediate device may reside in a content delivery network capable of streaming the bitstream 21 (and possibly in conjunction with transmitting a corresponding video data bitstream) to subscribers, such as the content consumer device 14, requesting the bitstream 21.

Alternatively, the broadcasting network 398 may store the bitstream 21 to a storage medium, such as a compact disc, a digital video disc, a high definition video disc or other storage media, most of which are capable of being read by a computer and therefore may be referred to as computer-readable storage media or non-transitory computer-readable storage media. In this context, the transmission channel may refer to those channels by which content stored to these mediums are transmitted (and may include retail stores and other store-based delivery mechanism). In any event, the techniques of this disclosure should not therefore be limited in this respect to the example of FIG. 9A.

As further shown in the example of FIG. 9A, the content consumer device 14 includes the audio playback system 16. The audio playback system 16 may represent any audio playback system capable of playing back multi-channel audio data. The audio playback system 16 may include a number of different renderers 22. The renderers 22 may each provide for a different form of rendering, where the different forms of rendering may include one or more of the various ways of performing vector-base amplitude panning (VBAP), and/or one or more of the various ways of performing soundfield synthesis. As used herein, "A and/or B" means "A or B", or both "A and B".

The audio playback system 16 may further include an audio decoding device 24. The audio decoding device 24 may represent a device configured to decode HOA coefficients 11' from the bitstream 21, where the HOA coefficients 11' may be similar to the HOA coefficients 11 but differ due to lossy operations (e.g., quantization) and/or transmission via the transmission channel. That is, the audio decoding device 24 may dequantize the foreground directional information specified in the bitstream 21, while also performing psychoacoustic decoding with respect to the foreground audio objects specified in the bitstream 21 and the encoded HOA coefficients representative of background components. The audio decoding device 24 may further perform interpolation with respect to the decoded foreground directional information and then determine the HOA coefficients representative of the foreground components based on the decoded foreground audio objects and the interpolated foreground directional information. The audio decoding device 24 may then determine the HOA coefficients 11' based on the determined HOA coefficients representative of the foreground components and the decoded HOA coefficients representative of the background components.

The audio playback system 16 may, after decoding the bitstream 21 to obtain the HOA coefficients 11' and render the HOA coefficients 11' to output loudspeaker feeds 25. The loudspeaker feeds 25 may drive one or more loudspeakers (which are not shown in the example of FIG. 9A for ease of illustration purposes).

To select the appropriate renderer or, in some instances, generate an appropriate renderer, the audio playback system 16 may obtain loudspeaker information 13 indicative of a number of loudspeakers and/or a spatial geometry of the loudspeakers. In some instances, the audio playback system 16 may obtain the loudspeaker information 13 using a reference microphone and driving the loudspeakers in such a manner as to dynamically determine the loudspeaker information 13. In other instances or in conjunction with the dynamic determination of the loudspeaker information 13, the audio playback system 16 may prompt a user to interface with the audio playback system 16 and input the loudspeaker information 16.

The audio playback system 16 may then select one of the audio renderers 22 based on the loudspeaker information 13. In some instances, the audio playback system 16 may, when none of the audio renderers 22 are within some threshold similarity measure (loudspeaker geometry wise) to that specified in the loudspeaker information 13, the audio playback system 16 may generate the one of audio renderers 22 based on the loudspeaker information 13. The audio playback system 16 may, in some instances, generate the one of audio renderers 22 based on the loudspeaker information 13 without first attempting to select an existing one of the audio renderers 22.

Figure 9B:
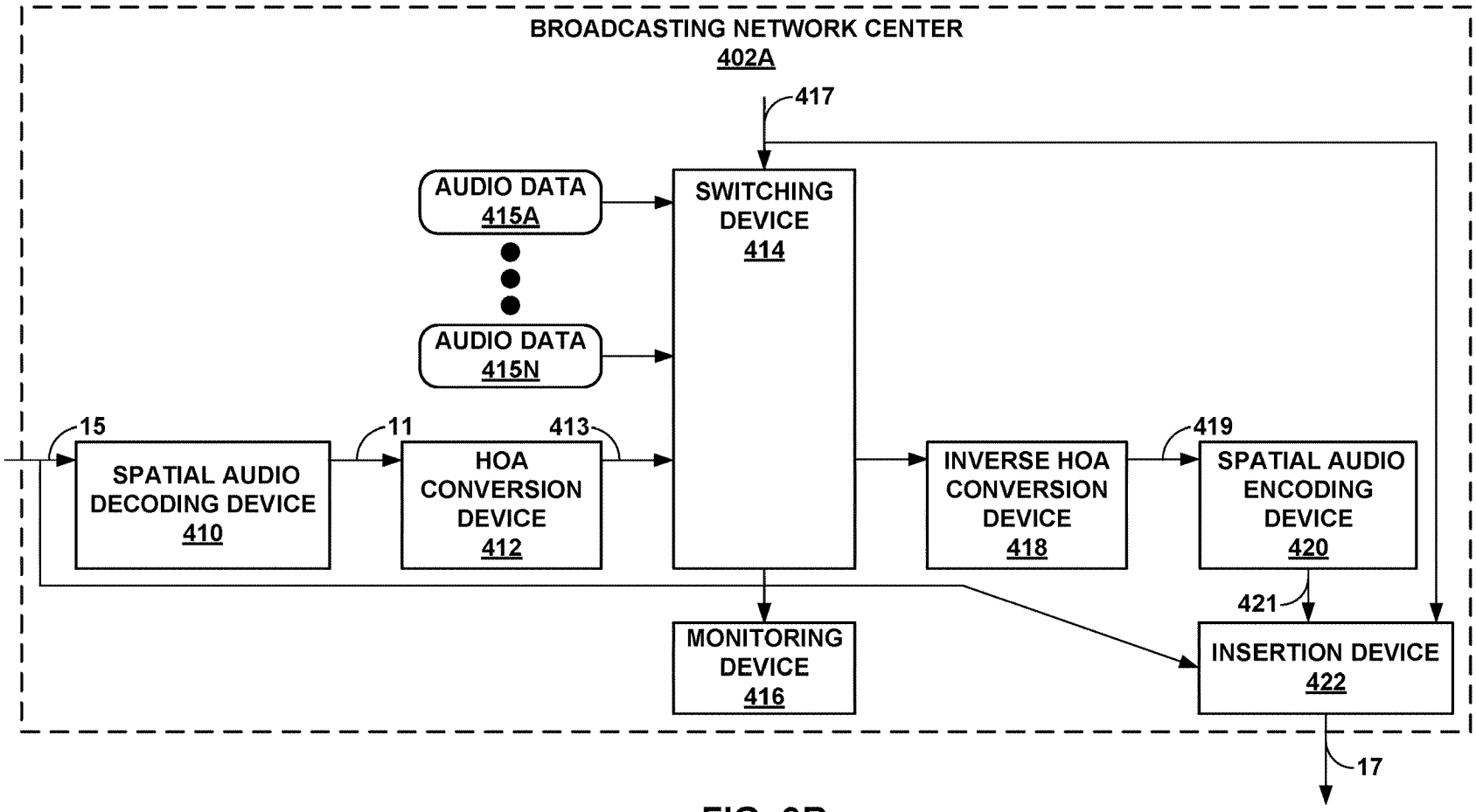
Figure 9C:
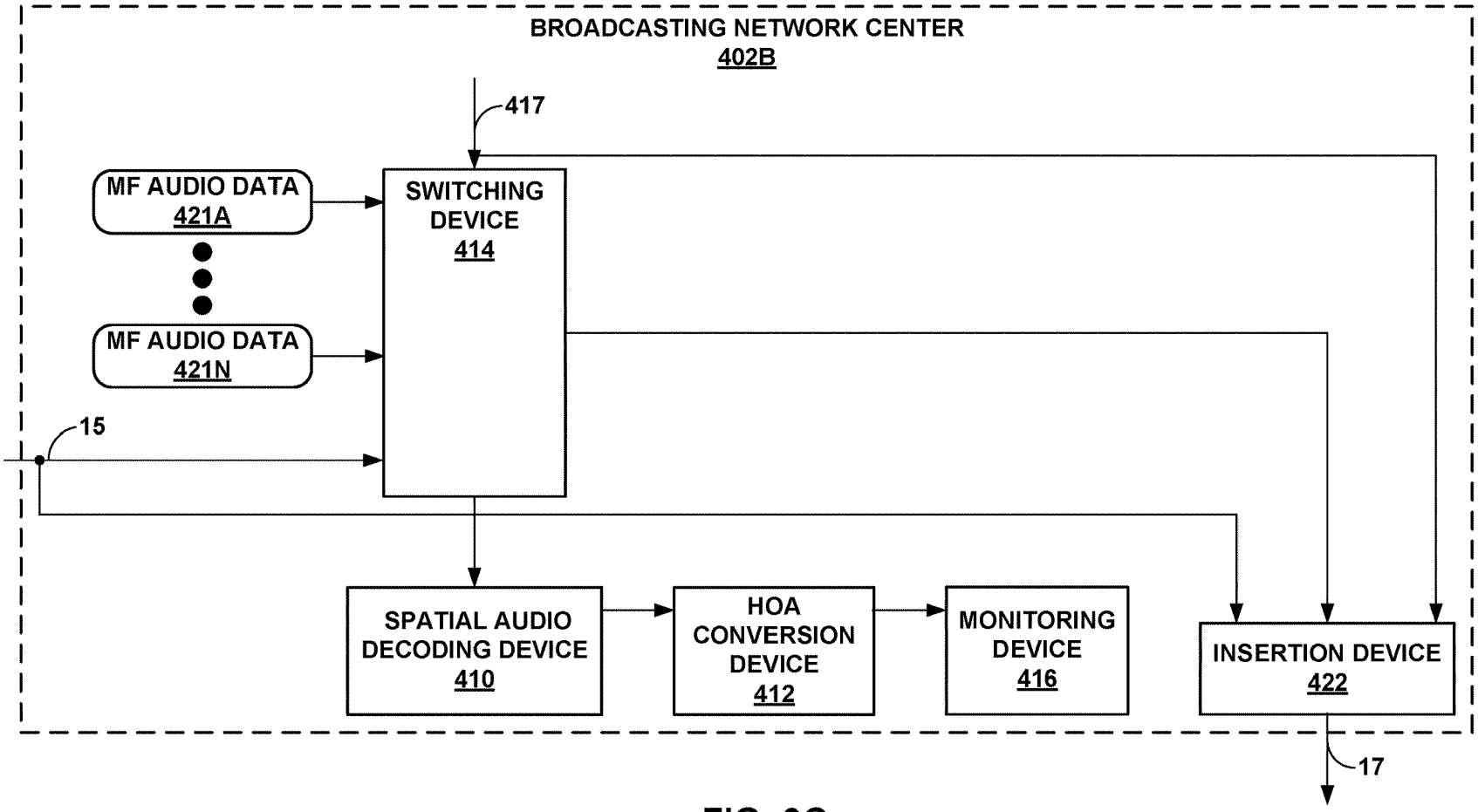
Figure 9D:
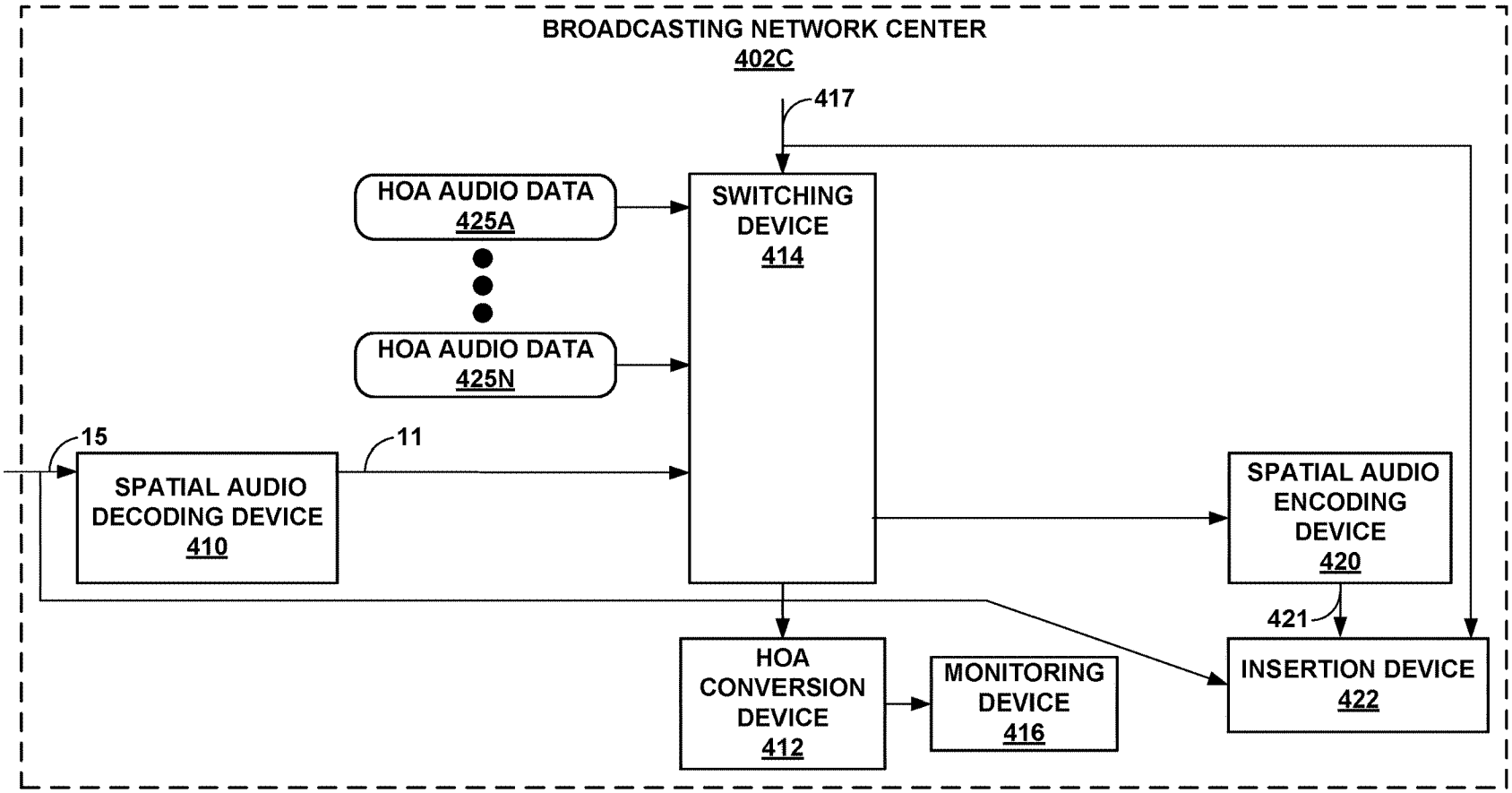

FIGS. 9B-9D are diagrams illustrating, in more detail, three different examples of the broadcasting network center 402 of FIG. 9A. In the example of FIG. 9B, the first example of the broadcasting network center 402, which is denoted broadcasting network center 402A, includes a spatial audio decoding device 410, an HOA conversion device 412, a switching device 414, a monitoring device 416, an Inverse HOA conversion device 418, a spatial audio encoding device 420 and an insertion device 422.

The spatial audio decoding device 410, which is described in more detail at other portions of this disclosure, represents a device or unit configured to perform operations generally reciprocal of those described with respect to the spatial audio encoding device 20. The spatial audio decoding device 410 may, in other words, obtain mezzanine formatted audio data 15 and perform mezzanine decompression with respect to the mezzanine formatted audio data 15 to obtain the HOA coefficients 11. The spatial audio decoding device 410 may output the HOA coefficients 11 to the HOA conversion device 412. The HOA conversion device 412 represents a device or unit configured to convert the HOA coefficients 11 from the spherical harmonic domain to a spatial domain (e.g. by rendering the HOA coefficients 11 to a specified spatial sound format, such as a 5.1 surround sound format). The HOA conversion device 412 may perform this conversion to accommodate the legacy audio equipment, such as the switching device 414 and the monitoring device 416 (both or one of which may be configured to operation with respect to a certain number of channels, such as the 6 channels of a 5.1 surround sound format). The HOA conversion device 412 may output spatial formatted audio data 413 to the switching device 414.

The switching device 414 may represent a device or unit configured to switch between various different audio data, including the spatial formatted audio data 413. The switching device 414 may switch between additional audio data 415A-415N ("additional audio data 415," which may also be referred to as "audio data 415" as shown in the example of FIG. 9B) and the spatial formatted audio data 413. The switching device 414 may switch between the audio data 415 and the spatial formatted audio data 415 as instructed by an input 417, which may be input by an operator, audio editor or other broadcaster personnel. The input 417 may configure the switching device 414 to output one of the audio data 415 or the spatial formatted audio data 413 to monitoring device 416. The operator, audio editor or other broadcasting personnel may listen to the selected one of the audio data 415 or the spatial formatted audio data 413 and generate additional input 417 specifying when one of the additional audio data 415 should be inserted into the mezzanine formatted audio data 15.

Upon receiving this additional input 417, the switching device 414 may switch through the selected one of the additional audio data 415, e.g., additional audio data 415A, through to the inverse HOA conversion device 418. This additional audio data 415A may represent any of the above discussed types of additional audio content, such as commercial audio content, television studio audio content, exit audio content, intro audio content (where intro and exit audio content may be referred to as "bumper audio content"), emergency audio content and the like. In any event, this additional audio data 415A (and generally the additional audio content 415) is not specified in either the mezzanine format or the spherical harmonic domain. Instead, this additional audio data 415 is typically specified in the spatial domain, often in the 5.1 surround sound format. To insert this additional audio data 415A into the mezzanine formatted spatial audio data 15, the broadcasting network center 402A may pass the additional audio data 415A to the inverse HOA conversion device 418.

The inverse HOA conversion device 418 may operate reciprocally to the HOA conversion device 412 to convert the additional audio data 415A from the spatial domain to the spherical harmonic domain. The inverse HOA conversion device 418 may then output the converted additional audio data 415A as converted additional audio data 419 to the spatial audio decoding device 420. The spatial audio encoding device 420 may operate in a manner substantially similar to and possibly the same as that described above with respect to spatial audio encoding device 20. The spatial audio encoding device 420 may output mezzanine formatted additional audio data 421 to the insertion device 422. The insertion device 422 may represent a device or unit configured to insert the mezzanine formatted additional audio data 421 into the mezzanine formatted audio data 15. In some examples, the insertion device 422 inserts mezzanine formatted additional audio data 421 into the original mezzanine formatted audio data 15, where this original mezzanine formatted audio data 15 has not undergone spatial audio decoding (or, in other words, mezzanine decompression), HOA conversion, spatial audio re-encoding and inverse HOA conversion, so as to avoid potential injection of audio artifacts into the augmented mezzanine formatted audio data 17. The insertion device 422 may insert this mezzanine formatted audio data 421 into the mezzanine formatted audio data 15 by, at least in part, crossfading the mezzanine formatted audio data 421 into the mezzanine formatted audio data 15.

FIG. 9C is a block diagram illustrating, in more detail, a second example of the broadcasting network center 402 of FIG. 9A. In the example of FIG. 9C, the second example of the broadcasting network center 402, which is denoted broadcasting network center 402B, may be substantially the same as the broadcasting network center 402A, except that the additional audio data 421A-421N shown in the example of FIG. 9C is already specified in the mezzanine format (MF). As such, the additional audio data 421A-421N is denoted as mezzanine formatted (MF) audio data 421A-421N ("MF audio data 425") in the example of FIG. 9C. The MF audio data 421 may each be substantially similar to the mezzanine formatted additional audio data 421 described above with respect to the example of FIG. 9B. In any event, given that the MF audio data 425 is specified in accordance with the mezzanine format, the broadcasting network center 402B may not include the inverse HOA conversion device 418 and the spatial audio encoding device 420 described above with respect to the broadcasting network center 402A. Because all of the audio data 421 and 15 input into the switching device 414 is specified in the same format (e.g., mezzanine format) no spatial audio decoding and conversion may be required prior to processing by switching device 417.

To monitor the MF additional audio data 421 and the MV audio data 15, the broadcasting network center 402B may include the spatial audio decoding device 410 and the HOA conversion device 412 to perform spatial audio decoding and HOA conversion with respect to the outputs of the switching device 414. The spatial audio decoding and HOA conversion may result in audio data specified in the spatial domain (e.g., 5.1 audio data) that is then input to the monitoring device 416 to allow an operator, editor or other broadcasting personnel to monitor the selected one (as specified by input data 417) of the inputs to the switching device 414.

FIG. 9D is a block diagram illustrating, in more detail, a third example of the broadcasting network center 402 of FIG. 9A. In the example of FIG. 9D, the third example of the broadcasting network center 402, which is denoted broadcasting network center 402C, may be substantially the same as the broadcasting network center 402B, except that the additional audio data 425A-425N shown in the example of FIG. 9D is specified in the HOA format (or, in other words, in the spherical harmonic domain). As such, the additional audio data 425A-425N is denoted as HOA audio data 425A-425N ("HOA audio data 425") in the example of FIG. 9D. Given that the HOA audio data 425 is specified in accordance with the HOA format, the broadcasting network center 402B may not include the inverse HOA conversion device 418. However, the broadcasting network center 402B may include the spatial audio encoding device 420 described above with respect to the broadcasting network center 402A so as to perform mezzanine compression with respect to the HOA audio data 425 to obtain MF additional audio data 421. Because the audio data 425 is specified in the HOA domain (or, in other words, the spherical harmonic domain), the spatial audio decoding device 410 performs spatial audio decoding with respect to the mezzanine formatted audio data 15 to obtain the HOA coefficients 11, thereby harmonizing the input format into switching device 414.

To monitor the HOA audio data 421 and 11, the broadcasting network center 402B may include the HOA conversion device 412 to perform HOA conversion with respect to the outputs of the switching device 414. The HOA conversion may result in audio data specified in the spatial domain (e.g., 5.1 audio data) that is then input to the monitoring device 416 to allow an operator, editor or other broadcasting personnel to monitor the selected one (as specified by input data 417) of the inputs to the switching device 414.

In this way, the techniques may enable the broadcasting network center 402 to be configured to store mezzanine formatted audio data generated as a result of performing mezzanine compression with respect to higher order ambisonic audio data, and process the mezzanine formatted audio data.

In these and other instances, the mezzanine formatted audio data is generated as a result of performing a mezzanine compression that does not involve any application of psychoacoustic audio encoding to the higher order ambisonic audio data.

In these and other instances, the mezzanine formatted audio data is generated as a result of performing spatial audio encoding with respect to the higher order ambisonic audio data.

In these and other instances, the mezzanine formatted audio data is generated as a result of performing a vector-based synthesis with respect to the higher order ambisonic audio data.

In these and other instances, the mezzanine formatted audio data is generated as a result of performing a singular value decomposition with respect to the higher order ambisonic audio data.

In these and other instances, the mezzanine formatted audio data includes one or more background components of a soundfield represented by the higher order ambisonic audio data.

In these and other instances, the background components include higher order ambisonic coefficients of the higher order ambisonic audio data corresponding to spherical basis function having an order less than two.

In these and other instances, the background components only include higher order ambisonic coefficients of the higher order ambisonic audio data corresponding to spherical basis function having an order less than two.

In these and other instances, the mezzanine formatted audio data includes one or more foreground components of a soundfield represented by the higher order ambisonic audio data.

In these and other instances, the mezzanine formatted audio data is generated as a result of performing a vector-based synthesis with respect to the higher order ambisonic audio data. In these instances, the foreground components include foreground audio objects decomposed from the higher order audio objects by performing the vector-based synthesis with respect to the higher order ambisonic audio data.

In these and other instances, the mezzanine formatted audio data includes one or more background components and one or more foreground components of a soundfield represented by the higher order ambisonic audio data.

In these and other instances, the mezzanine formatted audio data includes one or more pulse code modulated (PCM) transport channels and sideband information.

In these and other instances, the mezzanine formatted audio data is generated as a result of performing a vector-based synthesis with respect to the higher order ambisonic audio data to obtain the mezzanine formatted audio data. In these instances, the sideband information includes directional information output as a result of performing the vector-based synthesis with respect to the higher order ambisonic audio data.

In these and other instances, the mezzanine formatted audio data is generated as a result of performing a singular value decomposition with respect to the higher order ambisonic audio data to obtain the mezzanine formatted audio data. In these instances, the sideband information includes one or more V vectors output as a result of performing the vector-based synthesis with respect to the higher order ambisonic audio data.

In these and other instances, the broadcasting network center 402 may be configured to insert additional audio data into the mezzanine formatted audio data.

In these and other instances, the broadcasting network center 402 may be configured to insert commercial audio data into the mezzanine formatted audio data.

In these and other instances, the broadcasting network center 402 may be configured to insert a television studio show into the mezzanine formatted audio data.

In these and other instances, the broadcasting network center 402 may be configured to crossfade additional audio data into the mezzanine formatted audio data.

In these and other instances, the broadcasting network center 402 may be configured to process the mezzanine formatted audio data without performing either of mezzanine decompression or higher order ambisonic conversion with respect to the mezzanine formatted audio data.

In these and other instances, the broadcasting network center 402 may be configured to obtain additional audio data specified in a spatial domain, convert the additional audio data from the spatial domain to a spherical harmonic domain such that a soundfield described by the additional audio data is represented as additional higher order ambisonic audio data, and perform mezzanine compression with respect to the additional higher order ambisonic audio data to generate mezzanine formatted additional audio data. In these instances, the broadcasting network center 402 may be configured to insert mezzanine formatted additional audio data into the mezzanine formatted audio data.

In these and other instances, the broadcasting network center 402 may be configured to obtain mezzanine formatted additional audio data specified in a spherical harmonic domain. In these instances, the broadcasting network center 402 may be configured to insert mezzanine formatted additional audio data into the mezzanine formatted audio data.

In these and other instances, the broadcasting network center 402 may be configured to obtain additional higher order ambisonic audio data specified in a spherical harmonic domain, and perform mezzanine compression with respect to the additional higher order ambisonic audio data to generate mezzanine formatted additional audio data. In these instances, the broadcasting network center 402 may be configured to insert mezzanine formatted additional audio data into the mezzanine formatted audio data.

In these and other instances, the broadcasting network center 402 may be configured to perform psychoacoustic audio encoding with respect to the mezzanine formatted audio data to generate compressed audio data.

Figure 10:
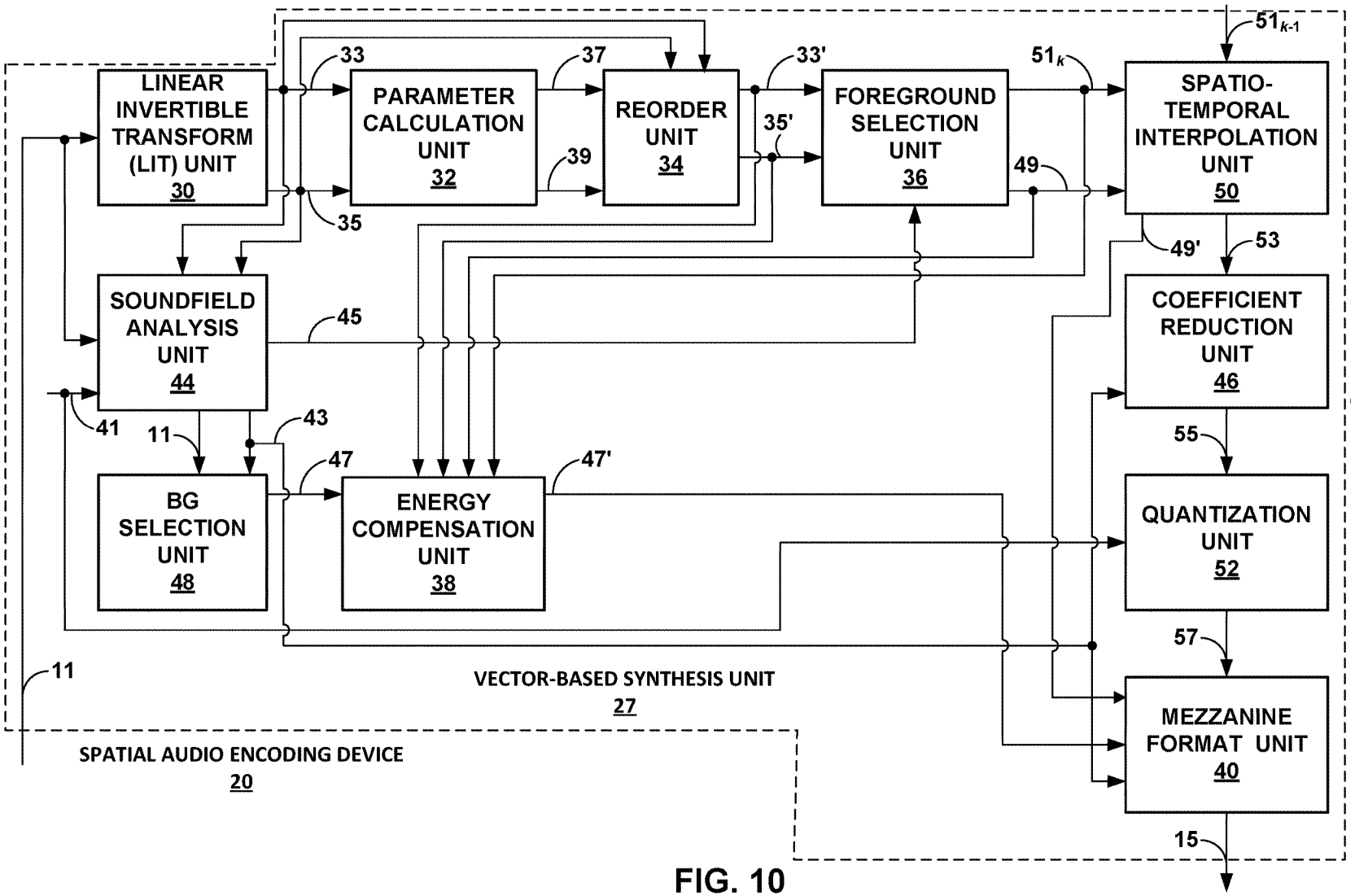
FIG. 10 is a block diagram illustrating, in more detail, one example of the spatial audio encoding device shown in the example of FIG. 9A that may perform various aspects of the techniques described in this disclosure

FIG. 10 is a block diagram illustrating, in more detail, one example of the spatial audio encoding device 20 shown in the example of FIG. 9A that may perform various aspects of the techniques described in this disclosure. The spatial audio encoding device 20 a vector-based synthesis methodology unit 27.

As shown in the example of FIG. 10, the vector-based synthesis unit 27 may include a linear invertible transform (LIT) unit 30, a parameter calculation unit 32, a reorder unit 34, a foreground selection unit 36, an energy compensation unit 38 a bitstream generation unit 42, a soundfield analysis unit 44, a coefficient reduction unit 46, a background (BG) selection unit 48, a spatio-temporal interpolation unit 50, and a quantization unit 52.

The linear invertible transform (LIT) unit 30 receives the HOA coefficients 11 in the form of HOA channels, each channel representative of a block or frame of a coefficient associated with a given order, sub-order of the spherical basis functions (which may be denoted as HOA[k], where k may denote the current frame or block of samples). The matrix of HOA coefficients 11 may have dimensions D: $M\times(N+1)^2$.

That is, the LIT unit 30 may represent a unit configured to perform a form of analysis referred to as singular value decomposition. While described with respect to SVD, the techniques described in this disclosure may be performed with respect to any similar transformation or decomposition that provides for sets of linearly uncorrelated, energy compacted output. Also, reference to "sets" in this disclosure is generally intended to refer to non-zero sets unless specifically stated to the contrary and is not intended to refer to the classical mathematical definition of sets that includes the so-called "empty set."

An alternative transformation may comprise a principal component analysis, which is often referred to as "PCA." PCA refers to a mathematical procedure that employs an orthogonal transformation to convert a set of observations of possibly correlated variables into a set of linearly uncorrelated variables referred to as principal components. Linearly uncorrelated variables represent variables that do not have a linear statistical relationship (or dependence) to one another. These principal components may be described as having a small degree of statistical correlation to one another. In any event, the number of so-called principal components is less than or equal to the number of original variables. In some examples, the transformation is defined in such a way that the first principal component has the largest possible variance (or, in other words, accounts for as much of the variability in the data as possible), and each succeeding component in turn has the highest variance possible under the constraint that this successive component be orthogonal to (which may be restated as uncorrelated with) the preceding components. PCA may perform a form of order-reduction, which in terms of the HOA coefficients 11 may result in the compression of the HOA coefficients 11. Depending on the context, PCA may be referred to by a number of different names, such as discrete Karhunen-Loeve transform, the Hotelling transform, proper orthogonal decomposition (POD), and eigenvalue decomposition (EVD) to name a few examples. Properties of such operations that are conducive to the underlying goal of compressing audio data are 'energy compaction' and 'decorrelation' of the multi-channel audio data.

In any event, the LIT unit 30 performs a singular value decomposition (which, again, may be referred to as "SVD") to transform the HOA coefficients 11 into two or more sets of transformed HOA coefficients. These "sets" of transformed HOA coefficients may include vectors of transformed HOA coefficients. In the example of FIG. 10, the LIT unit 30 may perform the SVD with respect to the HOA coefficients 11 to generate a so-called V matrix, an S matrix, and a U matrix. SVD, in linear algebra, may represent a factorization of a y-by-z real or complex matrix X (where X may represent multi-channel audio data, such as the HOA coefficients 11) in the following form:

$$X=USV^*$$

U may represent an y-by-y real or complex unitary matrix, where the y columns of U are commonly known as the left-singular vectors of the multi-channel audio data. S may represent an y-by-z rectangular diagonal matrix with non-negative real numbers on the diagonal, where the diagonal values of S are commonly known as the singular values of the multi-channel audio data. V* (which may denote a conjugate transpose of V) may represent an z-by-z real or complex unitary matrix, where the z columns of V* are commonly known as the right-singular vectors of the multi-channel audio data.

While described in this disclosure as being applied to multi-channel audio data comprising HOA coefficients 11, the techniques may be applied to any form of multi-channel audio data. In this way, the spatial audio encoding device 20 may perform a singular value decomposition with respect to multi-channel audio data representative of at least a portion of soundfield to generate a U matrix representative of left-singular vectors of the multi-channel audio data, an S matrix representative of singular values of the multi-channel audio data and a V matrix representative of right-singular vectors of the multi-channel audio data, and representing the multi-channel audio data as a function of at least a portion of one or more of the U matrix, the S matrix and the V matrix.

In some examples, the V* matrix in the SVD mathematical expression referenced above is denoted as the conjugate transpose of the V matrix to reflect that SVD may be applied to matrices comprising complex numbers. When applied to matrices comprising only real-numbers, the complex conjugate of the V matrix (or, in other words, the V* matrix) may be considered to be the transpose of the V matrix. Below it is assumed, for ease of illustration purposes, that the HOA coefficients 11 comprise real-numbers with the result that the V matrix is output through SVD rather than the V* matrix. Moreover, while denoted as the V matrix in this disclosure, reference to the V matrix should be understood to refer to the transpose of the V matrix where appropriate. While assumed to be the V matrix, the techniques may be applied in a similar fashion to HOA coefficients 11 having complex coefficients, where the output of the SVD is the V* matrix. Accordingly, the techniques should not be limited in this respect to only provide for application of SVD to generate a V matrix, but may include application of SVD to HOA coefficients 11 having complex components to generate a V* matrix.

In any event, the LIT unit 30 may perform a block-wise form of SVD with respect to each block (which may refer to a frame) of higher-order ambisonics (HOA) audio data (where this ambisonics audio data includes blocks or samples of the HOA coefficients 11 or any other form of multi-channel audio data). As noted above, a variable M may be used to denote the length of an audio frame in samples. For example, when an audio frame includes 1024 audio samples, M equals 1024. Although described with respect to this typical value for M, the techniques of this disclosure should not be limited to this typical value for M. The LIT unit 30 may therefore perform a block-wise SVD with respect to a block the HOA coefficients 11 having M-by-$(N+1)^2$ HOA coefficients, where N, again, denotes the order of the HOA audio data. The LIT unit 30 may generate, through performing this SVD, a V matrix, an S matrix, and a U matrix, where each of matrixes may represent the respective V, S and U matrixes described above. In this way, the linear invertible transform unit 30 may perform SVD with respect to the HOA coefficients 11 to output US[k] vectors 33 (which may represent a combined version of the S vectors and the U vectors) having dimensions D: $M\times(N+1)^2$, and V[k] vectors 35 having dimensions D: $(N+1)^2\times(N+1)^2$. Individual vector elements in the US[k] matrix may also be termed $X_{PS}(k)$ while individual vectors of the V[k] matrix may also be termed v(k).

An analysis of the U, S and V matrices may reveal that these matrices carry or represent spatial and temporal characteristics of the underlying soundfield represented above by X. Each of the N vectors in U (of length M samples) may represent normalized separated audio signals as a function of time (for the time period represented by M samples), that are orthogonal to each other and that have been decoupled from any spatial characteristics (which may also be referred to as directional information). The spatial characteristics, representing spatial shape and position (r, theta, phi) width may instead be represented by individual $i^{th}$ vectors, $v^{(i)}(k)$, in the V matrix (each of length $(N+1)^2$). Both the vectors in the U matrix and the V matrix are normalized such that their root-mean-square energies are equal to unity. The energy of the audio signals in U are thus represented by the diagonal elements in S. Multiplying U and S to form US[k] (with individual vector elements $X_{PS}(k)$), thus represent the audio signal with true energies. The ability of the SVD decomposition to decouple the audio time-signals (in U), their energies (in S) and their spatial characteristics (in V) may support various aspects of the techniques described in this disclosure. Further, this model of synthesizing the underlying HOA[k] coefficients, X, by a vector multiplication of US[k] and V[k] gives rise the term "vector based synthesis methodology," which is used throughout this document.

Although described as being performed directly with respect to the HOA coefficients 11, the LIT unit 30 may apply the linear invertible transform to derivatives of the HOA coefficients 11. For example, the LIT unit 30 may apply SVD with respect to a power spectral density matrix derived from the HOA coefficients 11. The power spectral density matrix may be denoted as PSD and obtained through matrix multiplication of the transpose of the hoaFrame to the hoaFrame, as outlined in the pseudo-code that follows below. The hoaFrame notation refers to a frame of the HOA coefficients 11.

The LIT unit 30 may, after applying the SVD (svd) to the PSD, may obtain an $S[k]^2$ matrix (S_squared) and a V[k] matrix. The $S[k]^2$ matrix may denote a squared S[k] matrix, whereupon the LIT unit 30 may apply a square root operation to the $S[k]^2$ matrix to obtain the S[k] matrix. The LIT unit 30 may, in some instances, perform quantization with respect to the V[k] matrix to obtain a quantized V[k] matrix (which may be denoted as V[k]' matrix). The LIT unit 30 may obtain the U[k] matrix by first multiplying the S[k] matrix by the quantized V[k]' matrix to obtain an SV[k]' matrix. The LIT unit 30 may next obtain the pseudo-inverse (pinv) of the SV[k]' matrix and then multiply the HOA coefficients 11 by the pseudo-inverse of the SV[k]' matrix to obtain the U[k] matrix. The foregoing may be represented by the following pseud-code:

```
PSD=hoaFrame'*hoaFrame;
[V, S_squared]=svd(PSD,'econ');
S=sqrt(S_squared);
U=hoaFrame*pinv(S*V');
```

By performing SVD with respect to the power spectral density (PSD) of the HOA coefficients rather than the coefficients themselves, the LIT unit 30 may potentially reduce the computational complexity of performing the SVD in terms of one or more of processor cycles and storage space, while achieving the same source audio encoding efficiency as if the SVD were applied directly to the HOA coefficients. That is, the above described PSD-type SVD may be potentially less computational demanding because the SVD is done on an F*F matrix (with F the number of HOA coefficients). Compared to a M*F matrix with M is the framelength, i.e., 1024 or more samples. The complexity of an SVD may now, through application to the PSD rather than the HOA coefficients 11, be around O(L^3) compared to O(M*L^2) when applied to the HOA coefficients 11 (where O(*) denotes the big-O notation of computation complexity common to the computer-science arts).

The parameter calculation unit 32 represents unit configured to calculate various parameters, such as a correlation parameter (R), directional properties parameters (θ, φ, r), and an energy property (e). Each of these parameters for the current frame may be denoted as R[k], θ[k], φ[k], r[k] and e[k]. The parameter calculation unit 32 may perform an energy analysis and/or correlation (or so-called cross-correlation) with respect to the US[k] vectors 33 to identify these parameters. The parameter calculation unit 32 may also determine these parameters for the previous frame, where the previous frame parameters may be denoted R[k−1], θ[k−1], φ[k−1], r[k−1] and e[k−1], based on the previous frame of US[k−1] vector and V[k−1] vectors. The parameter calculation unit 32 may output the current parameters 37 and the previous parameters 39 to reorder unit 34.

That is, the parameter calculation unit 32 may perform an energy analysis with respect to each of the L first US[k] vectors 33 corresponding to a first time and each of the second US[k−1] vectors 33 corresponding to a second time, computing a root mean squared energy for at least a portion of (but often the entire) first audio frame and a portion of (but often the entire) second audio frame and thereby generate 2L energies, one for each of the L first US[k]

vectors 33 of the first audio frame and one for each of the second US[k−1] vectors 33 of the second audio frame.

In other examples, the parameter calculation unit 32 may perform a cross-correlation between some portion of (if not the entire) set of samples for each of the first US[k] vectors 33 and each of the second US[k−1] vectors 33. Cross-correlation may refer to cross-correlation as understood in the signal processing arts. In other words, cross-correlation may refer to a measure of similarity between two waveforms (which in this case is defined as a discrete set of M samples) as a function of a time-lag applied to one of them. In some examples, to perform cross-correlation, the parameter calculation unit 32 compares the last L samples of each the first US[k] vectors 27, turn-wise, to the first L samples of each of the remaining ones of the second US[k−1] vectors 33 to determine a correlation parameter. As used herein, a "turn-wise" operation refers to an element by element operation made with respect to a first set of elements and a second set of elements, where the operation draws one element from each of the first and second sets of elements "in-turn" according to an ordering of the sets.

The parameter calculation unit 32 may also analyze the V[k] and/or V[k−1] vectors 35 to determine directional property parameters. These directional property parameters may provide an indication of movement and location of the audio object represented by the corresponding US[k] and/or US[k−1] vectors 33. The parameter calculation unit 32 may provide any combination of the foregoing current parameters 37 (determined with respect to the US[k] vectors 33 and/or the V[k] vectors 35) and any combination of the previous parameters 39 (determined with respect to the US[k−1] vectors 33 and/or the V[k−1] vectors 35) to the reorder unit 34.

The SVD decomposition does not guarantee that the audio signal/object represented by the p-th vector in US[k−1] vectors 33, which may be denoted as the US[k−1][p] vector (or, alternatively, as $X_{PS}^{(p)}(k-1)$), will be the same audio signal/object (progressed in time) represented by the p-th vector in the US[k] vectors 33, which may also be denoted as US[k][p] vectors 33 (or, alternatively as $X_{PS}^{(p)}(k)$). The parameters calculated by the parameter calculation unit 32 may be used by the reorder unit 34 to re-order the audio objects to represent their natural evaluation or continuity over time.

That is, the reorder unit 34 may then compare each of the parameters 37 from the first US[k] vectors 33 turn-wise against each of the parameters 39 for the second US[k−1] vectors 33. The reorder unit 34 may reorder (using, as one example, a Hungarian algorithm) the various vectors within the US[k] matrix 33 and the V[k] matrix 35 based on the current parameters 37 and the previous parameters 39 to output a reordered US[k] matrix 33' (which may be denoted mathematically as US[k]) and a reordered V[k] matrix 35' (which may be denoted mathematically as V[k]) to a foreground sound (or predominant sound—PS) selection unit 36 ("foreground selection unit 36") and an energy compensation unit 38.

In other words, the reorder unit 34 may represent a unit configured to reorder the vectors within the US[k] matrix 33 to generate reordered US[k] matrix 33'. The reorder unit 34 may reorder the US[k] matrix 33 because the order of the US[k] vectors 33 (where, again, each vector of the US[k] vectors 33, which again may alternatively be denoted as $X_{PS}^{(p)}(k)$, may represent one or more distinct (or, in other words, predominant) mono-audio object present in the soundfield) may vary from portions of the audio data. That is, given that the audio encoding device 12, in some examples, operates on these portions of the audio data generally referred to as audio frames, the position of vectors corresponding to these distinct mono-audio objects as represented in the US[k] matrix 33 as derived, may vary from audio frame-to-audio frame due to application of SVD to the frames and the varying saliency of each audio object form frame-to-frame.

Passing vectors within the US[k] matrix 33 directly to the mezzanine format unit 40 without reordering the vectors within the US[k] matrix 33 from audio frame-to audio frame may reduce the extent of the compression achievable for some compression schemes, such as legacy compression schemes that perform better when mono-audio objects are continuous (channel-wise, which is defined in this example by the positional order of the vectors within the US[k] matrix 33 relative to one another) across audio frames. Moreover, when not reordered, the encoding of the vectors within the US[k] matrix 33 may reduce the quality of the audio data when decoded. For example, AAC encoders may more efficiently compress the reordered one or more vectors within the US[k] matrix 33' from frame-to-frame in comparison to the compression achieved when directly encoding the vectors within the US[k] matrix 33 from frame-to-frame. While described above with respect to AAC encoders, the techniques may be performed with respect to any encoder that provides better compression when mono-audio objects are specified across frames in a specific order or position (channel-wise).

Various aspects of the techniques may, in this way, enable audio encoding device 12 to reorder one or more vectors (e.g., the vectors within the US[k] matrix 33 to generate reordered one or more vectors within the reordered US[k] matrix 33' and thereby facilitate compression of the vectors within the US[k] matrix 33 by a legacy audio encoder, such as the psychoacoustic audio coder).

For example, the reorder unit 34 may reorder one or more vectors within the US[k] matrix 33 from a first audio frame subsequent in time to the second frame to which one or more second vectors within the US[k−1] matrix 33 correspond based on the current parameters 37 and previous parameters 39. While described in the context of a first audio frame being subsequent in time to the second audio frame, the first audio frame may precede in time the second audio frame. Accordingly, the techniques should not be limited to the example described in this disclosure.

To illustrate consider the following Table 3 where each of the p vectors within the US[k] matrix 33 is denoted as US[k][p], where k denotes whether the corresponding vector is from the k-th frame or the previous (k−1)-th frame and p denotes the row of the vector relative to vectors of the same audio frame (where the US[k] matrix has $(N+1)^2$ such vectors). As noted above, assuming N is determined to be one, p may denote vectors one (1) through (4).

TABLE 3

| Energy Under Consideration | Compared To |
|---|---|
| US[k-1][1] | US[k][1], US[k][2], US[k][3], US[k][4] |
| US[k-1][2] | US[k][1], US[k][2], US[k][3], US[k][4] |
| US[k-1][3] | US[k][1], US[k][2], US[k][3], US[k][4] |
| US[k-1][4] | US[k][1], US[k][2], US[k][3], US[k][4] |

In the above Table 3, the reorder unit 34 compares the energy computed for US[k−1][1] to the energy computed for each of US[k][1], US[k][2], US[k][3], US[k][4], the energy computed for US[k−1][2] to the energy computed for each of US[k][1], US[k][2], US[k][3], US[k][4], etc. The reorder unit 34 may then discard one or more of the second US[k−1] vectors 33 of the second preceding audio frame (time-wise). To illustrate, consider the following Table 4 showing the remaining second US[k−1] vectors 33:

TABLE 4

| Vector Under Consideration | Remaining Under Consideration |
|---|---|
| US[k-1][1] | US[k][1], US[k][2] |
| US[k-1][2] | US[k][1], US[k][2] |
| US[k-1][3] | US[k][3], US[k][4] |
| US[k-1][4] | US[k][3], US[k][4] |

In the above Table 4, the reorder unit 34 may determine, based on the energy comparison that the energy computed for US[k−1][1] is similar to the energy computed for each of US[k][1] and US[k][2], the energy computed for US[k−1][2] is similar to the energy computed for each of US[k][1] and US[k][2], the energy computed for US[k−1][3] is similar to the energy computed for each of US[k][3] and US[k][4], and the energy computed for US[k−1][4] is similar to the energy computed for each of US[k] [3] and US[k][4]. In some examples, the reorder unit 34 may perform further energy analysis to identify a similarity between each of the first vectors of the US[k] matrix 33 and each of the second vectors of the US[k−1] matrix 33.

In other examples, the reorder unit 32 may reorder the vectors based on the current parameters 37 and the previous parameters 39 relating to cross-correlation. In these examples, referring back to Table 4 above, the reorder unit 34 may determine the following exemplary correlation expressed in Table 5 based on these cross-correlation parameters:

TABLE 5

| Vector Under Consideration | Correlates To |
|---|---|
| US[k-1][1] | US[k][2] |
| US[k-1][2] | US[k][1] |
| US[k-1][3] | US[k][3] |
| US[k-1][4] | US[k][4] |

From the above Table 5, the reorder unit 34 determines, as one example, that US[k−1][1] vector correlates to the differently positioned US[k][2] vector, the US[k−1][2] vector correlates to the differently positioned US[k][1] vector, the US[k−1][3] vector correlates to the similarly positioned US[k][3] vector, and the US[k−1][4] vector correlates to the similarly positioned US[k][4] vector. In other words, the reorder unit 34 determines what may be referred to as reorder information describing how to reorder the first vectors of the US[k] matrix 33 such that the US[k][2] vector is repositioned in the first row of the first vectors of the US[k] matrix 33 and the US[k][1] vector is repositioned in the second row of the first US[k] vectors 33. The reorder unit 34 may then reorder the first vectors of the US[k] matrix 33 based on this reorder information to generate the reordered US[k] matrix 33'.

Figure 11:
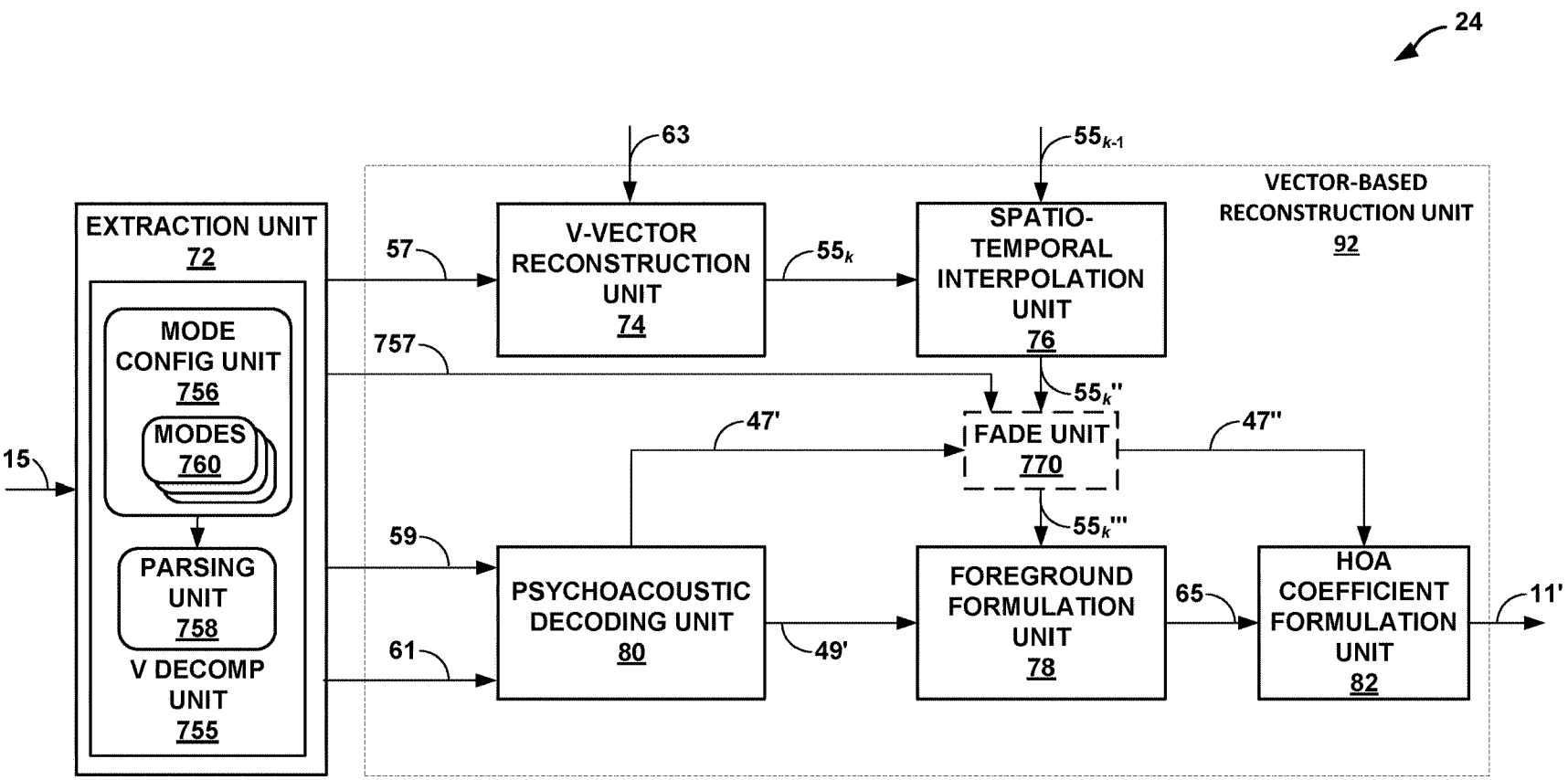
FIG. 11 is a block diagram illustrating the audio decoding device of FIG. 9A in more detail.

Additionally, the reorder unit 34 may, although not shown in the example of FIG. 10, provide this reorder information to the bitstream generation device 42, which may generate the bitstream 21 to include this reorder information so that the audio decoding device, such as the audio decoding device 24 shown in the example of FIGS. 4 and 11, may determine how to reorder the reordered vectors of the US[k] matrix 33' so as to recover the vectors of the US[k] matrix 33.

While described above as performing a two-step process involving an analysis based first an energy-specific parameters and then cross-correlation parameters, the reorder unit 32 may only perform this analysis only with respect to energy parameters to determine the reorder information, perform this analysis only with respect to cross-correlation parameters to determine the reorder information, or perform the analysis with respect to both the energy parameters and the cross-correlation parameters in the manner described above. Additionally, the techniques may employ other types of processes for determining correlation that do not involve performing one or both of an energy comparison and/or a cross-correlation. Accordingly, the techniques should not be limited in this respect to the examples set forth above. Moreover, other parameters obtained from the parameter calculation unit 32 (such as the spatial position parameters derived from the V vectors or correlation of the vectors in the V[k] and V[k−1]) can also be used (either concurrently/jointly or sequentially) with energy and cross-correlation parameters obtained from US[k] and US[k−1] to determine the correct ordering of the vectors in US.

As one example of using correlation of the vectors in the V matrix, the parameter calculation unit 34 may determine that the vectors of the V[k] matrix 35 are correlated as specified in the following Table 6:

TABLE 6

| Vector Under Consideration | Correlates To |
|---|---|
| V[k-1][1] | V[k][2] |
| V[k-1][2] | V[k][1] |
| V[k-1][3] | V[k][3] |
| V[k-1][4] | V[k][4] |

From the above Table 6, the reorder unit 34 determines, as one example, that V[k−1][1] vector correlates to the differently positioned V[k][2] vector, the V[k−1][2] vector correlates to the differently positioned V[k][1] vector, the V[k−1][3] vector correlates to the similarly positioned V[k][3] vector, and the V[k−1][4] vector correlates to the similarly positioned V[k][4] vector. The reorder unit 34 may output the reordered version of the vectors of the V[k] matrix 35 as a reordered V[k] matrix 35'.

In some examples, the same re-ordering that is applied to the vectors in the US matrix is also applied to the vectors in the V matrix. In other words, any analysis used in reordering the V vectors may be used in conjunction with any analysis used to reorder the US vectors. To illustrate an example in which the reorder information is not solely determined with respect to the energy parameters and/or the cross-correlation parameters with respect to the US[k] vectors 35, the reorder unit 34 may also perform this analysis with respect to the V[k] vectors 35 based on the cross-correlation parameters and the energy parameters in a manner similar to that described above with respect to the V[k] vectors 35. Moreover, while the US[k] vectors 33 do not have any directional properties, the V[k] vectors 35 may provide information relating to the directionality of the corresponding US[k] vectors 33. In this sense, the reorder unit 34 may identify correlations between V[k] vectors 35 and V[k−1] vectors 35 based on an analysis of corresponding directional properties parameters. That is, in some examples, audio object move within a soundfield in a continuous manner when moving or that stays in a relatively stable location. As such, the reorder unit 34 may identify those vectors of the V[k] matrix 35 and the V[k−1] matrix 35 that exhibit some known physically realistic motion or that stay stationary within the soundfield as correlated, reordering the US[k] vectors 33 and the V[k] vectors 35 based on this directional properties correlation. In any event, the reorder unit 34 may output the reordered US[k] vectors 33' and the reordered V[k] vectors 35' to the foreground selection unit 36.

Additionally, the techniques may employ other types of processes for determining correct order that do not involve performing one or both of an energy comparison and/or a cross-correlation. Accordingly, the techniques should not be limited in this respect to the examples set forth above.

Although described above as reordering the vectors of the V matrix to mirror the reordering of the vectors of the US matrix, in certain instances, the V vectors may be reordered differently than the US vectors, where separate syntax elements may be generated to indicate the reordering of the US vectors and the reordering of the V vectors. In some instances, the V vectors may not be reordered and only the US vectors may be reordered given that the V vectors may not be psychoacoustically encoded.

An embodiment where the re-ordering of the vectors of the V matrix and the vectors of US matrix are different are when the intention is to swap audio objects in space—i.e. move them away from the original recorded position (when the underlying soundfield was a natural recording) or the artistically intended position (when the underlying soundfield is an artificial mix of objects). As an example, suppose that there are two audio sources A and B, A may be the sound of a cat "meow" emanating from the "left" part of soundfield and B may be the sound of a dog "woof" emanating from the "right" part of the soundfield. When the re-ordering of the V and US are different, the position of the two sound sources is swapped. After swapping A (the "meow") emanates from the right part of the soundfield, and B ("the woof") emanates from the left part of the soundfield.

The soundfield analysis unit 44 may represent a unit configured to perform a soundfield analysis with respect to the HOA coefficients 11 so as to potentially achieve a target bitrate 41. The soundfield analysis unit 44 may, based on this analysis and/or on a received target bitrate 41, determine the total number of psychoacoustic coder instantiations (which may be a function of the total number of ambient or background channels ($BG_{TOT}$) and the number of foreground channels or, in other words, predominant channels. The total number of psychoacoustic coder instantiations can be denoted as numHOATransportChannels. The soundfield analysis unit 44 may also determine, again to potentially achieve the target bitrate 41, the total number of foreground channels (nFG) 45, the minimum order of the background (or, in other words, ambient) soundfield ($N_{BG}$ or, alternatively, MinAmbHoaOrder), the corresponding number of actual channels representative of the minimum order of background soundfield (nBGa=(MinAmbHoaOrder+1)$^2$), and indices (i) of additional BG HOA channels to send (which may collectively be denoted as background channel information 43 in the example of FIG. 10). The background channel information 42 may also be referred to as ambient channel information 43. Each of the channels that remains from numHOATransportChannels—nBGa, may either be an "additional background/ambient channel", an "active vector based predominant channel", an "active directional based predominant signal" or "completely inactive". In one embodiment, these channel types may be indicated (as a "ChannelType") syntax element by two bits (e.g. 00: additional background channel; 01: vector based predominant signal; 10: inactive signal; 11: directional based signal). The total number of background or ambient signals, nBGa, may be given by (MinAmbHoaOrder+1)$^2$+the number of times the index 00 (in the above example) appears as a channel type in the bitstream for that frame.

In any event, the soundfield analysis unit 44 may select the number of background (or, in other words, ambient) channels and the number of foreground (or, in other words, predominant) channels based on the target bitrate 41, selecting more background and/or foreground channels when the target bitrate 41 is relatively higher (e.g., when the target bitrate 41 equals or is greater than 512 Kbps). In one embodiment, the numHOATransportChannels may be set to 8 while the MinAmbHoaOrder may be set to 1 in the header section of the bitstream (which is described in more detail with respect to FIGS. 10-10O(ii)). In this scenario, at every frame, four channels may be dedicated to represent the background or ambient portion of the soundfield while the other 4 channels can, on a frame-by-frame basis vary on the type of channel—e.g., either used as an additional background/ambient channel or a foreground/predominant channel. The foreground/predominant signals can be one of either vector based or directional based signals, as described above.

In some instances, the total number of vector based predominant signals for a frame, may be given by the number of times the ChannelType index is 01, in the bitstream of that frame, in the above example. In the above embodiment, for every additional background/ambient channel (e.g., corresponding to a ChannelType of 00), a corresponding information of which of the possible HOA coefficients (beyond the first four) may be represented in that channel. This information, for fourth order HOA content, may be an index to indicate between 5-25 (the first four 1-4 may be sent all the time when minAmbHoaOrder is set to 1, hence only need to indicate one between 5-25). This information could thus be sent using a 5 bits syntax element (for $4^{th}$ order content), which may be denoted as "CodedAmbCoeffIdx."

In a second embodiment, all of the foreground/predominant signals are vector based signals. In this second embodiment, the total number of foreground/predominant signals may be given by nFG=numHOATransportChannels−[(MinAmbHoaOrder+1)$^2$+the number of times the index 00].

The soundfield analysis unit 44 outputs the background channel information 43 and the HOA coefficients 11 to the background (BG) selection unit 46, the background channel information 43 to coefficient reduction unit 46 and the bitstream generation unit 42, and the nFG 45 to a foreground selection unit 36.

In some examples, the soundfield analysis unit 44 may select, based on an analysis of the vectors of the US[k] matrix 33 and the target bitrate 41, a variable nFG number of these components having the greatest value. In other words, the soundfield analysis unit 44 may determine a value for a variable A (which may be similar or substantially similar to $N_{BG}$), which separates two subspaces, by analyzing the slope of the curve created by the descending diagonal values of the vectors of the S[k] matrix 33, where the large singular values represent foreground or distinct sounds and the low singular values represent background components of the soundfield. That is, the variable A may segment the overall soundfield into a foreground subspace and a background subspace.

In some examples, the soundfield analysis unit 44 may use a first and a second derivative of the singular value curve.

The soundfield analysis unit 44 may also limit the value for the variable A to be between one and five. As another example, the soundfield analysis unit 44 may limit the value of the variable A to be between one and $(N+1)^2$. Alternatively, the soundfield analysis unit 44 may pre-define the value for the variable A, such as to a value of four. In any event, based on the value of A, the soundfield analysis unit 44 determines the total number of foreground channels (nFG) 45, the order of the background soundfield ($N_{BG}$) and the number (nBGa) and the indices (i) of additional BG HOA channels to send.

Furthermore, the soundfield analysis unit 44 may determine the energy of the vectors in the V[k] matrix 35 on a per vector basis. The soundfield analysis unit 44 may determine the energy for each of the vectors in the V[k] matrix 35 and identify those having a high energy as foreground components.

Moreover, the soundfield analysis unit 44 may perform various other analyses with respect to the HOA coefficients 11, including a spatial energy analysis, a spatial masking analysis, a diffusion analysis or other forms of auditory analyses. The soundfield analysis unit 44 may perform the spatial energy analysis through transformation of the HOA coefficients 11 into the spatial domain and identifying areas of high energy representative of directional components of the soundfield that should be preserved. The soundfield analysis unit 44 may perform the perceptual spatial masking analysis in a manner similar to that of the spatial energy analysis, except that the soundfield analysis unit 44 may identify spatial areas that are masked by spatially proximate higher energy sounds. The soundfield analysis unit 44 may then, based on perceptually masked areas, identify fewer foreground components in some instances. The soundfield analysis unit 44 may further perform a diffusion analysis with respect to the HOA coefficients 11 to identify areas of diffuse energy that may represent background components of the soundfield.

The soundfield analysis unit 44 may also represent a unit configured to determine saliency, distinctness or predominance of audio data representing a soundfield, using directionality-based information associated with the audio data. While energy-based determinations may improve rendering of a soundfield decomposed by SVD to identify distinct audio components of the soundfield, energy-based determinations may also cause a device to erroneously identify background audio components as distinct audio components, in cases where the background audio components exhibit a high energy level. That is, a solely energy-based separation of distinct and background audio components may not be robust, as energetic (e.g., louder) background audio components may be incorrectly identified as being distinct audio components. To more robustly distinguish between distinct and background audio components of the soundfield, various aspects of the techniques described in this disclosure may enable the soundfield analysis unit 44 to perform a directionality-based analysis of the HOA coefficients 11 to separate foreground and ambient audio components from decomposed versions of the HOA coefficients 11.

In this respect, the soundfield analysis unit 44 may represent a unit configured or otherwise operable to identify distinct (or foreground) elements from background elements included in one or more of the vectors in the US[k] matrix 33 and the vectors in the V[k] matrix 35. According to some SVD-based techniques, the most energetic components (e.g., the first few vectors of one or more of the US[k] matrix 33 and the V[k] matrix 35 or vectors derived therefrom) may be treated as distinct components. However, the most energetic components (which are represented by vectors) of one or more of the vectors in the US[k] matrix 33 and the vectors in the V[k] matrix 35 may not, in all scenarios, represent the components/signals that are the most directional.

The soundfield analysis unit 44 may implement one or more aspects of the techniques described herein to identify foreground/direct/predominant elements based on the directionality of the vectors of one or more of the vectors in the US[k] matrix 33 and the vectors in the V[k] matrix 35 or vectors derived therefrom. In some examples, the soundfield analysis unit 44 may identify or select as distinct audio components (where the components may also be referred to as "objects"), one or more vectors based on both energy and directionality of the vectors. For instance, the soundfield analysis unit 44 may identify those vectors of one or more of the vectors in the US[k] matrix 33 and the vectors in the V[k] matrix 35 (or vectors derived therefrom) that display both high energy and high directionality (e.g., represented as a directionality quotient) as distinct audio components. As a result, if the soundfield analysis unit 44 determines that a particular vector is relatively less directional when compared to other vectors of one or more of the vectors in the US[k] matrix 33 and the vectors in the V[k] matrix 35 (or vectors derived therefrom), then regardless of the energy level associated with the particular vector, the soundfield analysis unit 44 may determine that the particular vector represents background (or ambient) audio components of the soundfield represented by the HOA coefficients 11.

In some examples, the soundfield analysis unit 44 may identify distinct audio objects (which, as noted above, may also be referred to as "components") based on directionality, by performing the following operations. The soundfield analysis unit 44 may multiply (e.g., using one or more matrix multiplication processes) vectors in the S[k] matrix (which may be derived from the US[k] vectors 33 or, although not shown in the example of FIG. 10 separately output by the LIT unit 30) by the vectors in the V[k] matrix 35. By multiplying the V[k] matrix 35 and the S[k] vectors, the soundfield analysis unit 44 may obtain VS[k] matrix. Additionally, the soundfield analysis unit 44 may square (i.e., exponentiate by a power of two) at least some of the entries of each of the vectors in the VS[k] matrix. In some instances, the soundfield analysis unit 44 may sum those squared entries of each vector that are associated with an order greater than 1.

As one example, if each vector of the VS[k] matrix, which includes 25 entries, the soundfield analysis unit 44 may, with respect to each vector, square the entries of each vector beginning at the fifth entry and ending at the twenty-fifth entry, summing the squared entries to determine a directionality quotient (or a directionality indicator). Each summing operation may result in a directionality quotient for a corresponding vector. In this example, the soundfield analysis unit 44 may determine that those entries of each row that are associated with an order less than or equal to 1, namely, the first through fourth entries, are more generally directed to the amount of energy and less to the directionality of those entries. That is, the lower order ambisonics associated with an order of zero or one correspond to spherical basis functions that, as illustrated in FIG. 1 and FIG. 2, do not provide much in terms of the direction of the pressure wave, but rather provide some volume (which is representative of energy).

The operations described in the example above may also be expressed according to the following pseudo-code. The pseudo-code below includes annotations, in the form of comment statements that are included within consecutive instances of the character strings "/*" and "*/" (without quotes).

```
[U,S,V]=svd(audioframe,'ecom');
VS=V*S;
/* The next line is directed to analyzing each row independently, and summing the values in the first (as one example) row from the fifth entry to the twenty-fifth entry to determine a directionality quotient or directionality metric for a corresponding vector. Square the entries before summing. The entries in each row that are associated with an order greater than 1 are associated with higher order ambisonics, and are thus more likely to be directional. */
sumVS=sum(VS(5:end,:).^2,1);
/* The next line is directed to sorting the sum of squares for the generated VS matrix, and selecting a set of the largest values (e.g., three or four of the largest values) */
[~,idxVS]=sort(sumVS,'descend');
U=U(:,idxVS);
V=V(:,idxVS);
S=S(idxVS,idxVS);
```

In other words, according to the above pseudo-code, the soundfield analysis unit 44 may select entries of each vector of the VS[k] matrix decomposed from those of the HOA coefficients 11 corresponding to a spherical basis function having an order greater than one. The soundfield analysis unit 44 may then square these entries for each vector of the VS[k] matrix, summing the squared entries to identify, compute or otherwise determine a directionality metric or quotient for each vector of the VS[k] matrix. Next, the soundfield analysis unit 44 may sort the vectors of the VS[k] matrix based on the respective directionality metrics of each of the vectors. The soundfield analysis unit 44 may sort these vectors in a descending order of directionality metrics, such that those vectors with the highest corresponding directionality are first and those vectors with the lowest corresponding directionality are last. The soundfield analysis unit 44 may then select the a non-zero subset of the vectors having the highest relative directionality metric.

The soundfield analysis unit 44 may perform any combination of the foregoing analyses to determine the total number of psychoacoustic coder instantiations (which may be a function of the total number of ambient or background channels ($BG_{TOT}$) and the number of foreground channels. The soundfield analysis unit 44 may, based on any combination of the foregoing analyses, determine the total number of foreground channels (nFG) 45, the order of the background soundfield ($N_{BG}$) and the number (nBGa) and indices (i) of additional BG HOA channels to send (which may collectively be denoted as background channel information 43 in the example of FIG. 10).

In some examples, the soundfield analysis unit 44 may perform this analysis every M-samples, which may be restated as on a frame-by-frame basis. In this respect, the value for A may vary from frame to frame. An instance of a bitstream where the decision is made every M-samples is shown in FIGS. 10-10O(ii). In other examples, the soundfield analysis unit 44 may perform this analysis more than once per frame, analyzing two or more portions of the frame. Accordingly, the techniques should not be limited in this respect to the examples described in this disclosure.

The background selection unit 48 may represent a unit configured to determine background or ambient HOA coefficients 47 based on the background channel information (e.g., the background soundfield ($N_{BG}$) and the number (nBGa) and the indices (i) of additional BG HOA channels to send). For example, when $N_{BG}$ equals one, the background selection unit 48 may select the HOA coefficients 11 for each sample of the audio frame having an order equal to or less than one. The background selection unit 48 may, in this example, then select the HOA coefficients 11 having an index identified by one of the indices (i) as additional BG HOA coefficients, where the nBGa is provided to the bitstream generation unit 42 to be specified in the bitstream 21 so as to enable the audio decoding device, such as the audio decoding device 24 shown in the example of FIG. 9A, to parse the BG HOA coefficients 47 from the bitstream 21. The background selection unit 48 may then output the ambient HOA coefficients 47 to the energy compensation unit 38. The ambient HOA coefficients 47 may have dimensions D: $M\times[(N_{BG}+1)^2+nBGa]$.

The foreground selection unit 36 may represent a unit configured to select those of the reordered US[k] matrix 33' and the reordered V[k] matrix 35' that represent foreground or distinct components of the soundfield based on nFG 45 (which may represent a one or more indices identifying these foreground vectors). The foreground selection unit 36 may output nFG signals 49 (which may be denoted as a reordered $US[k]_{1,\ldots,nFG}$ 49, $FG_{1,\ldots,nfG}[k]$ 49, or $X_{PS}^{(1\ldots nFG)}(k)$ 49) to the mezzanine format unit 40, where the nFG signals 49 may have dimensions D: M×nFG and each represent mono-audio objects. The foreground selection unit 36 may also output the reordered V[k] matrix 35' (or $v^{(1\ldots nFG)}(k)$ 35') corresponding to foreground components of the soundfield to the spatio-temporal interpolation unit 50, where those of the reordered V[k] matrix 35' corresponding to the foreground components may be denoted as foreground V[k] matrix $\mathbf{51}_k$ (which may be mathematically denoted as $\overline{V}_{1,\ldots,nFG}[k]$) having dimensions D: $(N+1)^2\times nFG$.

The energy compensation unit 38 may represent a unit configured to perform energy compensation with respect to the ambient HOA coefficients 47 to compensate for energy loss due to removal of various ones of the HOA channels by the background selection unit 48. The energy compensation unit 38 may perform an energy analysis with respect to one or more of the reordered US[k] matrix 33', the reordered V[k] matrix 35', the nFG signals 49, the foreground V[k] vectors $\mathbf{51}_k$ and the ambient HOA coefficients 47 and then perform energy compensation based on this energy analysis to generate energy compensated ambient HOA coefficients 47'. The energy compensation unit 38 may output the energy compensated ambient HOA coefficients 47' to the mezzanine format unit 40.

Effectively, the energy compensation unit 38 may be used to compensate for possible reductions in the overall energy of the background sound components of the soundfield caused by reducing the order of the ambient components of the soundfield described by the HOA coefficients 11 to generate the order-reduced ambient HOA coefficients 47 (which, in some examples, have an order less than N in terms of only included coefficients corresponding to spherical basis functions having the following orders/sub-orders: $[(N_{BG}+1)^2+nBGa]$). In some examples, the energy compensation unit 38 compensates for this loss of energy by determining a compensation gain in the form of amplification values to apply to each of the $[(N_{BG}+1)^2+nBGa]$ columns of the ambient HOA coefficients 47 in order to increase the root mean-squared (RMS) energy of the ambient HOA coefficients 47 to equal or at least more nearly approximate the RMS of the HOA coefficients 11 (as determined through aggregate energy analysis of one or more of the reordered US[k] matrix 33', the reordered V[k] matrix 35', the nFG signals 49, the foreground V[k] vectors $\mathbf{51}_k$ and the order-reduced ambient HOA coefficients 47), prior to outputting ambient HOA coefficients 47 to the mezzanine format unit 40.

In some instances, the energy compensation unit 38 may identify the RMS for each row and/or column of on one or more of the reordered US[k] matrix 33' and the reordered V[k] matrix 35'. The energy compensation unit 38 may also identify the RMS for each row and/or column of one or more of the selected foreground channels, which may include the nFG signals 49 and the foreground V[k] vectors $\mathbf{51}_k$, and the order-reduced ambient HOA coefficients 47. The RMS for each row and/or column of the one or more of the reordered US[k] matrix 33' and the reordered V[k] matrix 35' may be stored to a vector denoted $RMS_{FULL}$, while the RMS for each row and/or column of one or more of the nFG signals 49, the foreground V[k] vectors $\mathbf{51}_k$, and the order-reduced ambient HOA coefficients 47 may be stored to a vector denoted $RMS_{REDUCED}$. The energy compensation unit 38 may then compute an amplification value vector Z, in accordance with the following equation: $Z=RMS_{FULL}/RMS_{REDUCED}$. The energy compensation unit 38 may then apply this amplification value vector Z or various portions thereof to one or more of the nFG signals 49, the foreground V[k] vectors $\mathbf{51}_k$, and the order-reduced ambient HOA coefficients 47. In some instances, the amplification value vector Z is applied to only the order-reduced ambient HOA coefficients 47 per the following equation $HOA_{BG\text{-}RED'}=HOA_{BG\text{-}RED}Z^T$, where $HOA_{BG\text{-}RED}$ denotes the order-reduced ambient HOA coefficients 47, $HOA_{BG\text{-}RED'}$ denotes the energy compensated, reduced ambient HOA coefficients 47' and $Z^T$ denotes the transpose of the Z vector.

In some examples, to determine each RMS of respective rows and/or columns of one or more of the reordered US[k] matrix 33', the reordered V[k] matrix 35', the nFG signals 49, the foreground V[k] vectors $\mathbf{51}_k$, and the order-reduced ambient HOA coefficients 47, the energy compensation unit 38 may first apply a reference spherical harmonics coefficients (SHC) renderer to the columns. Application of the reference SHC renderer by the energy compensation unit 38 allows for determination of RMS in the SHC domain to determine the energy of the overall soundfield described by each row and/or column of the frame represented by rows and/or columns of one or more of the reordered US[k] matrix 33', the reordered V[k] matrix 35', the nFG signals 49, the foreground V[k] vectors $\mathbf{51}_k$, and the order-reduced ambient HOA coefficients 47, as described in more detail below.

The spatio-temporal interpolation unit 50 may represent a unit configured to receive the foreground V[k] vectors $\mathbf{51}_k$ for the k'th frame and the foreground V[k−1] vectors $\mathbf{51}_{k-1}$ for the previous frame (hence the k−1 notation) and perform spatio-temporal interpolation to generate interpolated foreground V[k] vectors. The spatio-temporal interpolation unit 50 may recombine the nFG signals 49 with the foreground V[k] vectors $\mathbf{51}_k$ to recover reordered foreground HOA coefficients. The spatio-temporal interpolation unit 50 may then divide the reordered foreground HOA coefficients by the interpolated V[k] vectors to generate interpolated nFG signals 49'. The spatio-temporal interpolation unit 50 may also output those of the foreground V[k] vectors $\mathbf{51}_k$ that were used to generate the interpolated foreground V[k] vectors so that an audio decoding device, such as the audio decoding device 24, may generate the interpolated foreground V[k] vectors and thereby recover the foreground V[k] vectors $\mathbf{51}_k$. Those of the foreground V[k] vectors $\mathbf{51}_k$ used to generate the interpolated foreground V[k] vectors are denoted as the remaining foreground V[k] vectors 53. In order to ensure that the same V[k] and V[k−1] are used at the encoder and decoder (to create the interpolated vectors V[k]) quantized/dequantized versions of these may be used at the encoder and decoder.

In this respect, the spatio-temporal interpolation unit 50 may represent a unit that interpolates a first portion of a first audio frame from some other portions of the first audio frame and a second temporally subsequent or preceding audio frame. In some examples, the portions may be denoted as sub-frames, where interpolation as performed with respect to sub-frames is described in more detail below with respect to FIGS. 45-46E. In other examples, the spatio-temporal interpolation unit 50 may operate with respect to some last number of samples of the previous frame and some first number of samples of the subsequent frame. The spatio-temporal interpolation unit 50 may, in performing this interpolation, reduce the number of samples of the foreground V[k] vectors $\mathbf{51}_k$ that are required to be specified in the bitstream 21, as only those of the foreground V[k] vectors $\mathbf{51}_k$ that are used to generate the interpolated V[k] vectors represent a subset of the foreground V[k] vectors $\mathbf{51}_k$. That is, in order to potentially make compression of the HOA coefficients 11 more efficient (by reducing the number of the foreground V[k] vectors $\mathbf{51}_k$ that are specified in the bitstream 21), various aspects of the techniques described in this disclosure may provide for interpolation of one or more portions of the first audio frame, where each of the portions may represent decomposed versions of the HOA coefficients 11.

The spatio-temporal interpolation may result in a number of benefits. First, the nFG signals 49 may not be continuous from frame to frame due to the block-wise nature in which the SVD or other LIT is performed. In other words, given that the LIT unit 30 applies the SVD on a frame-by-frame basis, certain discontinuities may exist in the resulting transformed HOA coefficients as evidence for example by the unordered nature of the US[k] matrix 33 and V[k] matrix 35. By performing this interpolation, the discontinuity may be reduced given that interpolation may have a smoothing effect that potentially reduces any artifacts introduced due to frame boundaries (or, in other words, segmentation of the HOA coefficients 11 into frames). Using the foreground V[k] vectors $\mathbf{51}_k$ to perform this interpolation and then generating the interpolated nFG signals 49' based on the interpolated foreground V[k] vectors $\mathbf{51}_k$ from the recovered reordered HOA coefficients may smooth at least some effects due to the frame-by-frame operation as well as due to reordering the nFG signals 49.

In operation, the spatio-temporal interpolation unit 50 may interpolate one or more sub-frames of a first audio frame from a first decomposition, e.g., foreground V[k] vectors $\mathbf{51}_k$, of a portion of a first plurality of the HOA coefficients 11 included in the first frame and a second decomposition, e.g., foreground V[k] vectors $\mathbf{51}_{k-1}$, of a portion of a second plurality of the HOA coefficients 11 included in a second frame to generate decomposed interpolated spherical harmonic coefficients for the one or more sub-frames.

In some examples, the first decomposition comprises the first foreground V[k] vectors $\mathbf{51}_k$ representative of right-singular vectors of the portion of the HOA coefficients 11. Likewise, in some examples, the second decomposition comprises the second foreground V[k] vectors $\mathbf{51}_k$ representative of right-singular vectors of the portion of the HOA coefficients 11.

In other words, spherical harmonics-based 3D audio may be a parametric representation of the 3D pressure field in terms of orthogonal basis functions on a sphere. The higher the order N of the representation, the potentially higher the spatial resolution, and often the larger the number of spherical harmonics (SH) coefficients (for a total of $(N+1)^2$ coefficients). For many applications, a bandwidth compression of the coefficients may be required for being able to transmit and store the coefficients efficiently. This techniques directed in this disclosure may provide a frame-based, dimensionality reduction process using Singular Value Decomposition (SVD). The SVD analysis may decompose each frame of coefficients into three matrices U, S and V. In some examples, the techniques may handle some of the vectors in US[k] matrix as foreground components of the underlying soundfield. However, when handled in this manner, these vectors (in U S[k] matrix) are discontinuous from frame to frame—even though they represent the same distinct audio component. These discontinuities may lead to significant artifacts when the components are fed through transform-audio-coders.

The techniques described in this disclosure may address this discontinuity. That is, the techniques may be based on the observation that the V matrix can be interpreted as orthogonal spatial axes in the Spherical Harmonics domain. The U[k] matrix may represent a projection of the Spherical Harmonics (HOA) data in terms of those basis functions, where the discontinuity can be attributed to orthogonal spatial axis (V[k]) that change every frame—and are therefore discontinuous themselves. This is unlike similar decomposition, such as the Fourier Transform, where the basis functions are, in some examples, constant from frame to frame. In these terms, the SVD may be considered of as a matching pursuit algorithm. The techniques described in this disclosure may enable the spatio-temporal interpolation unit 50 to maintain the continuity between the basis functions (V[k]) from frame to frame—by interpolating between them.

As noted above, the interpolation may be performed with respect to samples. This case is generalized in the above description when the subframes comprise a single set of samples. In both the case of interpolation over samples and over subframes, the interpolation operation may take the form of the following equation:

$$\overline{v(l)}=w(l)v(k)+(1-w(l))v(k-1).$$

In this above equation, the interpolation may be performed with respect to the single V-vector v(k) from the single V-vector v(k−1), which in one embodiment could represent V-vectors from adjacent frames k and k−1. In the above equation, l, represents the resolution over which the interpolation is being carried out, where l may indicate a integer sample and l=1, . . . T (where T is the length of samples over which the interpolation is being carried out and over which the output interpolated vectors, v(l) are required and also indicates that the output of this process produces l of these vectors). Alternatively, l could indicate subframes consisting of multiple samples. When, for example, a frame is divided into four subframes, l may comprise values of 1, 2, 3 and 4, for each one of the subframes. The value of l may be signaled as a field termed "CodedSpatialInterpolationTime" through a bitstream—so that the interpolation operation may be replicated in the decoder. The w(l) may comprise values of the interpolation weights. When the interpolation is linear, w(l) may vary linearly and monotonically between 0 and 1, as a function of l. In other instances, w(l) may vary between 0 and 1 in a non-linear but monotonic fashion (such as a quarter cycle of a raised cosine) as a function of l. The function, w(l), may be indexed between a few different possibilities of functions and signaled in the bitstream as a field termed "SpatialInterpolationMethod" such that the identical interpolation operation may be replicated by the decoder. When w(l) is a value close to 0, the output, v(l) may be highly weighted or influenced by v(k−1). Whereas when w(l) is a value close to 1, it ensures that the output, $\overline{v(l)}$, is highly weighted or influenced by v(k−1).

The coefficient reduction unit 46 may represent a unit configured to perform coefficient reduction with respect to the remaining foreground V[k] vectors 53 based on the background channel information 43 to output reduced foreground V[k] vectors 55 to the quantization unit 52. The reduced foreground V[k] vectors 55 may have dimensions D: $[(N+1)^2-(N_{BG}+1)^2-nBGa]\times nFG$.

The coefficient reduction unit 46 may, in this respect, represent a unit configured to reduce the number of coefficients of the remaining foreground V[k] vectors 53. In other words, coefficient reduction unit 46 may represent a unit configured to eliminate those coefficients of the foreground V[k] vectors (that form the remaining foreground V[k] vectors 53) having little to no directional information. As described above, in some examples, those coefficients of the distinct or, in other words, foreground V[k] vectors corresponding to a first and zero order basis functions (which may be denoted as $N_{BG}$) provide little directional information and therefore can be removed from the foreground V vectors (through a process that may be referred to as "coefficient reduction"). In this example, greater flexibility may be provided to not only identify these coefficients that correspond $N_{BG}$ but to identify additional HOA channels (which may be denoted by the variable TotalOfAddAmbHOAChan) from the set of $[(N_{BG}+1)^2+1, (N+1)^2]$. The soundfield analysis unit 44 may analyze the HOA coefficients 11 to determine $BG_{TOT}$, which may identify not only the $(N_{BG}+1)^2$ but the TotalOfAddAmbHOAChan, which may collectively be referred to as the background channel information 43. The coefficient reduction unit 46 may then remove those coefficients corresponding to the $(N_{BG}+1)^2$ and the TotalOfAddAmbHOAChan from the remaining foreground V[k] vectors 53 to generate a smaller dimensional V[k] matrix 55 of size $((N+1)^2-(BG_{TOT})\times nFG$, which may also be referred to as the reduced foreground V[k] vectors 55.

The quantization unit 52 may represent a unit configured to perform any form of quantization to compress the reduced foreground V[k] vectors 55 to generate coded foreground V[k] vectors 57, outputting these coded foreground V[k] vectors 57 to the bitstream generation unit 42. In operation, the quantization unit 52 may represent a unit configured to compress a spatial component of the soundfield, i.e., one or more of the reduced foreground V[k] vectors 55 in this example. For purposes of example, the reduced foreground V[k] vectors 55 are assumed to include two row vectors having, as a result of the coefficient reduction, less than 25 elements each (which implies a fourth order HOA representation of the soundfield). Although described with respect to two row vectors, any number of vectors may be included in the reduced foreground V[k] vectors 55 up to $(n+1)^2$, where n denotes the order of the HOA representation of the soundfield. Moreover, although described below as performing a scalar and/or entropy quantization, the quantization unit 52 may perform any form of quantization that results in compression of the reduced foreground V[k] vectors 55.

The quantization unit 52 may receive the reduced foreground V[k] vectors 55 and perform a compression scheme to generate coded foreground V[k] vectors 57. This compression scheme may involve any conceivable compression scheme for compressing elements of a vector or data generally, and should not be limited to the example described below in more detail. The quantization unit 52 may perform, as an example, a compression scheme that includes one or more of transforming floating point representations of each element of the reduced foreground V[k] vectors 55 to integer representations of each element of the reduced foreground V[k] vectors 55, uniform quantization of the integer representations of the reduced foreground V[k] vectors 55 and categorization and coding of the quantized integer representations of the remaining foreground V[k] vectors 55.

In some examples, various of the one or more processes of this compression scheme may be dynamically controlled by parameters to achieve or nearly achieve, as one example, a target bitrate for the resulting bitstream 21. Given that each of the reduced foreground V[k] vectors 55 are orthonormal to one another, each of the reduced foreground V[k] vectors 55 may be coded independently. In some examples, as described in more detail below, each element of each reduced foreground V[k] vectors 55 may be coded using the same coding mode (defined by various sub-modes).

In any event, as noted above, this coding scheme may first involve transforming the floating point representations of each element (which is, in some examples, a 32-bit floating point number) of each of the reduced foreground V[k] vectors 55 to a 16-bit integer representation. The quantization unit 52 may perform this floating-point-to-integer-transformation by multiplying each element of a given one of the reduced foreground V[k] vectors 55 by $2^{15}$, which is, in some examples, performed by a right shift by 15.

The quantization unit 52 may then perform uniform quantization with respect to all of the elements of the given one of the reduced foreground V[k] vectors 55. The quantization unit 52 may identify a quantization step size based on a value, which may be denoted as an nbits parameter. The quantization unit 52 may dynamically determine this nbits parameter based on the target bitrate 41. The quantization unit 52 may determining the quantization step size as a function of this nbits parameter. As one example, the quantization unit 52 may determine the quantization step size (denoted as "delta" or "Δ" in this disclosure) as equal to $2^{16-nbits}$. In this example, if nbits equals six, delta equals $2^{10}$ and there are $2^6$ quantization levels. In this respect, for a vector element v, the quantized vector element $v_q$ equals [v/Δ] and $-2^{nbits-1}<v_q<2^{nbits-1}$.

The quantization unit 52 may then perform categorization and residual coding of the quantized vector elements. As one example, the quantization unit 52 may, for a given quantized vector element $v_q$ identify a category (by determining a category identifier cid) to which this element corresponds using the following equation:

$$cid = \begin{cases} 0, & \text{if } v_q = 0 \\ \lfloor \log_2 |v_q| \rfloor + 1, & \text{if } v_q \neq 0 \end{cases}$$

The quantization unit 52 may then Huffman code this category index cid, while also identifying a sign bit that indicates whether $v_q$ is a positive value or a negative value. The quantization unit 52 may next identify a residual in this category. As one example, the quantization unit 52 may determine this residual in accordance with the following equation:

$$\text{residual}=|v_q|-2^{cid-1}$$

The quantization unit 52 may then block code this residual with cid-1 bits.

The following example illustrates a simplified example of this categorization and residual coding process. First, assume nbits equals six so that $v_q \in [-31,31]$. Next, assume the following:

| cid | vq | Huffman Code for cid |
|---|---|---|
| 0 | 0 | '1' |
| 1 | −1, 1 | '01' |
| 2 | −3, −2, 2, 3 | '000' |
| 3 | −7, −6, −5, −4, 4, 5, 6, 7 | '0010' |
| 4 | −15, −14, . . . , −8, 8, . . . , 14, 15 | '00110' |
| 5 | −31, −30, . . . , −16, 16, . . . , 30, 31 | '00111' |

Also, assume the following:

| cid | Block Code for Residual |
|---|---|
| 0 | N/A |
| 1 | 0, 1 |
| 2 | 01, 00, 10, 11 |
| 3 | 011, 010, 001, 000, 100, 101, 110, 111 |
| 4 | 0111, 0110 . . . , 0000, 1000, . . . , 1110, 1111 |
| 5 | 01111, . . . , 00000, 10000, . . . , 11111 |

Thus, for a $v_q$=[6, −17, 0, 0, 3], the following may be determined:

cid=3,5,0,0,2
sign=1,0,x,x,1
residual=2,1,x,x,1
Bits for 6='0010'+'1'+'10'
Bits for −17='00111'+'0'+'0001'
Bits for 0='0'
Bits for 0='0'
Bits for 3='000'+'1'+'1'
Total bits=7+10+1+1+5=24
Average bits=24/5=4.8

While not shown in the foregoing simplified example, the quantization unit 52 may select different Huffman code books for different values of nbits when coding the cid. In some examples, the quantization unit 52 may provide a different Huffman coding table for nbits values 6, . . . , 15. Moreover, the quantization unit 52 may include five different Huffman code books for each of the different nbits values ranging from 6, . . . , 15 for a total of 50 Huffman code books. In this respect, the quantization unit 52 may include a plurality of different Huffman code books to accommodate coding of the cid in a number of different statistical contexts.

To illustrate, the quantization unit 52 may, for each of the nbits values, include a first Huffman code book for coding vector elements one through four, a second Huffman code book for coding vector elements five through nine, a third Huffman code book for coding vector elements nine and above. These first three Huffman code books may be used when the one of the reduced foreground V[k] vectors 55 to be compressed is not predicted from a temporally subsequent corresponding one of the reduced foreground V[k] vectors 55 and is not representative of spatial information of a synthetic audio object (one defined, for example, originally by a pulse code modulated (PCM) audio object). The quantization unit 52 may additionally include, for each of the nbits values, a fourth Huffman code book for coding the one of the reduced foreground V[k] vectors 55 when this one of the reduced foreground V[k] vectors 55 is predicted from a temporally subsequent corresponding one of the reduced foreground V[k] vectors 55. The quantization unit 52 may also include, for each of the nbits values, a fifth Huffman code book for coding the one of the reduced foreground V[k] vectors 55 when this one of the reduced foreground V[k] vectors 55 is representative of a synthetic audio object. The various Huffman code books may be developed for each of these different statistical contexts, i.e., the non-predicted and non-synthetic context, the predicted context and the synthetic context in this example.

The following table illustrates the Huffman table selection and the bits to be specified in the bitstream to enable the decompression unit to select the appropriate Huffman table:

| Pred mode | HT info | HT table |
|---|---|---|
| 0 | 0 | HT5 |
| 0 | 1 | HT{1, 2, 3} |
| 1 | 0 | HT4 |
| 1 | 1 | HT5 |

In the foregoing table, the prediction mode ("Pred mode") indicates whether prediction was performed for the current vector, while the Huffman Table ("HT info") indicates additional Huffman code book (or table) information used to select one of Huffman tables one through five.

The following table further illustrates this Huffman table selection process given various statistical contexts or scenarios.

| | Recording | Synthetic |
|---|---|---|
| W/O Pred | HT{1, 2, 3} | HT5 |
| With Pred | HT4 | HT5 |

In the foregoing table, the "Recording" column indicates the coding context when the vector is representative of an audio object that was recorded while the "Synthetic" column indicates a coding context for when the vector is representative of a synthetic audio object. The "W/O Pred" row indicates the coding context when prediction is not performed with respect to the vector elements, while the "With Pred" row indicates the coding context when prediction is performed with respect to the vector elements. As shown in this table, the quantization unit 52 selects HT{1, 2, 3} when the vector is representative of a recorded audio object and prediction is not performed with respect to the vector elements. The quantization unit 52 selects HT5 when the audio object is representative of a synthetic audio object and prediction is not performed with respect to the vector elements. The quantization unit 52 selects HT4 when the vector is representative of a recorded audio object and prediction is performed with respect to the vector elements. The quantization unit 52 selects HT5 when the audio object is representative of a synthetic audio object and prediction is performed with respect to the vector elements.

In this respect, the quantization unit 52 may perform the above noted scalar quantization and/or Huffman encoding to compress the reduced foreground V[k] vectors 55, outputting the coded foreground V[k] vectors 57, which may be referred to as side channel information 57. This side channel information 57 may include syntax elements used to code the remaining foreground V[k] vectors 55.

As noted above, the quantization unit 52 may generate syntax elements for the side channel information 57. For example, the quantization unit 52 may specify a syntax element in a header of an access unit (which may include one or more frames) denoting which of the plurality of configuration modes was selected. Although described as being specified on a per access unit basis, quantization unit 52 may specify this syntax element on a per frame basis or any other periodic basis or non-periodic basis (such as once for the entire bitstream). In any event, this syntax element may comprise two bits indicating which of the four configuration modes were selected for specifying the non-zero set of coefficients of the reduced foreground V[k] vectors 55 to represent the directional aspects of this distinct component. The syntax element may be denoted as "codedVVecLength." In this manner, the quantization unit 52 may signal or otherwise specify in the bitstream which of the four configuration modes were used to specify the coded foreground V[k] vectors 57 in the bitstream. Although described with respect to four configuration modes, the techniques should not be limited to four configuration modes but to any number of configuration modes, including a single configuration mode or a plurality of configuration modes. The scalar/entropy quantization unit 53 may also specify the flag 63 as another syntax element in the side channel information 57.

The mezzanine format unit 40 included within the spatial audio encoding device 20 may represent a unit that formats data to conform to a known format (which may refer to a format known by a decoding device), thereby generating the mezzanine formatted audio data 15. The mezzanine format unit 40 may represent a multiplexer in some examples, which may receive the coded foreground V[k] vectors 57 energy compensated ambient HOA coefficients 47', the interpolated nFG signals 49' and the background channel information 43. The mezzanine format unit 40 may then generate the mezzanine formatted audio data 15 based on the coded foreground V[k] vectors 57, the energy compensated ambient HOA coefficients 47', the interpolated nFG signals 49' and the background channel information 43. As noted above, the mezzanine formatted audio data 15 may include PCM transport channels and sideband (or, in other words, sidechannel) information.

In this way, the techniques may enable a spatial audio encoding device 20 to be configured to store higher order ambisonic audio data, perform mezzanine compression with respect to the higher order ambisonic audio data to obtain mezzanine formatted audio data.

In these and other instances, the spatial audio encoding device 20 may be configured to perform the mezzanine compression that does not involve any application of psychoacoustic audio encoding with respect to the higher order ambisonic audio data to obtain the mezzanine formatted audio data.

In these and other instances, the spatial audio encoding device 20 may be configured to perform spatial audio encoding with respect to the higher order ambisonic audio data to obtain the mezzanine formatted audio data.

In these and other instances, the spatial audio encoding device 20 may be configured to perform a vector-based synthesis or decomposition with respect to the higher order ambisonic audio data to obtain the mezzanine formatted audio data.

In these and other instances, the spatial audio encoding device 20 may be configured to perform a singular value decomposition with respect to the higher order ambisonic audio data to obtain the mezzanine formatted audio data.

In these and other instances, the mezzanine formatted audio data includes one or more background components of a soundfield represented by the higher order ambisonic audio data.

In these and other instances, the background components include higher order ambisonic coefficients of the higher order ambisonic audio data corresponding to spherical basis function having an order less than two.

In these and other instances, the background components only include higher order ambisonic coefficients of the higher order ambisonic audio data corresponding to spherical basis function having an order less than two.

In these and other instances, the mezzanine formatted audio data includes one or more foreground components of a soundfield represented by the higher order ambisonic audio data.

In these and other instances, the spatial audio encoding device 20 may be configured to perform a vector-based synthesis or decomposition with respect to the higher order ambisonic audio data to obtain the mezzanine formatted audio data. In these instances, the foreground components include foreground audio objects decomposed from the higher order audio objects by performing the vector-based synthesis or decomposition with respect to the higher order ambisonic audio data.

In these and other instances, the mezzanine formatted audio data includes one or more background components and one or more foreground components of a soundfield represented by the higher order ambisonic audio data.

In these and other instances, the mezzanine formatted audio data includes one or more pulse code modulated (PCM) transport channels and sideband information.

In these and other instances, the spatial audio encoding device 20 may be configured to perform a vector-based synthesis or decomposition with respect to the higher order ambisonic audio data to obtain the mezzanine formatted audio data. In these instances, the sideband information includes directional information output as a result of performing the vector-based synthesis or decomposition with respect to the higher order ambisonic audio data.

In these and other instances, the spatial audio encoding device 20 may be configured to perform a singular value decomposition with respect to the higher order ambisonic audio data to obtain the mezzanine formatted audio data. In these instances, the sideband information includes one or more V vectors output as a result of performing the vector-based synthesis or decomposition with respect to the higher order ambisonic audio data.

In these and other instances, the spatial audio encoding device 20 may be configured to transmit the mezzanine formatted audio data to a broadcasting network for processing by the broadcasting network.

In these and other instances, the spatial audio encoding device 20 may be configured to transmit the mezzanine formatted audio data to a broadcasting network for insertion of additional audio data into the mezzanine formatted audio data prior to broadcasting the mezzanine formatted audio data.

FIG. 11 is a block diagram illustrating the audio decoding device 24 of FIG. 11 in more detail. As shown in the example of FIG. 11 the audio decoding device 24 may include an extraction unit 72, a directionality-based reconstruction unit 90 and a vector-based reconstruction unit 92. Although described below, more information regarding the audio decoding device 24 and the various aspects of decompressing or otherwise decoding HOA coefficients is available in International Patent Application Publication No. WO 2014/194099, entitled "INTERPOLATION FOR DECOMPOSED REPRESENTATIONS OF A SOUND FIELD," filed 29 May 2014.

The extraction unit 72 may represent a unit configured to receive the bitstream 15 and extract the a vector-based encoded version of the HOA coefficients 11. The extraction unit 72 may determine from the above noted syntax element indicative of whether the HOA coefficients 11 were encoded via the various direction-based or vector-based versions. The extraction unit 72 may extract the coded foreground V[k] vectors 57 (which may include coded weights 57 and/or indices 63 or scalar quantized V-vectors), the encoded ambient HOA coefficients 59 and the corresponding audio objects 61 (which may also be referred to as the encoded nFG signals 61). The audio objects 61 each correspond to one of the vectors 57. The extraction unit 72 may pass the coded foreground V[k] vectors 57 to the V-vector reconstruction unit 74 and the encoded ambient HOA coefficients 59 along with the encoded nFG signals 61 to the psychoacoustic decoding unit 80.

The V-vector reconstruction unit 74 may represent a unit configured to reconstruct the V-vectors from the encoded foreground V[k] vectors 57. The V-vector reconstruction unit 74 may operate in a manner reciprocal to that of the quantization unit 52.

The psychoacoustic decoding unit 80 may operate in a manner reciprocal to the psychoacoustic audio coder unit 40 shown in the example of FIG. 11 so as to decode the encoded ambient HOA coefficients 59 and the encoded nFG signals 61 and thereby generate energy compensated ambient HOA coefficients 47' and the interpolated nFG signals 49' (which may also be referred to as interpolated nFG audio objects 49'). The psychoacoustic decoding unit 80 may pass the energy compensated ambient HOA coefficients 47' to the fade unit 770 and the nFG signals 49' to the foreground formulation unit 78.

The spatio-temporal interpolation unit 76 may operate in a manner similar to that described above with respect to the spatio-temporal interpolation unit 50. The spatio-temporal interpolation unit 76 may receive the reduced foreground V[k] vectors $\mathbf{55}_k$ and perform the spatio-temporal interpolation with respect to the foreground V[k] vectors $\mathbf{55}_k$ and the reduced foreground V[k−1] vectors $\mathbf{55}_{k-1}$ to generate interpolated foreground V[k] vectors $\mathbf{55}_k''$. The spatio-temporal interpolation unit 76 may forward the interpolated foreground V[k] vectors $\mathbf{55}_k''$ to the fade unit 770.

The extraction unit 72 may also output a signal 757 indicative of when one of the ambient HOA coefficients is in transition to fade unit 770, which may then determine which of the $SHC_{BG}$ 47' (where the $SHC_{BG}$ 47' may also be denoted as "ambient HOA channels 47'''" or "ambient HOA coefficients 47'''") and the elements of the interpolated foreground V[k] vectors $\mathbf{55}_k''$ are to be either faded-in or faded-out. In some examples, the fade unit 770 may operate opposite with respect to each of the ambient HOA coefficients 47' and the elements of the interpolated foreground V[k] vectors $\mathbf{55}_k''$. That is, the fade unit 770 may perform a fade-in or fade-out, or both a fade-in or fade-out with respect to corresponding one of the ambient HOA coefficients 47', while performing a fade-in or fade-out or both a fade-in and a fade-out, with respect to the corresponding one of the elements of the interpolated foreground V[k] vectors $\mathbf{55}_k''$. The fade unit 770 may output adjusted ambient HOA coefficients 47'' to the HOA coefficient formulation unit 82 and adjusted foreground V[k] vectors $\mathbf{55}_k'''$ to the foreground formulation unit 78. In this respect, the fade unit 770 represents a unit configured to perform a fade operation with respect to various aspects of the HOA coefficients or derivatives thereof, e.g., in the form of the ambient HOA coefficients 47' and the elements of the interpolated foreground V[k] vectors $\mathbf{55}_k''$.

The foreground formulation unit 78 may represent a unit configured to perform matrix multiplication with respect to the adjusted foreground V[k] vectors $\mathbf{55}_k'''$ and the interpolated nFG signals 49' to generate the foreground HOA coefficients 65. In this respect, the foreground formulation unit 78 may combine the audio objects 49' (which is another way by which to denote the interpolated nFG signals 49') with the vectors $\mathbf{55}_k'''$ to reconstruct the foreground or, in other words, predominant aspects of the HOA coefficients 11'. The foreground formulation unit 78 may perform a matrix multiplication of the interpolated nFG signals 49' by the adjusted foreground V[k] vectors $\mathbf{55}_k'''$.

The HOA coefficient formulation unit 82 may represent a unit configured to combine the foreground HOA coefficients 65 to the adjusted ambient HOA coefficients 47" so as to obtain the HOA coefficients 11'. The prime notation reflects that the HOA coefficients 11' may be similar to but not the same as the HOA coefficients 11. The differences between the HOA coefficients 11 and 11' may result from loss due to transmission over a lossy transmission medium, quantization or other lossy operations. In these and other instances, the broadcasting network center 402 may be configured to perform mezzanine decompression with respect to the mezzanine formatted audio data to obtain the higher order ambisonic audio data, perform higher order ambisonic conversion with respect to the higher order ambisonic audio data to obtain spatially formatted audio data, and monitor the spatially formatted audio data.

In one or more examples, the functions described may be implemented in hardware, software, firmware, or any combination thereof. If implemented in software, the functions may be stored on or transmitted over as one or more instructions or code on a computer-readable medium and executed by a hardware-based processing unit. Computer-readable media may include computer-readable storage media, which corresponds to a tangible medium such as data storage media Data storage media may be any available media that can be accessed by one or more computers or one or more processors to retrieve instructions, code and/or data structures for implementation of the techniques described in this disclosure. A computer program product may include a computer-readable medium.

Likewise, in each of the various instances described above, it should be understood that the audio decoding device 24 may perform a method or otherwise comprise means to perform each step of the method for which the audio decoding device 24 is configured to perform. In some instances, the means may comprise one or more processors. In some instances, the one or more processors may represent a special purpose processor configured by way of instructions stored to a non-transitory computer-readable storage medium. In other words, various aspects of the techniques in each of the sets of encoding examples may provide for a non-transitory computer-readable storage medium having stored thereon instructions that, when executed, cause the one or more processors to perform the method for which the audio decoding device 24 has been configured to perform.

By way of example, and not limitation, such computer-readable storage media can comprise RAM, ROM, EEPROM, CD-ROM or other optical disk storage, magnetic disk storage, or other magnetic storage devices, flash memory, or any other medium that can be used to store desired program code in the form of instructions or data structures and that can be accessed by a computer. It should be understood, however, that computer-readable storage media and data storage media do not include connections, carrier waves, signals, or other transitory media, but are instead directed to non-transitory, tangible storage media. Disk and disc, as used herein, includes compact disc (CD), laser disc, optical disc, digital versatile disc (DVD), floppy disk and Blu-ray disc, where disks usually reproduce data magnetically, while discs reproduce data optically with lasers. Combinations of the above should also be included within the scope of computer-readable media.

Instructions may be executed by one or more processors, such as one or more digital signal processors (DSPs), general purpose microprocessors, application specific integrated circuits (ASICs), field programmable logic arrays (FPGAs), or other equivalent integrated or discrete logic circuitry. Accordingly, the term "processor," as used herein may refer to any of the foregoing structure or any other structure suitable for implementation of the techniques described herein. In addition, in some aspects, the functionality described herein may be provided within dedicated hardware and/or software modules configured for encoding and decoding, or incorporated in a combined codec. Also, the techniques could be fully implemented in one or more circuits or logic elements.

The techniques of this disclosure may be implemented in a wide variety of devices or apparatuses, including a wireless handset, an integrated circuit (IC) or a set of ICs (e.g., a chip set). Various components, modules, or units are described in this disclosure to emphasize functional aspects of devices configured to perform the disclosed techniques, but do not necessarily require realization by different hardware units. Rather, as described above, various units may be combined in a codec hardware unit or provided by a collection of interoperative hardware units, including one or more processors as described above, in conjunction with suitable software and/or firmware.

Various aspects of the techniques have been described. These and other aspects of the techniques are within the scope of the following claims.

What is claimed is:

1. A method of compressing higher order ambisonic (HOA) coefficients representative of a soundfield, the method comprising:

determining whether to augment one or more foreground audio objects with ambient HOA coefficients of the HOA coefficients based on one or more singular values obtained through decomposition of the HOA coefficients, the ambient HOA coefficients representative of an ambient component of the soundfield, and the foreground audio objects and the ambient HOA coefficients being obtained through the decomposition of the HOA coefficients; wherein the HOA coefficients also include one or more foreground HOA coefficients representative of the one or more foreground audio objects of the soundfield, and compressing, with an encoding device, the one or more foreground HOA coefficients; and generating a bitstream including the compressed one or more foreground HOA coefficients.

2. The method of claim 1, wherein determining whether to augment the one or more foreground audio objects in the bitstream with the ambient HOA coefficients comprises analyzing the one or more singular values obtained through the decomposition of the HOA coefficients.

3. The method of claim 1, wherein determining whether to augment the one or more foreground audio objects in the bitstream with the ambient HOA coefficients comprises:

determining whether one or more ambient singular values of the one or more singular values are less than a threshold value, wherein the ambient singular values are associated with the ambient component of the soundfield; and when the one or more ambient singular values associated with the ambient component are less than the threshold value, determining not to use the ambient HOA coefficients to augment the foreground audio objects.

4. The method of claim 3, wherein determining whether to augment the one or more foreground audio objects in the bitstream with the ambient HOA coefficients comprises:

when the one or more ambient singular values are equal to or greater than the threshold value, determining to use the ambient HOA coefficients to augment the foreground audio objects.

5. The method of claim 1, wherein each of the one or more singular values represents a square root of a corresponding energy value.

6. The method of claim 1, wherein each of the one or more singular values represents a square root of a corresponding eigenvalue.

7. The method of claim 1, further comprising coding one or more S matrices that include the one or more singular values.

8. The method of claim 1, wherein determining whether to augment the one or more foreground audio objects in the bitstream with the ambient HOA coefficients is based on one or more amplitudes corresponding to one or more ambient singular values of the one or more singular values, the ambient singular values being associated with the ambient component of the soundfield.

9. The method of claim 1, wherein determining whether to use the ambient HOA coefficients to augment the one or more foreground audio objects comprises:

determining to use the ambient HOA coefficients to augment the foreground audio objects; and determining a number of bits to assign to the ambient component.

10. The method of claim 1, further comprising compressing, with the encoding device, the ambient HOA coefficients, and wherein the bitstream also includes the compressed ambient coefficients.

11. A device for compressing higher order ambisonic (HOA) coefficients representative of a soundfield, the device comprising:

a memory configured to store the HOA coefficients of the soundfield; and one or more processors configured to:

determine whether to augment one or more foreground audio objects in a bitstream with ambient HOA coefficients of the HOA coefficients, the ambient HOA coefficients representative of an ambient component of the soundfield, and the foreground audio objects and the ambient HOA coefficients being obtained through the decomposition of the HOA coefficients;

process the HOA coefficients, the HOA coefficients comprising one or more foreground HOA coefficients representative of the one or more foreground audio objects of the soundfield;

compress the one or more foreground HOA coefficients; and generate a bitstream including the compressed one or more foreground HOA coefficients.

12. The device of claim 11, wherein, to determine whether to augment the one or more foreground audio objects, the one or more processors are configured to analyze the one or more singular values obtained through the decomposition of the HOA coefficients.

13. The device of claim 11, wherein, to determine whether to augment the one or more foreground audio objects in the bitstream with the ambient HOA coefficients, the one or more processors are configured to:

determine whether one or more ambient singular values of the one or more singular values are less than a threshold value, wherein the ambient singular values are associated with the ambient component of the soundfield; and when the one or more ambient singular values associated with the ambient component are less than the threshold value, determine not to use the ambient HOA coefficients to augment the foreground audio objects.

14. The device of claim 13, wherein, to determine whether to augment the one or more foreground audio objects in the bitstream with the ambient HOA coefficients, the one or more processors are configured to:

when the one or more ambient singular values are equal to or greater than the threshold value, augment the foreground audio objects in the bitstream with the ambient HOA coefficients.

15. The device of claim 11, wherein the one or more processors are configured to process the one or more singular values, each of the one or more singular values representing a square root of a corresponding energy value.

16. The device of claim 11, wherein the one or more processors are configured to process the one or more singular values, each of the one or more singular values representing a square root of a corresponding eigenvalue.

17. The device of claim 11, wherein the one or more processors are further configured to code one or more S matrices that include the one or more singular values.

18. The device of claim 11, wherein, to determine whether to augment the one or more foreground audio objects in the bitstream with the ambient HOA coefficients, the one or more processors are configured to determine whether to augment the one or more foreground audio objects in the bitstream with the ambient HOA coefficients based on one or more amplitudes corresponding to one or more ambient singular values of the one or more singular values, the ambient singular values being associated with the ambient component of the soundfield.

19. The device of claim 11, wherein, to determine whether to augment the one or more foreground audio objects in the bitstream with the ambient HOA coefficients, the one or more processors are configured to:

determine to use the ambient HOA coefficients to augment the foreground audio objects; and determine a number of bits to assign to the ambient component.

20. The device of claim 11, further comprising a microphone array configured to capture audio data associated with the HOA coefficients representative of the soundfield.

21. The device of claim 20, wherein the microphone array is configured to output the HOA coefficients representative of the soundfield.

22. The device of claim 20, wherein the microphone array is included in a three-dimensional microphone.

23. The device of claim 11, further comprising the one or more processors configured to compress the ambient HOA coefficients, and wherein the bitstream also includes the compressed ambient coefficients.

24. A device for compressing higher order ambisonic (HOA) coefficients representative of a soundfield, the device comprising:

means for determining whether to augment one or more foreground audio objects in a bitstream with ambient HOA coefficients of the HOA coefficients, the ambient HOA coefficients representative of an ambient component of the soundfield, and the foreground audio objects and the ambient HOA coefficients being obtained through the decomposition of the HOA coefficients;

means for processing the HOA coefficients, the HOA coefficients comprising one or more foreground HOA coefficients representative of the one or more foreground audio objects of the soundfield;

means for compressing the one or more foreground HOA coefficients; and means for generating a bitstream including the compressed one or more foreground HOA coefficients.

25. The device of claim 24, further comprising means for compressing the ambient HOA coefficients, and wherein the bitstream also includes the compressed ambient coefficients.

* * * * *